US007705807B2

(12) United States Patent
Nagao et al.

(10) Patent No.: US 7,705,807 B2
(45) Date of Patent: Apr. 27, 2010

(54) PLASMA DISPLAY PANEL DRIVING METHOD AND PLASMA DISPLAY PANEL APPARATUS CAPABLE OF DISPLAYING HIGH-QUALITY IMAGES WITH HIGH LUMINOUS EFFICIENCY

(75) Inventors: Nobuaki Nagao, Kyoto (JP); Hidetaka Higashino, Kyoto (JP); Junichi Hibino, Osaka (JP)

(73) Assignee: Panasonic Corporation, Osaka (JP)

( * ) Notice: Subject to any disclaimer, the term of this patent is extended or adjusted under 35 U.S.C. 154(b) by 176 days.

(21) Appl. No.: 11/927,821

(22) Filed: Oct. 30, 2007

(65) Prior Publication Data

US 2008/0062081 A1 Mar. 13, 2008

Related U.S. Application Data

(60) Division of application No. 10/630,586, filed on Jul. 30, 2003, now Pat. No. 7,468,714, which is a continuation of application No. 09/786,384, filed on Mar. 2, 2001, now Pat. No. 6,653,993.

(51) Int. Cl.
*G09G 3/28* (2006.01)

(52) U.S. Cl. ..... 345/68; 345/60

(58) Field of Classification Search ..... 345/60–68; 315/169.4

See application file for complete search history.

(56) References Cited

U.S. PATENT DOCUMENTS 3,919,591 A 11/1975 Criscimagna
4,063,131 A 12/1977 Miller et al.
4,087,805 A 5/1978 Miller
4,100,535 A 7/1978 Bitzer et al.
4,104,563 A 8/1978 Shlig et al.
4,140,945 A 2/1979 Trogdon
4,180,762 A 12/1979 Weber
4,320,418 A 3/1982 Pavliscak
4,562,434 A 12/1985 Amano
4,570,159 A 2/1986 Criscimagna et al.

(Continued)

FOREIGN PATENT DOCUMENTS

EP 0 032 196 7/1981

(Continued)

OTHER PUBLICATIONS

Weber, Larry F., Plasma Display Device Challenges, Proceedings of the 18th International Display Research Conference, Asia Display '98, presented at Sheraton Walker-Hill, Seoul, Korea, Sep. 28-Oct. 1, 1998, Sponsored by Society for Information Display & The Korean Physical Society, pp. 15-27.

(Continued)

*Primary Examiner*—Kevin M Nguyen

(57) ABSTRACT

Set-up, write, sustain and erase pulses are variously applied to a plasma display panel using a staircase waveform in which the rising or falling portion is in at least two steps. These staircase waveforms can be realized by adding at least two pulses. Use of such waveforms for the set-up, write and erase pulses improves contrast, and use for the sustain pulses reduces screen flicker and improves luminous efficiency. This is of particular use in driving high definition plasma display panels to achieve high image quality and high luminance.

10 Claims, 43 Drawing Sheets

U.S. PATENT DOCUMENTS

| | | | | |
|---|---|---|---|---|
| 4,591,847 | A | 5/1986 | Criscimagna et al. | |
| 4,683,470 | A | 7/1987 | Criscimagna et al. | |
| 5,142,200 | A | 8/1992 | Yamamoto et al. | |
| 5,446,344 | A | 8/1995 | Kanazawa | |
| 5,663,741 | A | 9/1997 | Kanazawa | |
| 5,745,086 | A | 4/1998 | Weber | |
| 5,844,373 | A | 12/1998 | Yao et al. | |
| 6,011,355 | A * | 1/2000 | Nagai | 315/169.3 |
| 6,020,687 | A | 2/2000 | Hirakawa et al. | |
| 6,037,916 | A | 3/2000 | Amemiya | |
| 6,084,559 | A | 7/2000 | Nagao et al. | |
| 6,160,530 | A * | 12/2000 | Makino | 345/60 |
| 6,215,463 | B1 | 4/2001 | Matsumoto et al. | |
| 6,252,568 | B1 * | 6/2001 | Iseki et al. | 345/60 |
| 6,256,001 | B1 | 7/2001 | Kim et al. | |
| 6,262,699 | B1 | 7/2001 | Suzuki et al. | |
| 6,292,159 | B1 | 9/2001 | Someya et al. | |
| 6,317,105 | B1 | 11/2001 | Eo et al. | |
| 6,414,653 | B1 | 7/2002 | Kobayashi | |
| 6,426,732 | B1 | 7/2002 | Makino | |
| 6,483,487 | B2 | 11/2002 | Iseki | |
| 6,512,501 | B1 | 1/2003 | Nagaoka et al. | |

FOREIGN PATENT DOCUMENTS

| | | | |
|---|---|---|---|
| EP | 102462 | | 3/1984 |
| EP | 0 615 221 | | 9/1994 |
| EP | 0680067 | | 4/1995 |
| EP | 0 779 643 | A2 | 12/1996 |
| EP | 762461 | | 3/1997 |
| EP | 0866439 | | 3/1998 |
| EP | 0 836 171 | | 4/1998 |
| EP | 0 855 692 | | 7/1998 |
| JP | 50-39024 | | 4/1975 |
| JP | 52-150940 | | 12/1977 |
| JP | 52-150941 | | 12/1977 |
| JP | 53-101235 | | 9/1978 |
| JP | 54-148435 | | 11/1979 |
| JP | 56-104389 | | 8/1981 |
| JP | 56-142593 | | 11/1981 |
| JP | 58-65485 | | 4/1983 |
| JP | 59-61886 | | 4/1984 |
| JP | 59-181393 | | 10/1984 |
| JP | 61-107297 | | 5/1986 |
| JP | 62-196696 | | 8/1987 |
| JP | 03-175491 | | 7/1991 |
| JP | 3-259183 | | 11/1991 |
| JP | 4-113754 | | 4/1992 |
| JP | 04-267293 | | 9/1992 |
| JP | 5-6147 | | 1/1993 |
| JP | 5-183341 | | 7/1993 |
| JP | 6-67617 | | 3/1994 |
| JP | 6-187915 | | 7/1994 |
| JP | 06-314078 | | 11/1994 |
| JP | 736408 | | 2/1995 |
| JP | 7-134566 | | 5/1995 |
| JP | 7-146667 | | 6/1995 |
| JP | 7-160218 | | 6/1995 |
| JP | 7-271325 | | 10/1995 |
| JP | 7-283844 | | 10/1995 |
| JP | 7-295506 | | 11/1995 |
| JP | 7-295507 | | 11/1995 |
| JP | 8-30228 | | 2/1996 |
| JP | 08-212930 | | 8/1996 |
| JP | 9-6280 | | 1/1997 |
| JP | 9-68946 | | 3/1997 |
| JP | 9-81073 | | 3/1997 |
| JP | 2616663 | | 3/1997 |
| JP | 9-115450 | | 5/1997 |
| JP | 9-127910 | | 5/1997 |
| JP | 2642956 | | 5/1997 |
| JP | 9-259767 | | 10/1997 |
| JP | 9-297557 | | 11/1997 |
| JP | 10-105111 | | 4/1998 |
| JP | 10-143107 | | 5/1998 |
| JP | 10-149135 | | 6/1998 |
| JP | 10-177363 | | 6/1998 |
| JP | 10-207417 | | 8/1998 |
| JP | 10-207418 | | 8/1998 |
| JP | 10-283934 | | 10/1998 |
| JP | 10-301529 | | 11/1998 |
| JP | 10-319901 | | 12/1998 |
| JP | 10-333635 | | 12/1998 |
| JP | 11-15436 | | 1/1999 |
| JP | 11-52908 | | 2/1999 |
| JP | 11-065514 | | 3/1999 |
| JP | 11-65516 | | 3/1999 |
| JP | 11-065523 | | 3/1999 |
| JP | 11-085099 | | 3/1999 |
| JP | 11-95721 | | 4/1999 |
| JP | 11-109914 | | 4/1999 |
| JP | 11-133914 | | 5/1999 |
| JP | 11-296136 | | 10/1999 |
| JP | 11-352924 | | 12/1999 |
| JP | 2000-47633 | | 2/2000 |
| JP | 2000-47634 | | 2/2000 |
| JP | 2000-47635 | | 2/2000 |
| JP | 2000-122602 | | 4/2000 |
| JP | 2000-155556 | | 6/2000 |
| JP | 2001-518645 | | 10/2001 |
| JP | 3249440 | | 11/2001 |
| JP | 3384809 | | 12/2002 |
| KR | 1998-077754 | | 11/1998 |
| KR | 1998-087502 | | 12/1998 |
| WO | 97/20301 | | 6/1997 |
| WO | 98/21706 | | 5/1998 |
| WO | 9831001 | | 7/1998 |

OTHER PUBLICATIONS

"Write and Erase Waveforms for High-Resolution AC Plasma Display Panels" by T. Criscimagna et al., 2320 Proceedings of the SID 22 (1981) No. 4.

"Sustain Drive with Reduced Peak Sustain current and Full Sustain Margin" by T. Criscimagna, IBM Technical Disclosure Bulletin, vol. 25, No. 73, Dec. 1982.

"Plasma Panel Write Waveform with Avalanche Control" by J.R. Beidl et al., IBM Technical Disclosure Bulletin, vol. 21, No. 3, Aug. 1978.

"9.4: Low Voltage Selection Circuits for Plasma Display Panel" by T. Criscimagna, 1975 SID Int'l Symposium, Apr. 22-24, 1975.

* cited by examiner

| SIGNAL | TYPE OF GAS | LUMINANCE (cd/m$^2$) |
|---|---|---|
| ◆ | He(50)-Ne(48)-Xe(2) | 547 |
| ■ | He(50)-Ne(48)-Xe(2)-Ar(0.1) | 566 |
| ▲ | He(30)-Ne(68)-Xe(2) | 518 |
| ● | He(30)-Ne(67.9)-Xe(2)-Ar(0.1) | 532 |

PLASMA DISPLAY PANEL DRIVING METHOD AND PLASMA DISPLAY PANEL APPARATUS CAPABLE OF DISPLAYING HIGH-QUALITY IMAGES WITH HIGH LUMINOUS EFFICIENCY

This is a divisional application of U.S. Ser. No. 10/630,586, filed on Jul. 30, 2003, now U.S. Pat. No. 7,468,714, issued on Dec. 23, 2008, which is a continuation application of Ser. No. 09/786,384 filed Mar. 2, 2001, U.S. Pat. No. 6,653,993, issued on Nov. 25, 2003.

INDUSTRIAL FIELD OF USE

The present invention relates to a plasma display panel driving method and a plasma display panel display apparatus used as the display screen for computers, televisions and the like, and in particular to a driving method which uses an address-display-period-separated sub-field (hereafter referred to as ADS) method.

RELATED ART

Recently, plasma display panels (hereafter referred to as PDPs) have become the focus of attention for their ability to realize a large, slim and lightweight display apparatus for use in computers, televisions and the like.

PDPs can be broadly divided into two types: direct current (DC) and alternating current (AC). One example of a DC PDP is described in EPO 762,461, which discloses a PDP in which discharge cells are arranged in a matrix. AC PDPs are suitable for large-screen use and so are at present the dominant type.

High-definition television in which high resolutions of up to 1920×1080 pixels is currently being introduced and PDPs should preferably be compatible with this kind of high-definition display, just as with other types of display.

FIG. 1 is a view of a conventional alternating current (AC) PDP.

In this PDP a front substrate 11 and a back substrate 12 are placed in parallel so as to face each other with a space in between. The edges of the substrates are then sealed.

Scanning electrode group 19*a* and sustain electrode group 19*b* are formed in parallel strips on the inward-facing surface of the front substrate 11. The electrode groups 19*a* and 19*b* are covered by a dielectric layer 17 composed of lead glass or similar. The surface of the dielectric layer 17 is then covered with a protective layer 18 of magnesium oxide (MgO). A data electrode group 14 formed in parallel strips is covered by an insulating layer 13 composed of lead glass or similar are placed on the inward-facing surface of the back substrate 12. Barrier ribs 15 are placed on top of the insulating layer 13, in parallel with the data electrode group 14. The space between the front substrate 11 and the back substrate 12 is divided into spaces of 100 to 200 microns by the barrier ribs 15. Discharge gas is sealed in these spaces. The pressure at which the discharge gas is enclosed is normally set below external (atmospheric) pressure, typically in a range of between 200 to 500 torr.

FIG. 2 shows an electrode matrix for the PDP. The electrode groups 19*a* and 19*b* are arranged at right angles to the data electrode group 14. Discharge cells are formed in the space between the substrates, at the points where the electrodes intersect. The barrier ribs 15 separate adjacent discharge cells preventing discharge diffusion between adjacent discharge cells so that a high resolution display can be achieved.

In monochrome PDPs, a gas mixture composed mainly of neon is used as the discharge gas, emitting visible light when discharge is performed. However, in a color PDP like the one in FIG. 1, a phosphor layer 16 composed of phosphors for the three primary colors red (R), green (G) and blue (B) is formed on the inner walls of the discharge cells, and a gas mixture composed mainly of xenon (such as neon/xenon or helium/xenon) is used as the discharge gas. Color display takes place by converting ultraviolet light generated by the discharge into visible light of various colors using the phosphor layer 16.

Discharge cells in this kind of PDP are fundamentally only capable of two display states, ON and OFF. Here, an ADS method in which one frame (one field) is divided into a plurality of sub-frames (sub-fields) and the ON and OFF states in each sub-frame are combined to express a gray scale is used.

FIG. 3 shows a division method for one frame when a 256-level gray scale is expressed. The horizontal axis shows time and the shaded parts show discharge sustain periods.

In the example division method shown in FIG. 3, one frame is made up of eight sub-frames. The ratios of the discharge sustain period for the sub-frames are set respectively at 1, 2, 4, 8, 16, 32, 64, and 128. These eight-bit binary combinations express a 256 gray scale. The NTSC (National Television System Committee) standard for television images stipulates a frame rate of 60 frames per second, so the time for one frame is set at 16.7 ms.

Each sub-frame is composed of the following sequence: a set-up period, a write period, a discharge sustain period and an erase period.

FIG. 4 is a time chart showing when pulses are applied to electrodes during one sub-frame in one related art.

In the set-up period, all the discharge cells are set-up by applying set-up pulses to all of the scan electrodes 19*a*.

In the write period, data pulses are applied to selected data electrodes 14 while scan pulses are applied sequentially to the scan electrodes 19*a*. This causes a wall charge to accumulate in the cells to be ignited, writing one screen of pixel data.

In the discharge sustain period, a bulk pulse voltage is applied across the scan electrodes 19*a* and the sustain electrodes 19*b*, causing discharge to occur in the discharge cells where the wall charge has accumulated, and light to be emitted for a certain period.

In the erase period, narrow erase pulses are applied in bulk to the scan electrodes 19*a*, causing the wall charges in all of the discharge cells to be erased.

In the above driving method, light should normally only be emitted in the discharge sustain period and not in the set-up, write and erase periods. However, discharge occurring when set-up or erase pulses are applied causes the whole panel to emit light and contrast drops accordingly. Discharge occurring when the write pulses are applied also causes discharge cells to emit light, having a further detrimental effect on contrast. Consequently, there is a need to develop techniques for resolving these problems.

The above PDP driving method also should make the discharge sustain period in each frame as long as possible in order to improve luminance. Accordingly, the write pulses (scan pulses and data pulses) should preferably be as short as possible, so that writing can be performed at high speed.

High resolution PDPs have a large number of scan electrodes, so it is particularly desirable that the write pulses (scan pulses and data pulses) be narrow to enable driving to be performed at high speed.

However, in a conventional PDP, setting the write pulse narrowly causes write defects, lowering the quality of the image displayed.

If the voltage for the write pulse is high and the pulse narrow, writing may conceivably be performed at high speed without write defects. Normally, however, higher speed data drivers have lower ability to withstand voltage, so that it is difficult to realize a driving circuit which can write at both a high voltage and a high speed.

In the above PDP driving method, another important issue is driving the PDP with low power consumption. To achieve this, the inefficient power consumed in the discharge sustain period should be reduced to increase luminous efficiency.

DISCLOSURE OF THE INVENTION

An object of the present invention is to provide a PDP driving method that operates at high speed, and improves contrast without causing write defects. A further object of the present invention is to provide a PDP driving method that improves luminous efficiency. Yet another object of the present invention is to provide a PDP driving method that produces high image quality and high luminance without causing flicker and roughness on the screen.

In the present invention, a staircase waveform that rises in two steps or more is used for the set-up pulses. Using this kind of waveform for the set-up pulses rather than a simple rectangular pulse improves contrast without producing write defects.

Using a staircase waveform that falls in two steps or more for the write pulses rather than a simple rectangular pulse enables high speed driving to be performed without causing write defects.

Meanwhile, using a staircase waveform that rises in two steps or more for the write pulses improves contrast without causing write defects.

Furthermore, using a staircase waveform that falls in two steps or more rather than a simple rectangular waveform for the sustain pulses allows a high voltage to be set for the sustain pulses and ensures that operations are performed stably, so that high image quality can be realized.

If a staircase waveform that rises in two steps or more is used for the sustain pulses rather than a simple rectangular wave, luminous efficiency is improved. A particularly marked improvement in luminous efficiency is achieved when the second step of the rising portion and the first step of the falling portion of the waveform correspond to a continuous function.

Luminous efficiency may also be improved by using a waveform whose rising portion is a slope for the sustain pulses.

Another way of improving luminous efficiency is using a waveform in which the voltage at a time when the discharge current is highest is higher than the applied voltage occurring at a time when the pulse starts for the sustain pulses.

Using a staircase waveform with two or more steps for the first sustain pulse to be applied during the discharge sustain period improves image quality.

Additionally, using a staircase waveform that rises in two steps or more for the erase pulses rather than a simple rectangular waveform improves contrast and enables a high quality image to be realized.

Using a staircase waveform that falls in two or more steps for the erase pulses shortens the erase period.

These effects can be further enhanced by using staircase waveforms for the set-up, write, sustain and erase pulses simultaneously.

Staircase waveforms that rise and fall in two steps, like the ones described as being used for the set-up, write, sustain and erase pulses, are realized by adding two or more pulses together.

PREFERRED EMBODIMENTS OF THE INVENTION

The following is an explanation of the embodiments of the invention with reference to the drawings.

Figure 1:
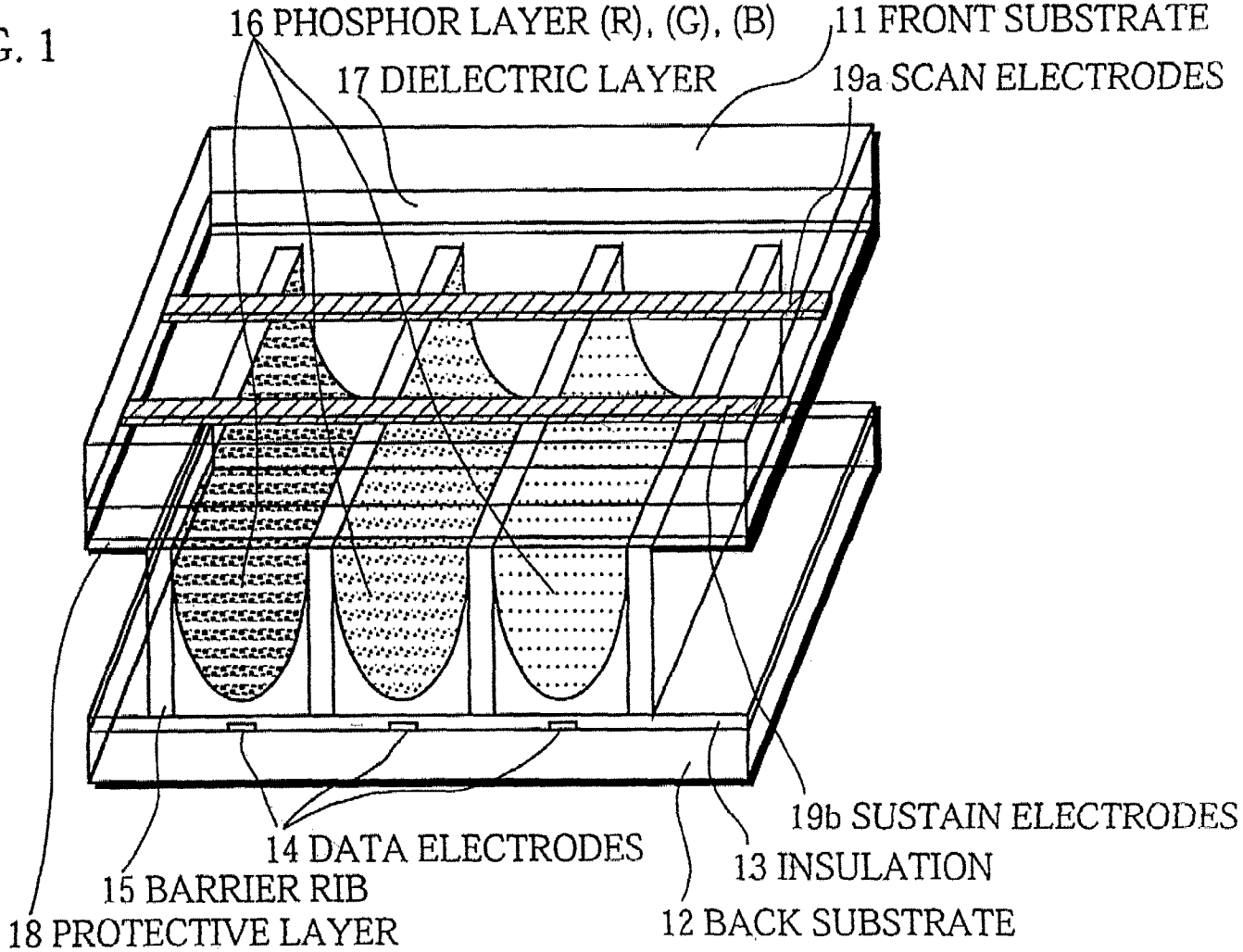
FIG. 1 is an outline of a conventional alternating current PDP.

A PDP 10 used in all of the embodiments has the same physical structure as the PDP explained in the related art section of the application with reference to FIG. 1, so the same numerical references will be used as in FIG. 1.

The driving method of the embodiments basically uses the ADS method explained in the related art section of the application. However, at least one of the set-up pulses, scan pulses, sustain pulses and erase pulses that are respectively applied in the set-up, scan, sustain and erase periods has either a staircase or a slope waveform, rather than a simple rectangular wave.

The following is an explanation of the driving apparatus and the driving method used in the embodiments.

Figure 5:
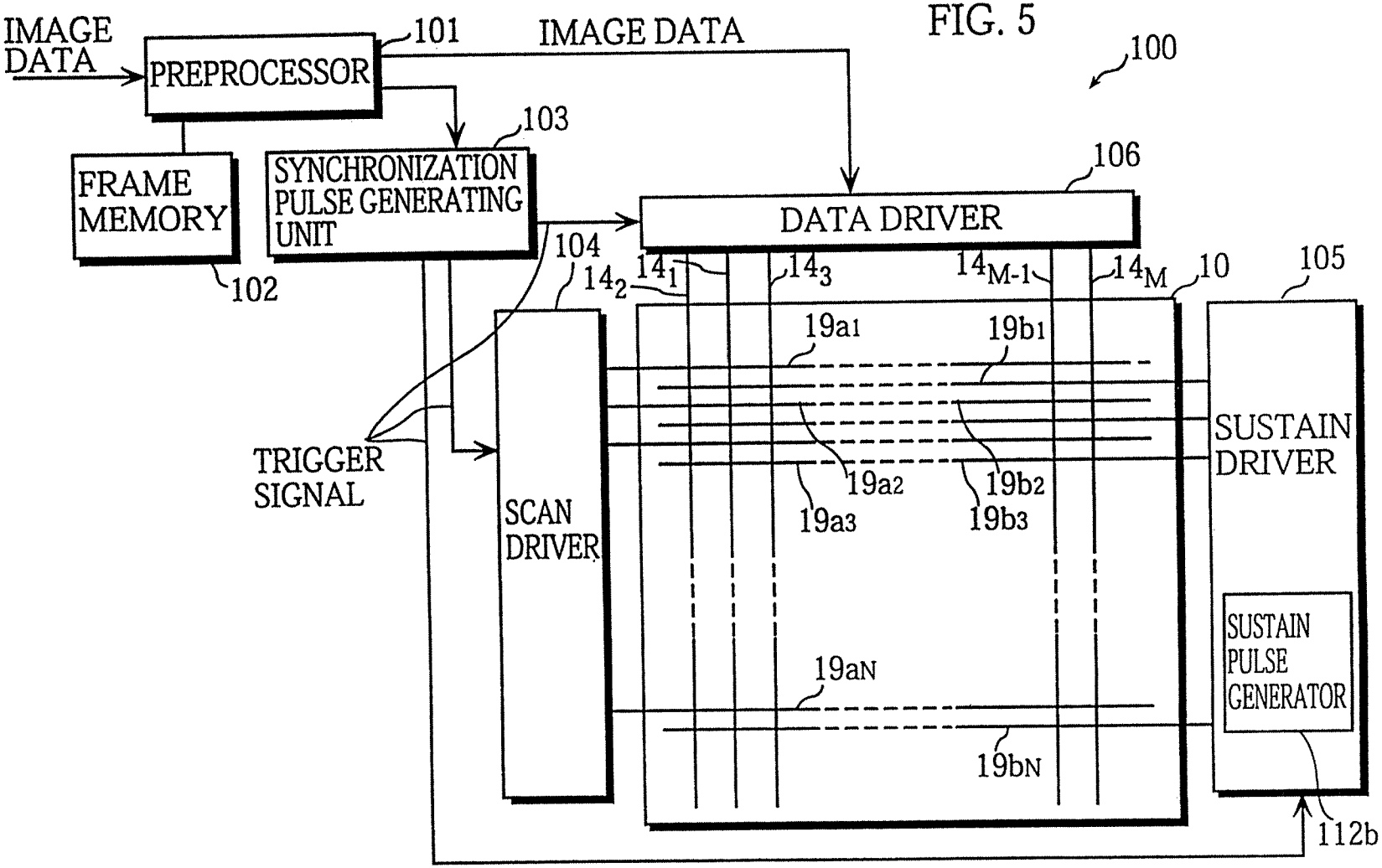
FIG. 5 is a block diagram showing a structure for a PDP driving apparatus relating to the embodiments.

FIG. 5 is a block diagram showing a structure of a driving apparatus 100.

The driving apparatus 100 includes a preprocessor 101, a frame memory 102, a synchronization pulse generating unit 103, a scan driver 104, a sustain driver 105 and a data driver 106. The preprocessor 101 processes image data input from an external image output device. The frame memory 102 stores the processed data. The synchronization pulse generating unit 103 generates synchronization pulses for each frame and each sub-frame. The scan driver 104 applies pulses to the scan electrodes 19*a*, the sustain driver 105 to the sustain electrodes 19*b*, and the data driver to the data electrodes 14.

The preprocessor 101 extracts image data for each frame from the input image data, produces image data for each sub-frame from the extracted image data (the sub-frame image data) and stores it in the frame memory 102. The preprocessor 101 then outputs the current sub-frame image data stored in the frame memory 102 line by line to the data driver 106, detects synchronization signals such as horizontal synchronization signals and vertical synchronization signals from the input image data and sends synchronization signals for each frame and sub-frame to the synchronization pulse generating unit 103.

The frame memory 102 is capable of storing the data for each frame split into sub-frame image data for each sub-frame.

Specifically, the frame memory 102 is a two-port frame memory provided with two memory areas each capable of storing one frame (eight sub-frame images). An operation in which frame image data is written in one memory area, while the frame data written in the other frame memory area is read can be performed alternately on the memory areas.

The synchronization pulse generating unit 103 generates trigger signals indicating the timing at which each of the set-up, scan, sustain and erase pulses should rise. These trigger signals are generated with reference to the synchronization signals received from the preprocessor 101 regarding each frame and each sub-frame, and sent to the drivers 104 to 106.

The scan driver 104 generates and applies the set-up, scan, sustain and erase pulses in response to the trigger signals received from the synchronization pulse generating unit 103.

Figure 6:
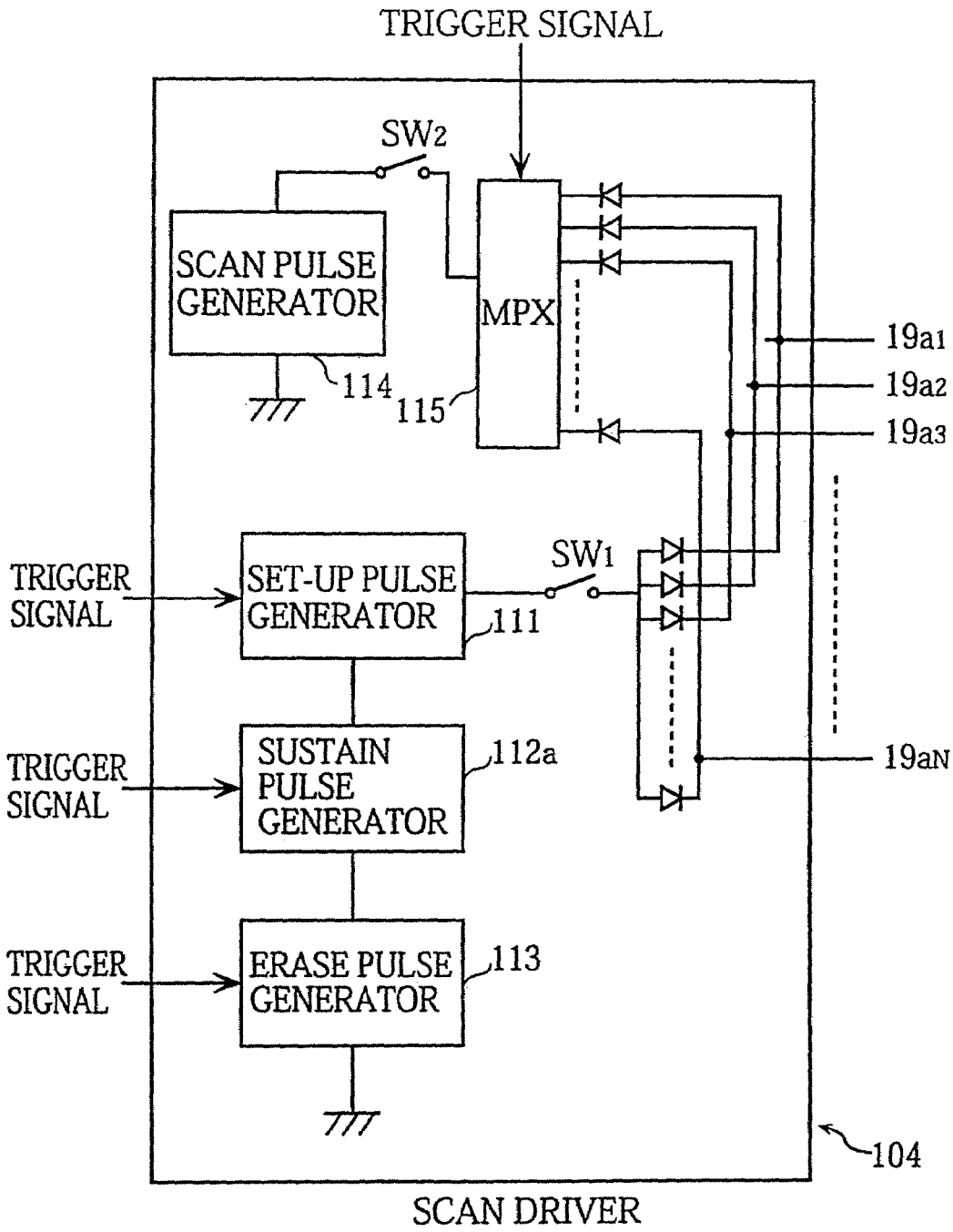
FIG. 6 is a block diagram showing a structure for the scan driver in FIG. 5.

FIG. 6 is a block diagram showing a structure of the scan driver 104.

The set-up, sustain, and erase pulses are applied to all of the scan electrodes 19*a*. The required pulse waveform is different in each case.

As a result, the scan driver 104 has three pulse generators, one for generating each kind of pulse, as shown in FIG. 6. These are a set-up pulse generator 111, a sustain pulse generator 112*a* and an erase pulse generator 113. The three pulse generators are connected in series using a floating ground method and apply the set-up, sustain and erase pulses in turn to the scan electrode group 19*a*, in response to the trigger signals from the synchronization pulse generating unit 103.

As shown in FIG. 6, the scan driver 104 also includes a multiplexer 115 which, along with the scan pulse generator 114 to which it is connected, enables the scan pulses to be applied in sequence to the scan electrodes $\mathbf{19}a_1$, 19*a* and so on, as far as $\mathbf{19}a_N$. A method in which pulses are generated in the scan pulse generator 114 and output switched by the multiplexer 115 is used, but a structure in which a separate scan pulse generating circuit is provided for each scan electrode 19*a* may also be used.

Switches $SW_1$ and $SW_2$ are arranged in the scan driver 104 to selectively apply the output from the above pulse generators 111 to 113 and the output from the scan pulse generator 114 to the scan electrode group 19*a*.

The sustain driver 105 has a sustain pulse generator 112*b* and generates sustain pulses in response to the trigger signals from the synchronization pulse generating unit 103, and applies the sustain pulses to the sustain electrodes 19*b*.

The data driver 106 outputs data pulses to the data electrodes $\mathbf{14}_1$ to $\mathbf{14}_M$ in parallel. Output takes place based on sub-field information which is input serially into the data driver 106 one line at a time.

Figure 7:
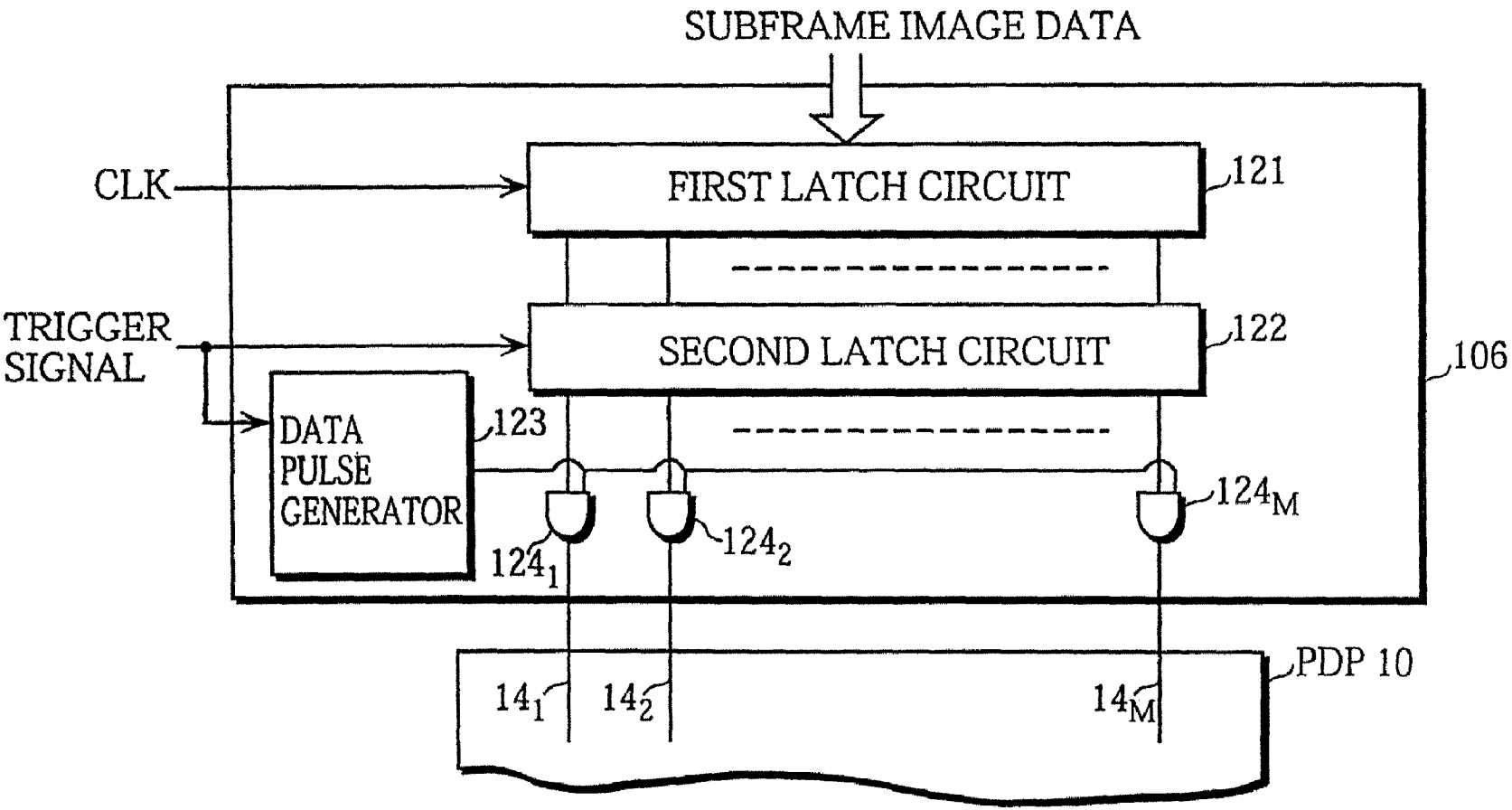
FIG. 7 is a block diagram showing a structure for the data driver in FIG. 5.

FIG. 7 is a block diagram of a structure for the data driver 106.

The data driver 106 includes a first latch circuit 121 which fetches one scan line of sub-frame data at a time, a second latch circuit 122 which stores one line of sub-frame data, a data pulse generator 123 which generates data pulses, and AND gates $\mathbf{124}_1$ to $\mathbf{124}_M$ located at the entrance to each electrode $\mathbf{14}_1$ to $\mathbf{14}_M$.

In the first latch circuit 121, sub-frame data sent in order from the preprocessor 101 is synchronized with a CLK (clock) signal and fetched sequentially so many bits at a time. Once one scan line of sub-frame image data (information showing whether each of the data electrodes 14$_1$ to 14$_M$ is to have a data pulse applied) has been latched, it is transferred to the second latch circuit 122. The second latch circuit 122 opens the AND gates from the AND gates 124$_1$ to 124$_M$ belonging to the data electrodes that are to have the pulses applied, in response to the trigger signals from the synchronization pulse generating unit 122. The data pulse generator 123 generates the data pulses simultaneously with this, and the data pulses are applied to the data electrodes with open AND gates.

In the driving apparatus 100, as explained below, the operations for one sub-frame composed of a sequence of the set-up, write, discharge sustain and erase periods are repeated eight times to display a one-frame image.

In the set-up period, switches $SW_1$ and $SW_2$ in the scan driver 104 are ON and OFF respectively. The set-up pulse generator 111 applies a set-up pulse to all of the scan electrodes 12*a*, causing a set-up discharge to occur in all of the discharge cells, and a wall charge to accumulate in each discharge cell. Applying a certain amount of wall voltage to each cell enables the write discharge occurring in the following write period to commence sooner.

In the write period, the switches $SW_1$ and $SW_2$ in the scan driver 104 are OFF and ON respectively. Negative scan pulses generated by the scan pulse generator 114 are applied sequentially from the first row of scan electrodes 19*a* 1 to the last row of scan electrodes 19*a* N. Simultaneously, the data driver 106 performs a write discharge by applying positive data pulses to the data electrodes 14 1 to 14 M corresponding to the discharge cells to be ignited, accumulating a wall charge in these discharge cells. Thus, a one-screen latent image is written by accumulating a wall charge on the surface of the dielectric layer in the discharge cells which are to be ignited.

The scan pulses and the data pulses (the write pulses in other words) should be set as narrow as possible to enable driving to be performed at high speed. However, if the write pulses are too narrow, write defects are likely. Additionally, limitations in the type of circuitry that may be used mean that the pulse width usually needs to be set at about 1.25 μm or more.

In the sustain period, the switches $SW_1$ and $SW_2$ in the scan driver 104 are ON and OFF respectively. The operations in which the sustain pulse generator 112*a* applies a discharge pulse of a fixed length (for example 1 to 5 μs) to the entire scan electrode group 12*a* and the sustain driver 105 applies a discharge pulse of a fixed length to the entire sustain electrode group 12*b* are alternated repeatedly.

This operation raises the electric potential of the surface of the dielectric layer above the discharge starting voltage (hereafter referred to as the starting voltage) in the discharge cells in which a wall charge had accumulated during the write period, so that discharge occurs in such cells. This sustain discharge causes ultraviolet light to be emitted within the discharge cells. The ultraviolet light excites the phosphors in the phosphor layer to emit visible light corresponding to the color of the phosphor layer in each discharge cell.

In the erase period, the switches $SW_1$ and $SW_2$ in the scan driver 104 are ON and OFF respectively. Narrow erase pulses are applied to the entire scan electrode group 19*a*, erasing the wall charge in each discharge cell by generating a partial discharge.

The following fifteen embodiments each explain a particular pulse waveform arrangement and its effect.

First Embodiment

Figure 8:
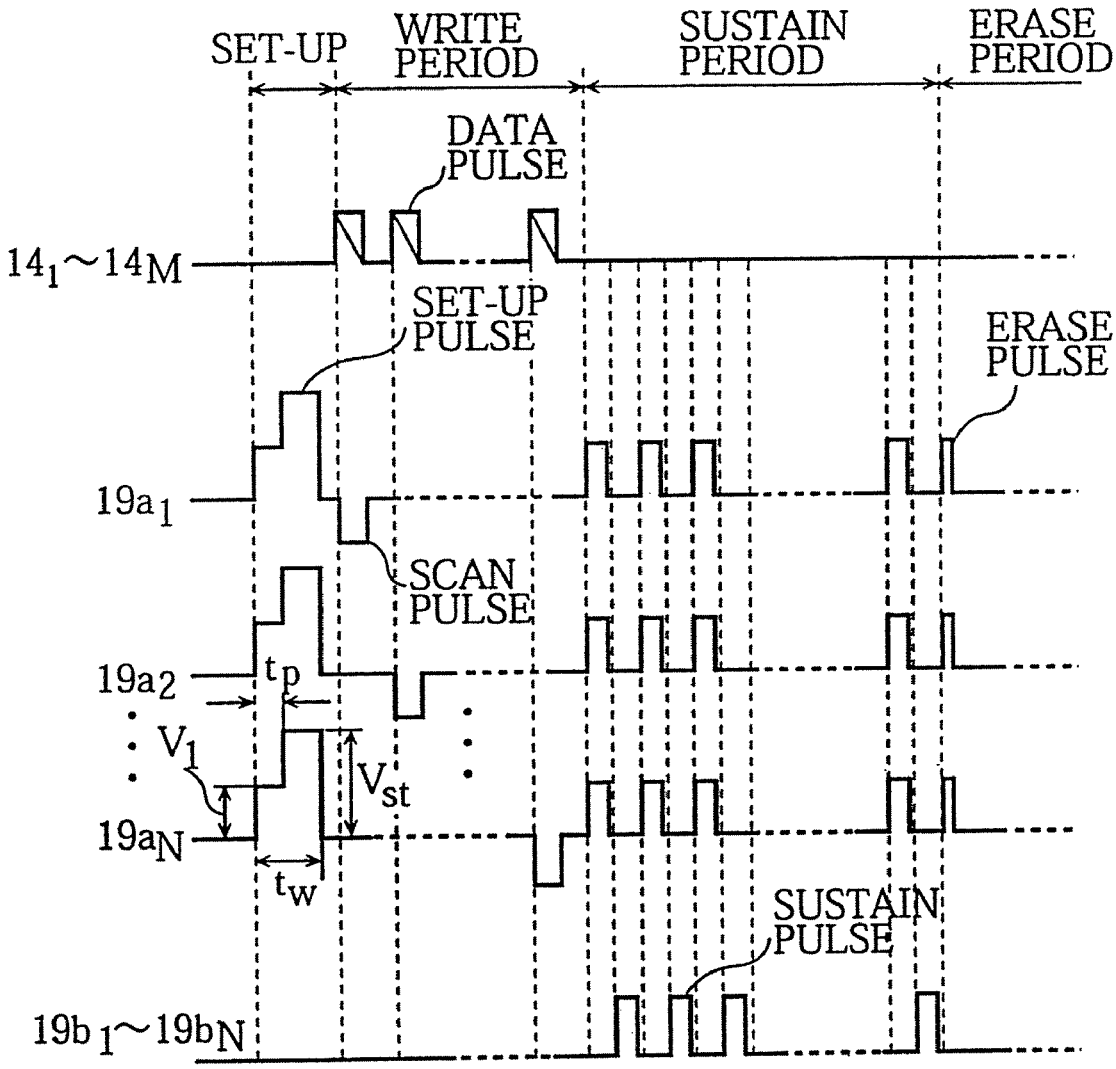
FIG. 8 is a time chart showing a PDP driving method relating to the first embodiment.

FIG. 8 is a time chart showing a PDP driving method relating to the present embodiment.

Figure 4:
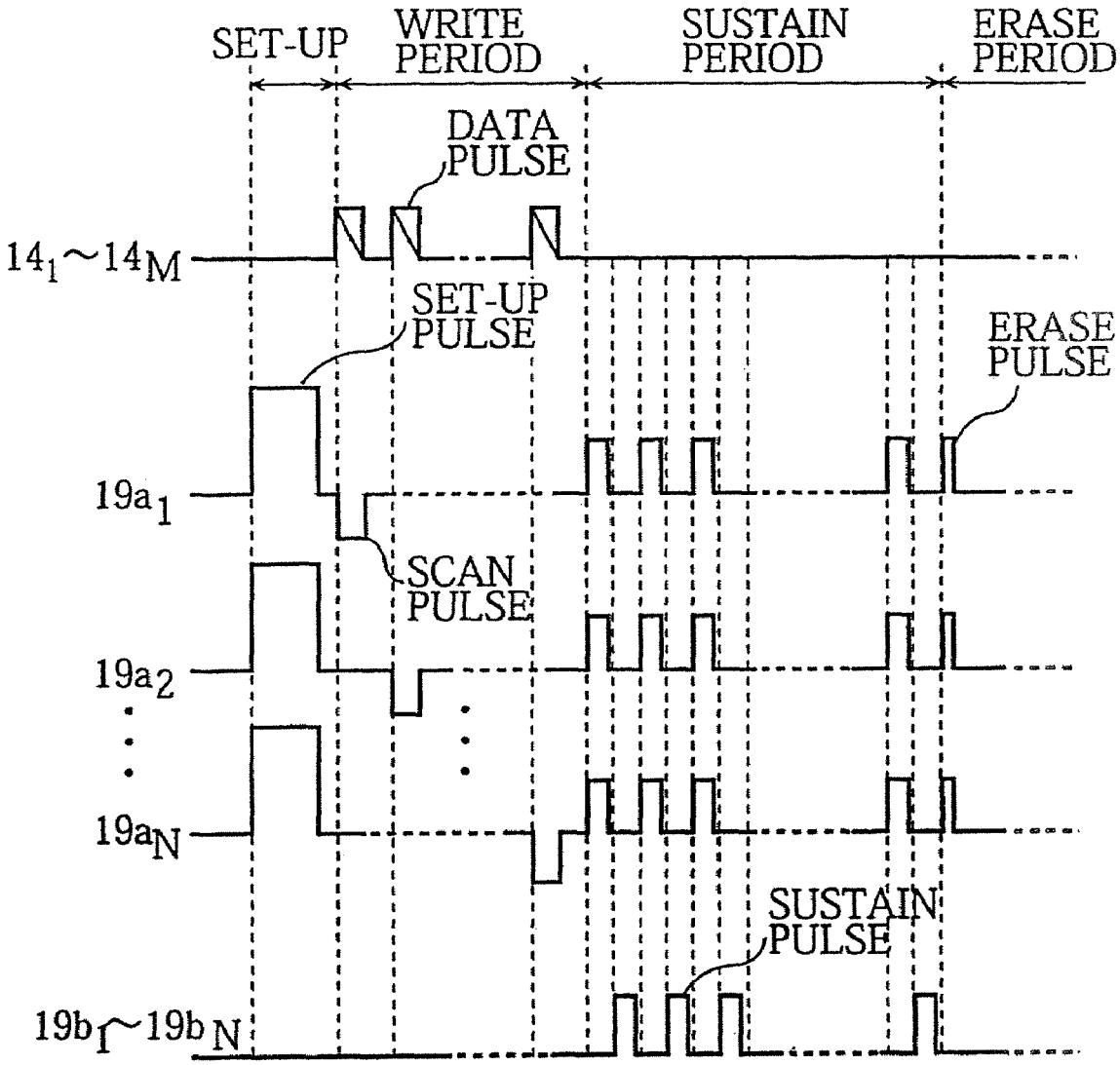
FIG. 4 is a related art example of a time chart occurring when pulses are applied to electrodes during one sub-frame.

In the related art driving method shown in FIG. 4, the set-up pulses had a simple rectangular wave. In this embodiment, however, the set-up pulses use a staircase waveform that rises in two steps.

This kind of waveform is achieved by adding two pulse waveforms and applying them.

Figure 9:
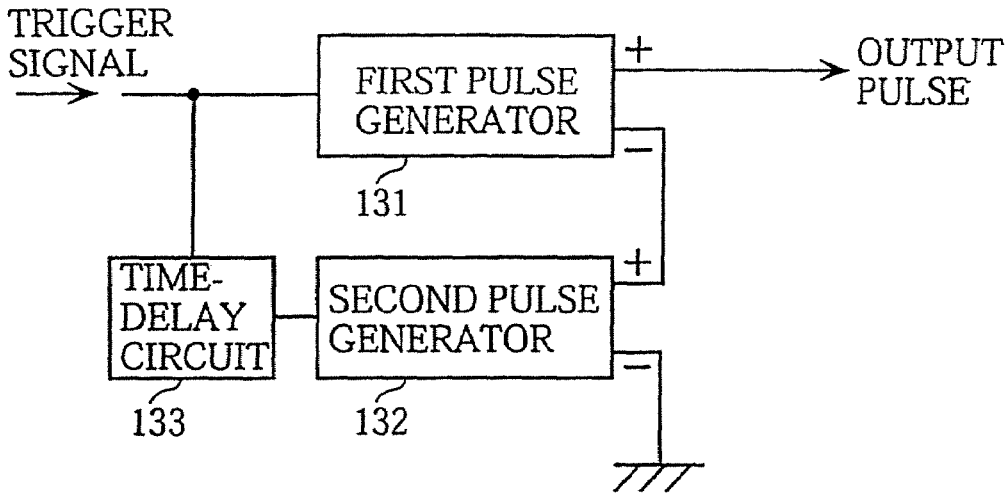
FIG. 9 is a block diagram of a pulse adding circuit relating to the embodiments.

FIG. 9 is a block diagram of a pulse adding circuit which generates the staircase waveform.

The pulse adding circuit includes a first pulse generator 131, a second pulse generator 132 and a time-delay circuit 133. The first and second pulse generators 131 and 132 are connected in series using a floating ground method, and the output voltage of the two generators added.

Figure 10A:
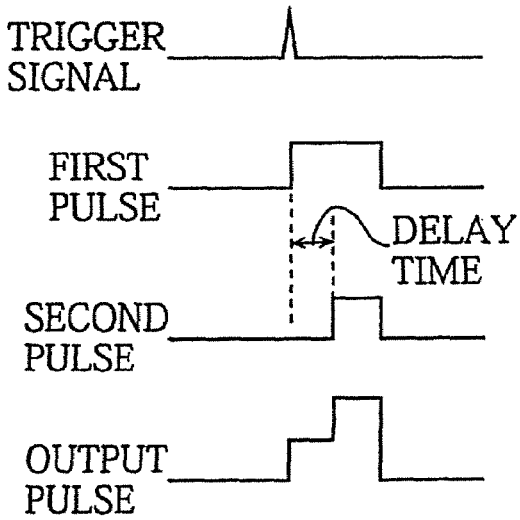
FIG. 10 shows the situation when a first and second pulse are added by the pulse adding circuit to form a staircase waveform with a two-step rise.

FIG. 10A shows a situation in which the pulse adding circuit synchronizes first and second pulses to form a staircase waveform which rises in two steps.

The first pulse generated by the first pulse generator 131 is a wide rectangular wave and the second pulse generated by the second pulse generator 132 is a narrow rectangular wave.

The first pulse is generated by the first pulse generator 131 and then the second pulse is generated by the second pulse generator 132 having been delayed by the time-delay circuit 133 for a set amount of time. The pulses are generated in response to trigger signals from the added pulse generating unit 103. The width of each pulse is set so that the first and second pulses fall at almost the same time.

The first and second pulses are added in this way, causing the output pulse to rise in two steps.

Figure 10B:
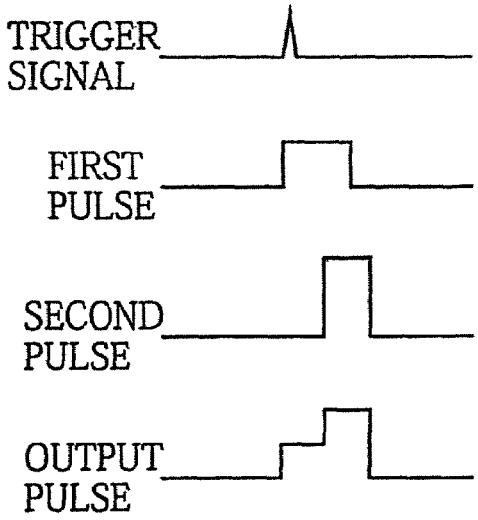

As an alternative to the pulse adding circuit shown in FIG. 9, the first and second pulse generators 131 and 132 may be connected in parallel and the first and second pulses output so that they overlap. Here, as shown in FIG. 10B, a staircase pulse which has a two-step rise can be generated by causing the second pulse generator 132 to generate a second pulse at a higher level than the first pulse.

The set-up pulse generator 111 in this embodiment has one such circuit and uses a staircase waveform that has a two-step rise for the set-up pulses.

As is explained below, the use of such a waveform rather than a simple rectangular wave for the set-up pulses limits write defects and improves contrast.

In other words, set-up pulses are applied to the discharge cells to accumulate a certain amount of wall charge in each discharge cell, with the aim of creating conditions in which writing can be performed accurately in a short time during the write period.

Light should not be emitted when the set-up pulses are applied. If a simple rectangular wave is used for the set-up pulses, as in the related art, however, there is a large variation in voltage (voltage variation range) when the voltage rises, and a strong discharge tends to be generated. This discharge causes a strong emission of light from the whole screen and contrast drops accordingly. Additionally, generating this kind of strong discharge (undesired light discharge) makes variations in the wall charge accumulated in each discharge cell following the application of the set-up pulses more likely. Such variations in the wall charge in each cell are the cause of partial write defects and variations in luminance.

If a two-step rising waveform is used for the set-up pulse, however, such sudden variations in voltage can be avoided and the applied voltage raised. The wall charge can then be accumulated stably without causing undesired light discharge.

The reason for this is that the relation between the voltage variation range and brightness occurring when the set-up pulse rises is not a proportional one. While little variation in voltage does not cause excessive brightness, a sharp increase in brightness is observed when the variation in voltage reaches a certain level. Thus, raising the voltage to a certain level in two steps rather than one reduces the brightness caused by discharge.

Wall charge may also be accumulated stably and brightness limited by using a slope for the rising part of the waveform, as is taught for example by Weber in U.S. Pat. No. 5,745,086. However, the rise time in Weber is extremely long. Using the two-step rising waveform of the present invention instead means that set-up can be performed stably using a narrower pulse.

By using the two-step rising waveform, set-up can be performed stably during a short set-up period, making it possible to perform driving at a much higher speed.

The PDP driving method of this embodiment can thus drive the panel at high-speed without write defects, and improve contrast to achieve superior image quality.

An example of a technique using a pulse having a waveform with a stepped risetime is disclosed in U.S. Pat. No. 4,104,563. This reference teaches the use of a pulse with a stepped risetime as a normalizing waveform. However, in order to achieve the above-mentioned effects, it is desirable to set the set-up pulse as described hereafter.

If the voltage $V_1$ needed for the rise to the first step is too small relative to the peak voltage $V_{st}$, a large amount of light emission will occur in the rise to the second step and there is a danger that the improvements in contrast will be lost. Therefore, the ratio of $V_1$ to $V_{st}$ should be set at 0.3 to 0.4 or more, and the ratio of $(V_{st}-V_1)$ to $V_{st}$ should be set at 0.6 to 0.7 or less.

If the period between the end the first-step rise and the start of the second-step rise, in other words the flat part of the first step $t_p$, is too wide relative to the pulse width $t_w$ it will have a detrimental effect. Therefore, the ratio of $t_p$ to $t_w$ should be set at 0.8 to 0.9 or less.

The first-step rise voltage $V_1$ should preferably be set within the range $V_f-70V \leqq V_1 \leqq V_f$. $V_f$ is the starting voltage at the driving apparatus.

The starting voltage $V_f$ is a fixed value determined by the structure of the PDP 10, and is measured by, for example, applying a very slowly increasing voltage between the scan electrodes 12*a* and the sustain electrodes 12*b* and reading the applied voltage when the discharge cells start to ignite.

Experiment 1

A two-step rise waveform was used for the set-up pulses when driving a PDP. While driving was performed, the peak voltage $V_{st}$ and the pulse width $t_w$ remained fixed, but the $t_p$ to $t_w$ ratio and the $(V_{st}-V_1)$ to $V_{st}$ ratio were changed to various values and the variations in contrast and brightness measured.

Each of the waveforms for the set-up pulses was generated by a given waveform generator and the voltage of this output was amplified by a high-speed high-voltage amplifier before being applied to the PDP.

Contrast was measured by igniting one part of the PDP to produce white color in a dark room and measuring the luminance ratio of the dark part to the light part.

Figure 11:
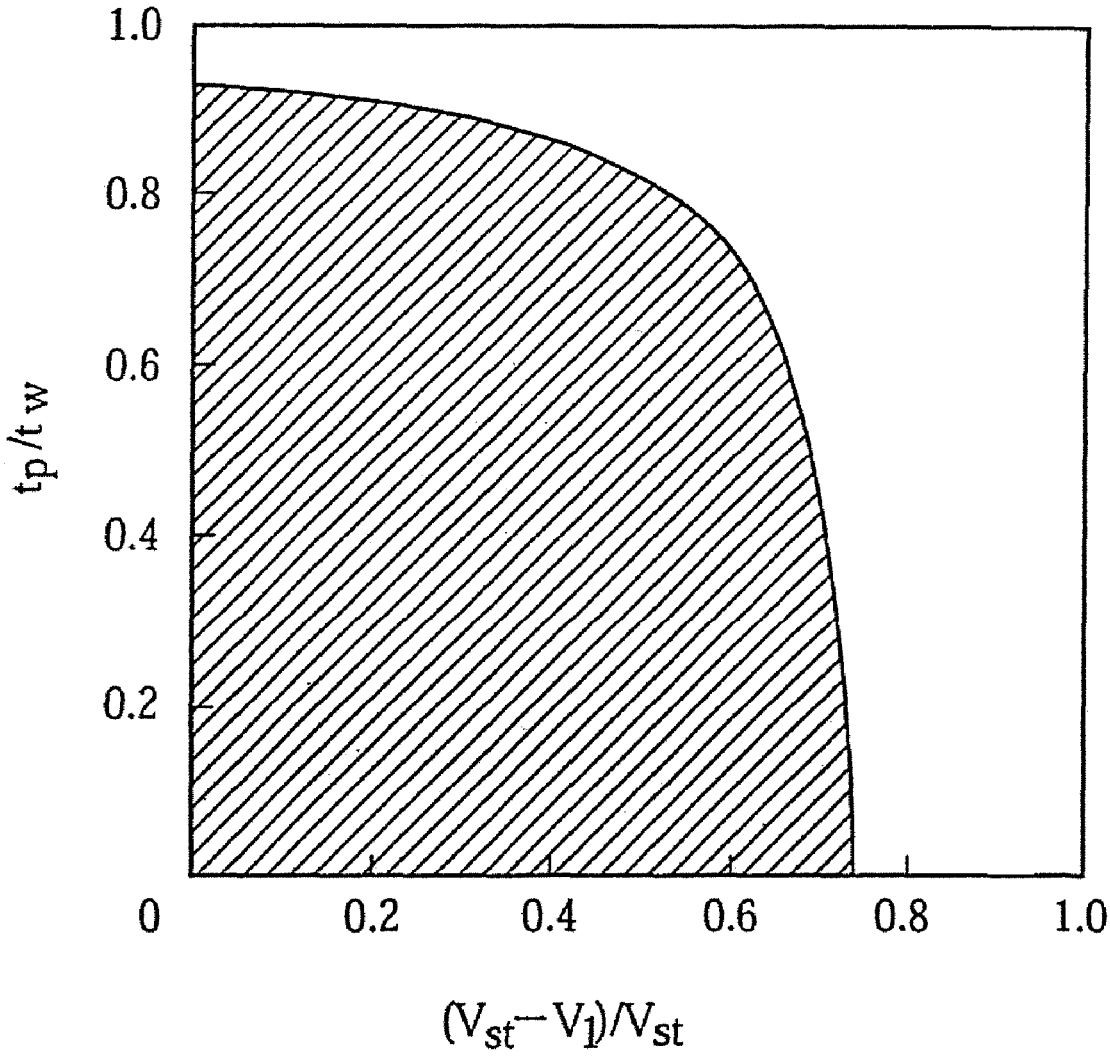
FIG. 11 shows the results of experiment 1.

FIG. 11 shows the results of this experiment, displaying the relation between the ratio $t_p$ to $t_w$ and the ratio $(V_{st}-V_1)$ to V and contrast.

The shaded area in the drawing is the area in which contrast is high and variations in luminance caused by write defects are low; in other words, the acceptable area. The area outside of the shaded area shows unacceptable results.

It can be seen from the drawing that the ratio $t_p$ to $t_w$ should preferably 0.8 to 0.9 or less and the ratio $(V_{st}-V_1)$ to V 0.6 to 0.7 or less. However, if the ratios $t_p$ to $t_w$ and $(V_{st}-V_1)$ to $V_{st}$ are too small no effects will be achieved, so it is preferable that the ratios be set at 0.05 or above.

The present embodiment uses a waveform in which two pulses are added to form a two-step rising staircase waveform as the set-up pulse. However, the same superior image effects may be achieved by adding three or more pulses to generate a multi-step waveform having three or more rises.

Second Embodiment

Figure 12:
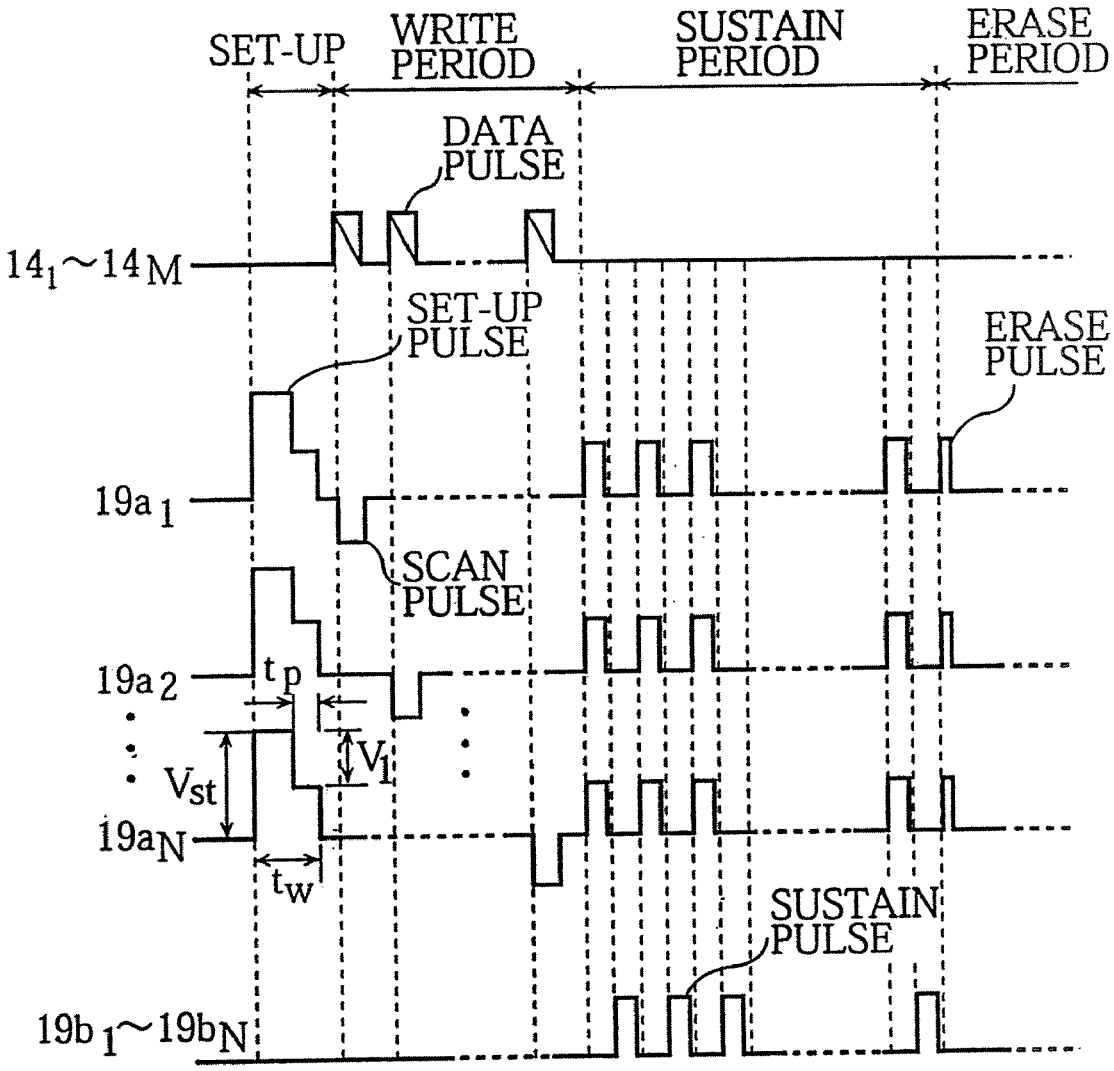
FIG. 12 is a time chart showing a PDP driving method relating to the second embodiment.

FIG. 12 is a time chart showing a PDP driving method relating to the present embodiment.

In the first embodiment, a two-step rising waveform was used for the set-up pulses, but in this embodiment a two-step falling waveform is used for the set-up pulse.

FIG. 13 shows a situation in which the pulse adding circuit adds first and second pulses to form a staircase waveform which falls in two steps.

The two-step falling waveform uses a pulse adding circuit like the one explained in the first embodiment and can be generated by adding a first pulse generated by the first pulse generator 131 and a second pulse generated by the second pulse generator 132.

Figure 13A:
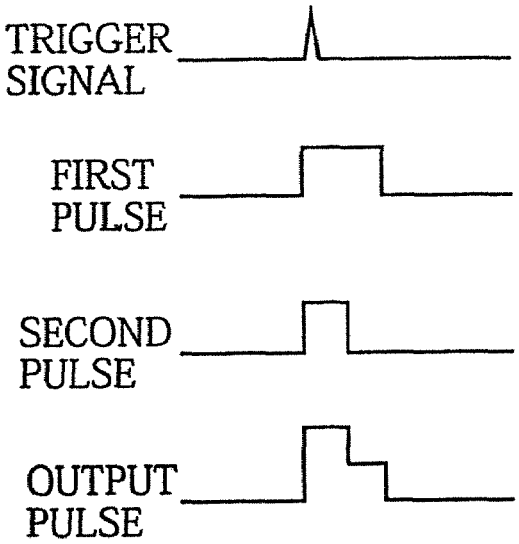
FIG. 13 shows the situation when a first and second pulse are added by the pulse adding circuit to form a staircase waveform with a two-step fall.
Figure 13B:
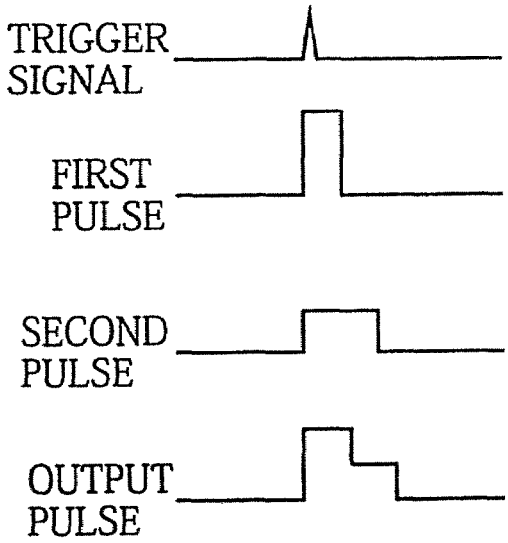

Specifically, a pulse adding circuit like the one in FIG. 9, in which a first pulse generator and a second pulse generator are connected in series using a floating ground method, is used. As shown in FIG. 13A, a first pulse with a wide rectangular wave is raised by the first pulse generator 131 at almost the same time as a second pulse with a narrow rectangular wave is raised by the second pulse generator 132. A two-step falling waveform is generated by adding the two pulses. Alternately, a pulse adding circuit in which the first and second pulse generators are connected in parallel is used. In this case, as shown in FIG. 13B, the first pulse generator raises a first pulse which is a narrow rectangular wave at a relatively high level and the second pulse generator a second pulse which is a rectangular wave at a relatively low level. The two pulses are added to generate a two-step falling waveform.

If a simple rectangular wave is used as the set-up pulse, as in the related art, however, when the voltage fall is large, sudden variation in voltage (the voltage variation range) tends to cause a self-erasing discharge. This self-erasing discharge causes a strong emission of light from the whole screen, which reduces contrast.

Since one part of the wall charge formed during the rise time of the set-up pulses is extinguished by the self-erasing charge, the priming effect is also weakened.

If a two-step falling waveform is used for the set-up pulses, the sudden voltage variation experienced when the charge falls will not occur, so the self-erasing discharge is restricted. As a result, the emission of light from the whole screen can be limited, improving contrast, while extinguishing of the wall charge is restricted, allowing the priming effect to be improved.

If a gradually falling waveform is used as the set-up pulse, the wall charge may be accumulated stably and brightness controlled in a similar way, but the fall time for the waveform is long. In the present embodiment, however, the use of a two-step falling waveform enables set-up to be performed stably with a narrower pulse.

Accordingly, using the two-step falling waveform enables set-up to be performed in a short set-up period, allowing driving to be performed at a higher speed.

The PDP driving method of this embodiment enables driving to be performed at high speed without write defects, and contrast is drastically improved. As a result, superior image quality can be realized.

A technique using a pulse having a waveform with a stepped falling time is disclosed, for example, in the *IBM Technical Disclosure Bulletin* (Vol. 21, No. 3, August 1978). This reference teaches the use of a write pulse with a stepped falling time as a way of avoiding self-erasing. However, to obtain the above effects, a set-up pulse should preferably be set as described hereinafter.

If the voltage $V_1$ needed for the fall in the first step is too small relative to the peak voltage $V_{st}$, a large amount of light emission will occur in the second-step fall and there is a danger that effects will be lost. Therefore, the ratio of $V_1$ to $V_{st}$ should be set at no more than 0.8 to 0.9.

If the period between the end of the first-step fall and the start of the second-step fall, in other words the width of the flat part of the first step $t_p$, is too large relative to the pulse width $t_w$ it will have a detrimental effect. Therefore, the ratio of $t_p$ to $t_w$ should be set at no more than 0.6 to 0.8.

Experiment 2

A PDP was driven using the same method as in the experiment of the first embodiment, using various set-up pulses with different two-step falling waveforms, and the contrast measured in each case.

During driving of the PDP, various values were used for the ratio $t_p$ to $t_w$ comparing the pulse width $t_w$ to the width of the first fall step $t_p$ and the ratio $V_1$ to $V_{st}$ comparing the maximum voltage $V_{st}$ to the amount the voltage falls during the first step $V_1$.

Figure 14:
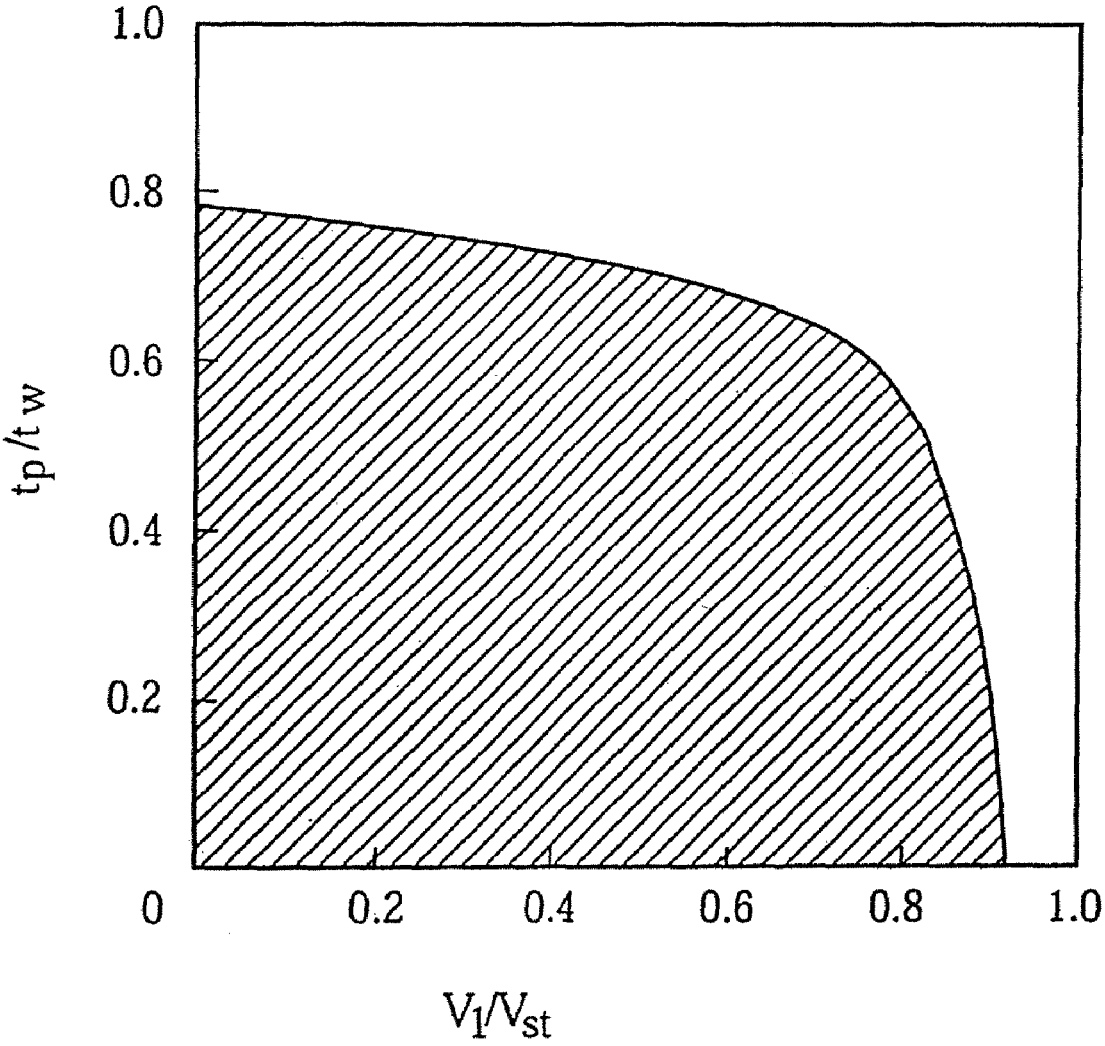
FIG. 14 shows the results of experiment 2.

FIG. 14 shows the results of this experiment, displaying the relation between the ratio $t_p$ to $t_w$ and the ratio $V_1$ to $V_{st}$ and contrast.

The shaded area in the drawing is the area in which contrast is high and variations in luminance caused by write defects are low; in other words, the acceptable area. The area outside of the shaded area shows unacceptable results.

It can be seen from the drawing that the ratios $t_p$ to $t_w$ and $V_1$ to $V_{st}$ should not be too large, so that the ratio $t_p$ to $t_w$ should preferably be no more than 0.6 to 0.8 and the ratio no more than $V_1$ to $V_{st}$ 0.8 to 0.9. However, if the ratios $t_p$ to $t_w$ and $V_1$ to $V_{st}$ are too small useful effects will not be achieved, so it is preferable that the ratios be set at 0.05 or above.

The present embodiment uses a waveform in which two pulses are added to form a two-step falling staircase waveform as the set-up pulse. However, the same effect may be achieved by adding three or more pulses to generate a multi-step waveform having three or more falls that may realize superior image quality.

Third Embodiment

Figure 15:
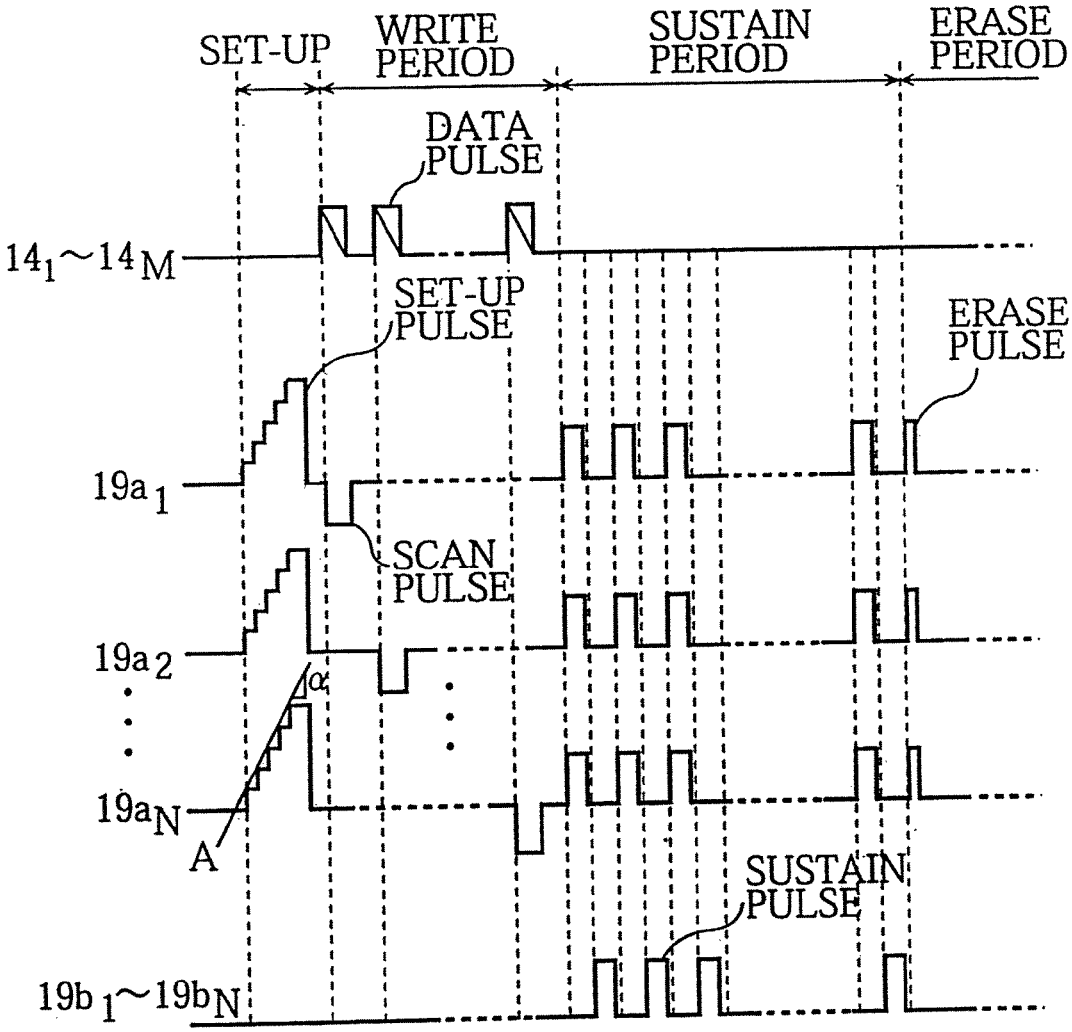
FIG. 15 is a time chart showing a PDP driving method relating to the third embodiment.

FIG. 15 is a time chart showing a PDP driving method relating to the present embodiment.

In the first embodiment, a two-step rising waveform was used for the set-up pulses. The present embodiment, however, uses a multi-step staircase waveform which rises in three or more steps (for example five steps).

This kind of multi-step waveform set-up pulse can be obtained by using a staircase wave generating circuit as the set-up pulse generator 111.

Figure 16:
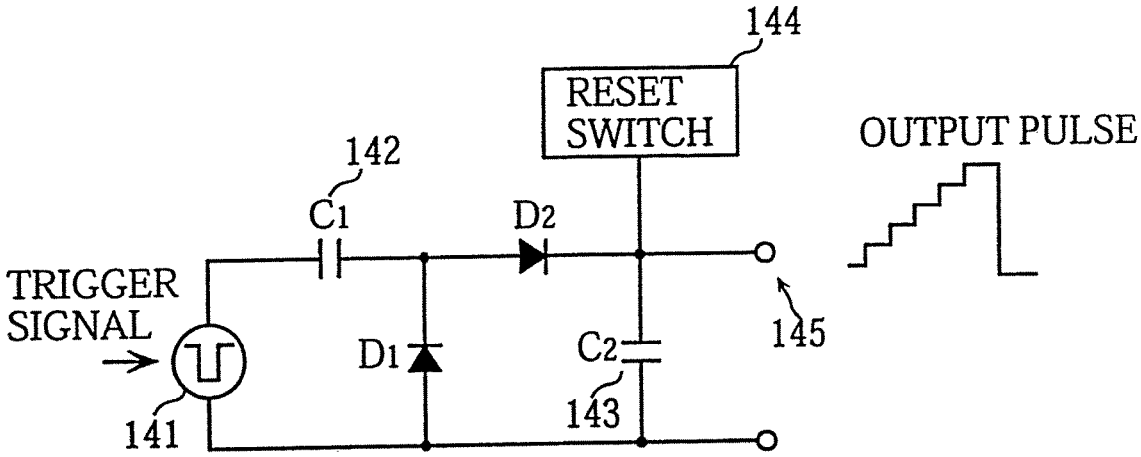
FIG. 16 is a block diagram showing a staircase wave generating circuit relating to the third embodiment.

FIG. 16 is a block diagram of a staircase wave generating circuit described in 'Denshi Tsushin Handobuku' (Electronic Communication Handbook) published by Denshi Tsushin Gakkai.

The staircase wave generating circuit includes a clock pulse generator 141, which generates a fixed number (in this case five) of successive negative pulses (voltage $V_p$), capacitors 142 and 143, and a reset switch 144. A capacitance $C_1$ of the capacitor 142 is set higher than a capacitance $C_2$ of the capacitor 143.

When a first pulse is issued by the clock pulse generator 141, the voltage of an output unit 145 rises to $C_1/(C_1+C_2)V_p$. The voltage of the output unit 145 rises to $C_1 \cdot C_2/(C_1+C_2)^2 V_p$ when a second pulse is issued and to $C_1 \cdot C_2/(C_1+C_2)^3 V_p$ when a third pulse issued.

Accordingly, when a fixed number of pulses (five) is issued by the clock pulse oscillator 141, a waveform which rises in a corresponding number of steps is output. Then, after a fixed time has elapsed, a set-up pulse waveform having a plurality of rising steps (five steps) is generated by the reset switch 144. A discharge is created in the output side of the circuit, making the voltage fall.

The effect obtained by using this kind of multi-step rising waveform is basically the same as that in the first embodiment. However, although the voltage rises to the same level, the rise in voltage for each step is smaller, enabling a greater effect to be obtained.

In this staircase pulse waveform, the average value for the rate of voltage change in steps after the first step (the slope a of the line A in FIG. 15) should preferably be set at not less than 1V/μs but not more than 9V/μs. The reasons for this are as follows.

If the voltage rises so that the velocity of the voltage change is within these limits, a weak discharge is generated in an area where I-V characteristics are positive, and discharge takes place in an almost constant voltage mode so that the inside of the discharge cells is kept at a value $V_f$*, a little lower than the starting voltage $V_f$. This means that a negative wall charge corresponding to the potential difference ($V-V_f$*) between the voltages V and $V_f$* can accumulate efficiently on the surface of the dielectric layer covering the scan electrodes 12*a*.

If the average rate of voltage change α is set at 10V/μs or more, the light emitted by the set-up pulse discharge is stronger and contrast drops markedly. If the average rate of voltage change α a stays within this range, however, and especially if it is set at 6V/μs or less, the light emitted by the set-up pulse discharge is much weaker than that emitted by the sustain discharge and contrast is almost totally unaffected.

If set-up is performed at an average rate of voltage change α of 10V/μs or more, controlling accumulation of the wall charge at an even rate is difficult, so that the generation of write defects in the subsequent write period is more likely. An overly large voltage change during the rising portion of the set-up pulses increases the likelihood that light emissions caused by the set-up pulses will be strong and the wall voltage uneven. This is because a strong discharge generated during the rising portion of the pulse and the accumulation of excess wall charge during rising mean that a strong discharge (the self-erasing discharge) will be generated in the falling portion of the pulse.

As explained in the first embodiment, the voltage $V_1$ for the first-step rise should be set in relation to the starting voltage $V_f$ so that $V_f-70V \leqq V_1 \leqq V_f$.

Experiment 3

A PDP in which a staircase waveform rising in five steps was used for the set-up pulses was driven, and the relation between a wall charge transfer amount ΔQ [pC] and write pulse voltage $V_{data}$ [V] was measured. In order to investigate the dependency of driving conditions on the average rate of voltage change α during rising, the average rate of voltage change α [V/μs] following the first step was set at various values between 2.1 and 10.5 and measurements taken.

Set-up pulses with variously-shaped waveforms were generated using a given waveform generator and their voltage amplified by a high-speed high-voltage amplifier before being applied to the PDP. The voltage of the set-up pulse in the first-step rise was set at 180V, 20V lower than the starting voltage $V_f$.

The wall charge transfer amount ΔQ was measured by connecting a wall charge measuring apparatus to the PDP. This circuit used the same principle as Sawyer-Tower circuits employed when evaluating the characteristics of ferroelectrics and the like.

Figure 17:
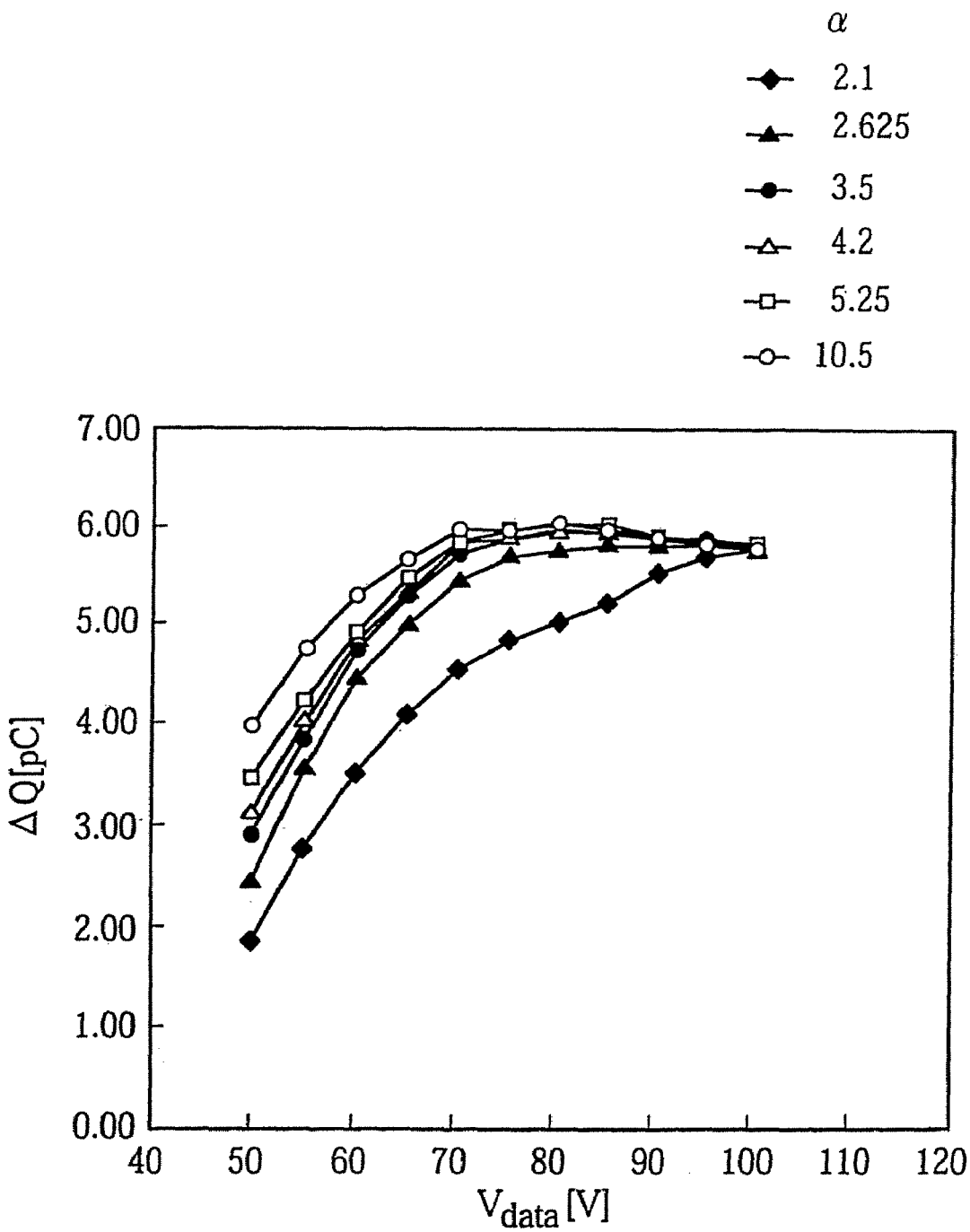
FIG. 17 shows the results of measurements made in experiment 3.

FIG. 17 shows the results of this measurement, illustrating the relation between write pulse voltage $V_{data}$ and wall charge transfer amount ΔQ for each value of an average rate of voltage change α.

If the wall charge transfer amount ΔQ is no more than 3.5 pC, write defects and screen flicker are more likely to be generated. Accordingly, to enable the PDP to be driven normally $V_{data}$ should be set above the ΔQ=3.5 pC line shown in the drawing.

From the drawing, it can be seen that an increase in $V_{data}$ is accompanied by an increase in the wall charge transfer amount ΔQ produced by the write discharge. This shows that increasing $V_{data}$ increases the probability of discharge and reduces write defects.

In the drawing, $V_{data}$ occupies a small range, showing that the wall charge transfer amount ΔQ is larger for higher values of the average rate of voltage changed. In other words, if the average rate of voltage change α is set at a relatively high level within this range, the level of the wall charge transfer amount ΔQ is maintained and the PDP can be correctly driven even if $V_{data}$ is set at a low value.

In the driving method of this embodiment, the wall charge at the completion of the set-up period can be restricted to the desired level without losing contrast and write discharge defects restricted. As a result, such image quality deterioration as flicker and roughness can be limited and superior image quality achieved.

The present embodiment showed an example in which a multi-step rising pulse waveform was used for the set-up pulses, but a staircase waveform which has multi-steps in both its rising and falling portions may also be used for the set-up pulse to achieve the same high level of image quality.

Fourth Embodiment

Figure 18:
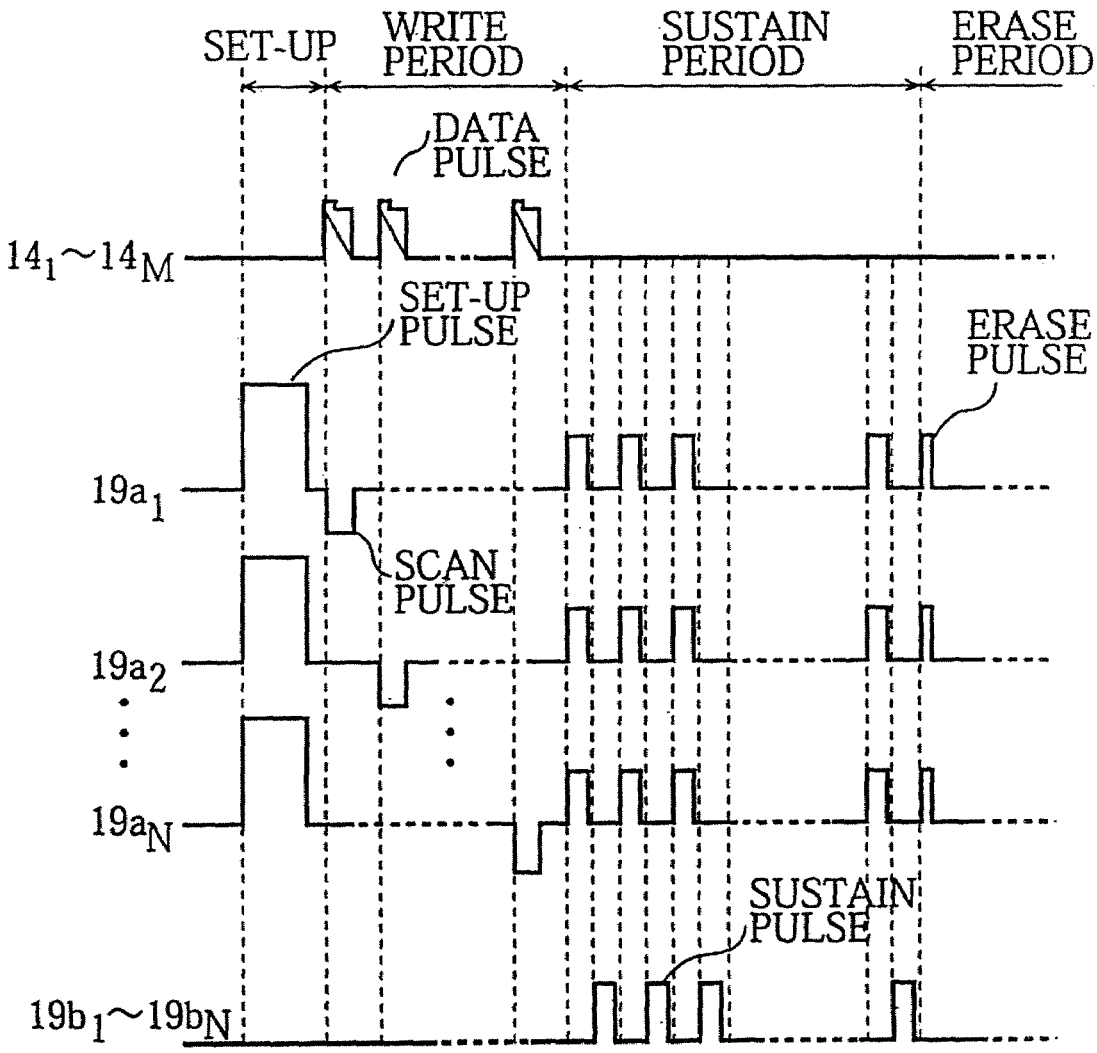
FIG. 18 is a time chart showing a PDP driving method relating to the fourth embodiment.

FIG. 18 is a time chart showing a PDP driving method relating to this embodiment.

The present embodiment uses a staircase waveform that falls in two steps as a data pulse.

A pulse adding circuit such as the one explained in the second embodiment may be used in the data pulse generator 123 to apply the two-step falling staircase waveform for the data pulses.

If a simple rectangular wave like the one in the related art is used, a data pulse width set at no more than 2 μs causes the discharge efficiency of the sustain discharge to fall and there will be a tendency for sharp reductions in image quality caused by write defects to occur.

However, in the present embodiment, the use of a two-step falling staircase waveform for the data pulses instead of a simple rectangular wave enables the write pulses (scan pulses and data pulses) to be set at a smaller width without reducing discharge efficiency during the sustain discharge. The width of the write pulses can be set as narrow as 1.25 μs.

By setting the write pulse narrowly, driving can be performed at high speed during the write period. This is extremely useful when driving high definition PDPs with a large number of scanning lines such as are used in high definition television having a high resolution.

The reason that the present embodiment can achieve stable writing even with narrow write pulses is as follows.

The discharge operation from the write period to the discharge sustain period is performed in the following way. First, discharge is performed in the scan electrodes and the data electrodes by applying write pulses. As a result of this priming, a sustain discharge can be performed between the scan electrodes and the sustain electrodes when sustain pulses are applied.

If a simple rectangular wave is used for the data pulses, as shown in Experiment 4B below, the discharge delay from when the pulse is applied to when discharge is performed is long and the discharge delay time (the time from when the pulse rises until the discharge peak) is around 700 to 900 ns. This means that shortening the time between the rise and the fall of the data pulse is likely to produce discharge defects. Additionally, discharge delay is caused in the discharge sustain period also, making unstable light emission likely.

If a two-step falling waveform produced from two added pulses is used for the data pulses, as in the present embodiment, however, the discharge delay time is reduced to a short 300 to 500 ns, and discharge completed in a short time. This means that discharge can be achieved reliably even if the time between the rise and the fall of the data pulses, i.e. the pulse width, is shortened, enabling writing to be performed stably.

The following observations may also be made.

If a simple rectangular wave is used for the data pulses, it can rise at quite a high voltage, so that short data pulses and high speed driving are possible.

However, in data drivers used conventionally in PDPs, there is a reciprocal relationship between the slewing rate of the voltage during the rise time and ability to withstand voltage. Thus, a driving circuit which can raise a high voltage of more than 100V momentarily is both difficult and expensive to produce.

If a pulse created by combining first and second pulses to form a staircase waveform is generated, a driver IC (power MOSFET) is used for each of the first and second pulse generators. This driver IC has a low ability to withstand voltage of 100 V or less and a fast slewing rate in the rising period of the pulse. This means that driving can be performed at both a high voltage and a high speed.

Thus, the PDP driving method of the present embodiment uses a low cost driving circuit to achieve high-speed, stable writing.

When using a two-step falling staircase waveform as a write pulse, as in the present invention, the first-step fall should preferably be set in the range of 10V to 100V. This is because effects are difficult to obtain at less than 10V and a waveform with a first-step fall of more than 100V is difficult to achieve with a driver IC that has a low ability to withstand voltage.

A technique using a pulse having a stepped fall time is disclosed, for example, in the *IBM Technical Disclosure Bul-*

*letin* (Vol. 21, No. 3, August 1978). This reference teaches that a stepped falling waveform is valuable in order to avoid self-erasing. However, in order to achieve the above effects, it is desirable to set pulse width in a range of 0.5 μs to 2.0 μs when the peak voltage of the write pulse is between 70V and 100V, as shown by the results of the following experiment.

Experiment 4A

A PDP was driven by applying data pulses, composed of waveforms in which a pulse width PW was set at various values, to the data electrodes, and the wall charge transfer amount ΔQ [pC] was measured before and after the write discharge. The data pulse voltage $V_{data}$ was set variously at 60, 70, 80, 90 and 100 V.

The wall charge transfer amount ΔQ was measured by connecting the wall charge measuring apparatus of the third embodiment to the PDP.

Figure 19:
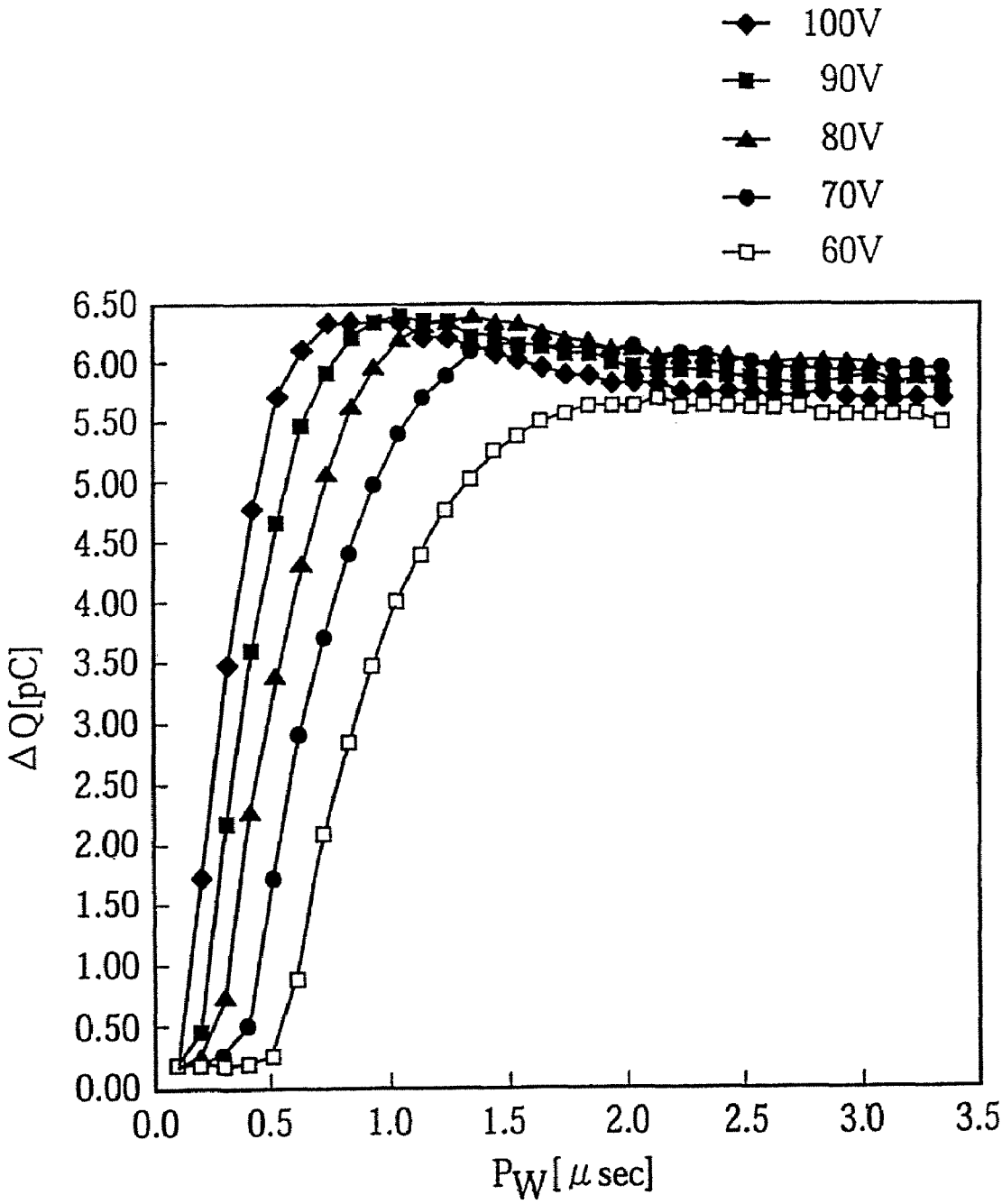
FIG. 19 shows the results of measurements made in the experiment 4A.

FIG. 19 shows the results of this measurement, illustrating the relation between the data pulse width PW and wall charge transfer amount ΔQ for each value of the data pulse voltage $V_{data}$.

In the drawing, it can be seen that when $V_{data}$ is 60V, the wall charge transfer amount ΔQ can be maintained at a high value when the pulse width PW is at a range of 2.0 μs or more, so that write discharge can be performed more or less normally in this range. However, when $V_{data}$ was 60V, a small amount of flicker was observed.

If, however, $V_{data}$ is set higher than this, the wall charge transfer amount ΔQ can be maintained at a high value, even if the pulse width PW is reduced, and write discharge can still be performed normally. When $V_{data}$ is 100V, for example, even if the pulse width PW is set at 1.0 μs, a high value of around 6 [pC] can be obtained for the wall charge transfer amount ΔQ and write discharge is performed normally.

From this it can be seen that higher values of the voltage $V_{data}$ for the data pulses enable a high stable wall charge transfer amount ΔQ to be obtained at a narrower pulse width PW.

When the pulse width PW is in a range of more than 2.0 μs, the wall charge transfer amount ΔQ can be maintained at roughly the same value, and the voltage $V_{data}$ can be stabilized in a range of 5.50 to 6.00 pC. On the other hand, when the pulse width PW is 2.0 μs or less, a voltage $V_{data}$ of between 70V and 100V has a much larger wall charge amount than a voltage $V_{data}$ of 60V.

As a result, when the pulse width PW is set in a range of 2.0 μs or less, a write pulse with a peak voltage of between 70V and 100V is desirable in order to accumulate a satisfactory wall charge.

Furthermore, from FIG. 19, it can be seen that the value of the wall charge transfer amount ΔQ will be less than the stable range (5.50 to 6.00 pC) when the pulse width PW is less than 0.5 μs. Consequently, a pulse width PW of 0.5 μs or more is required to accumulate a satisfactory wall charge when the peak voltage of the write pulse is 100V or less.

Experiment 4B

The PDP was driven using both a rectangular wave with a maximum voltage $V_p$ of 60(V) and a two-step falling staircase waveform with a maximum voltage of 100V like that in the present embodiment as a data pulse. The applied voltage waveform and the wall charge transfer amount ΔQ waveform were measured in each case, along with the average discharge delay time for the write discharge. Screen flicker was also measured.

Each waveform was measured using a digital oscilloscope. For each measurement noise was eliminated by taking an average of 500 scans. Table One shows the results of this experiment.

TABLE ONE

| | MAX. VOLTAGE $V_p$ [V] | AVERAGE DISCHARGE DELAY TIME [μs] | FLICKER |
|---|---|---|---|
| RECTANGULAR WAVE | 60 | 1.86 | A LITTLE |
| WAVEFORM OF FOURTH EMBODIMENT | 100 | 0.76 | NO |

From these results, it can be seen that using a two-step falling staircase waveform as a data pulse reduces the discharge delay time and screen flicker.

Fifth Embodiment

Figure 20:
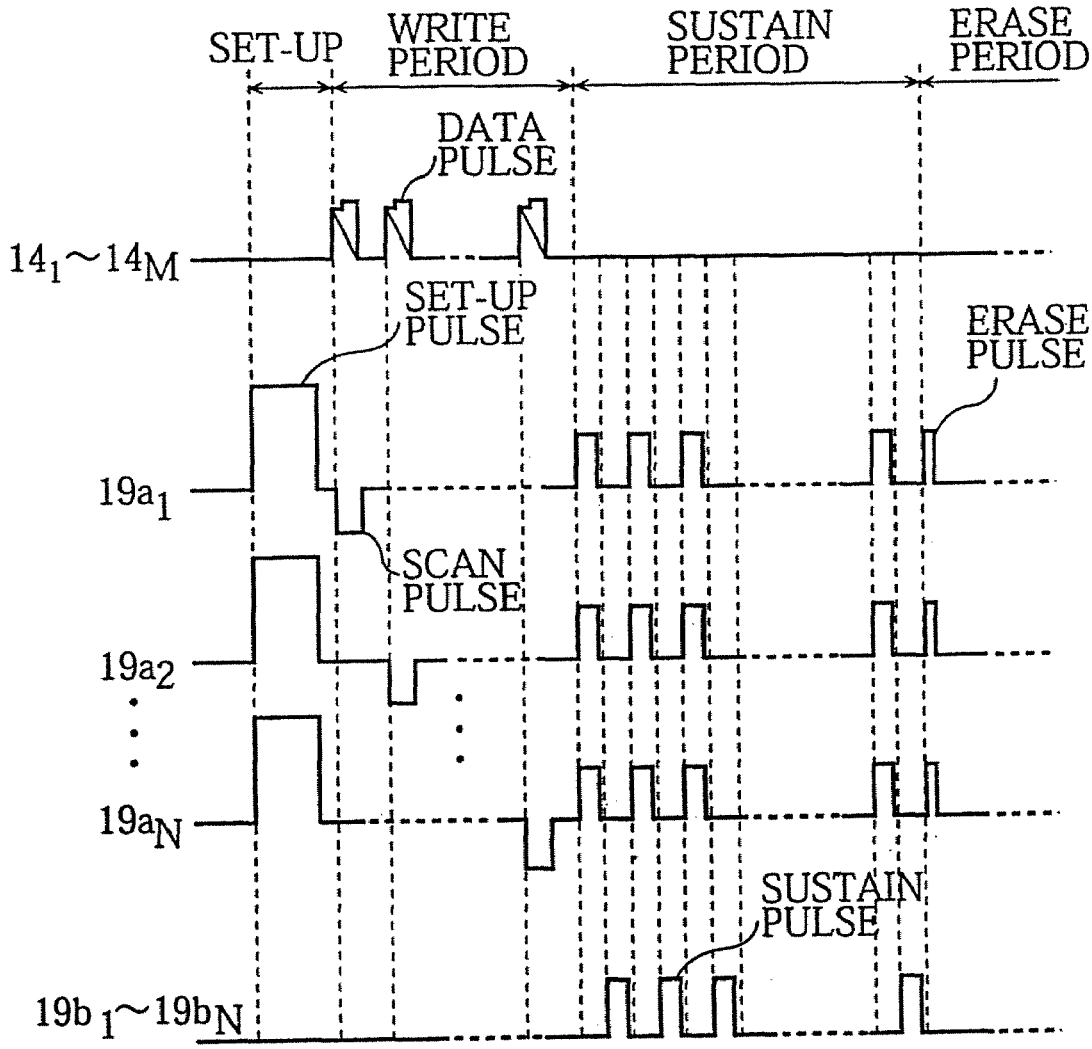
FIG. 20 is a time chart showing a PDP driving method relating to the fifth embodiment.

FIG. 20 is a time chart showing a PDP driving method relating to the present embodiment.

In the present embodiment, a two-step rising staircase waveform is used for a data pulse.

A pulse adding circuit such as the one explained in the first embodiment may be used as the data pulse generator 123 of FIG. 7 to apply the two-step rising staircase waveform for the data pulses.

If a simple rectangular wave like the one in the related art is used, a sharp rise in voltage is experienced in the pulse rise time, so that, as shown in Experiment 5A below, light emission caused by the data pulses becomes stronger and the wall voltage is likely to become uneven. The reason for this is the same as was given in the case of the set-up pulses in the first embodiment.

If light emission is caused by the data pulses, this is added to the light emission of the sustain discharge as luminance, causing image quality to be reduced when low gradations are displayed. If light emission caused by the data pulse is strong when an image signal is input using a ramp waveform and gray scale display performed, the deterioration in image quality is particularly marked.

Here, if the voltage of the data pulses applied to the data electrodes is set at a low level, the light emission caused by the data pulses can be restricted, but the discharge delay for the write discharge increases. This means that write defects are generated and deterioration in image quality is likely to occur.

If a two-step rising staircase waveform like the one in the present embodiment is used for the data pulse however, the voltage variation for each step is small and the pulse can be raised to a high voltage, enabling the light emission caused by the data pulse to be restricted without producing write defects.

As in the fourth embodiment, driver ICs with a low ability to withstand voltage of 100V or less are used for the first and second pulse generators in the pulse adding circuit, allowing the PDP to be driven at high speed. Even if a two-step rising staircase waveform is used for the write pulses, however, the second step rise should preferably be set within the range of 10V to 100V.

The above-mentioned *IBM Technical Disclosure Bulletin* (Vol. 21, No. 3, August 1978) discloses the use of a write pulse with a rising staircase waveform. However, in order to achieve the above effects, as explained in the fourth embodiment, it is desirable to set the pulse width in a range of 0.5 μs to 2.0 μs or less, when the peak voltage of the write pulse is between 70V and 100V.

Experiment 5A

The PDP 10 was driven by the related art driving method using a simple rectangular wave as the data pulse, and light emissions produced by the write discharge and the sustain discharge were observed.

Figure 21A:
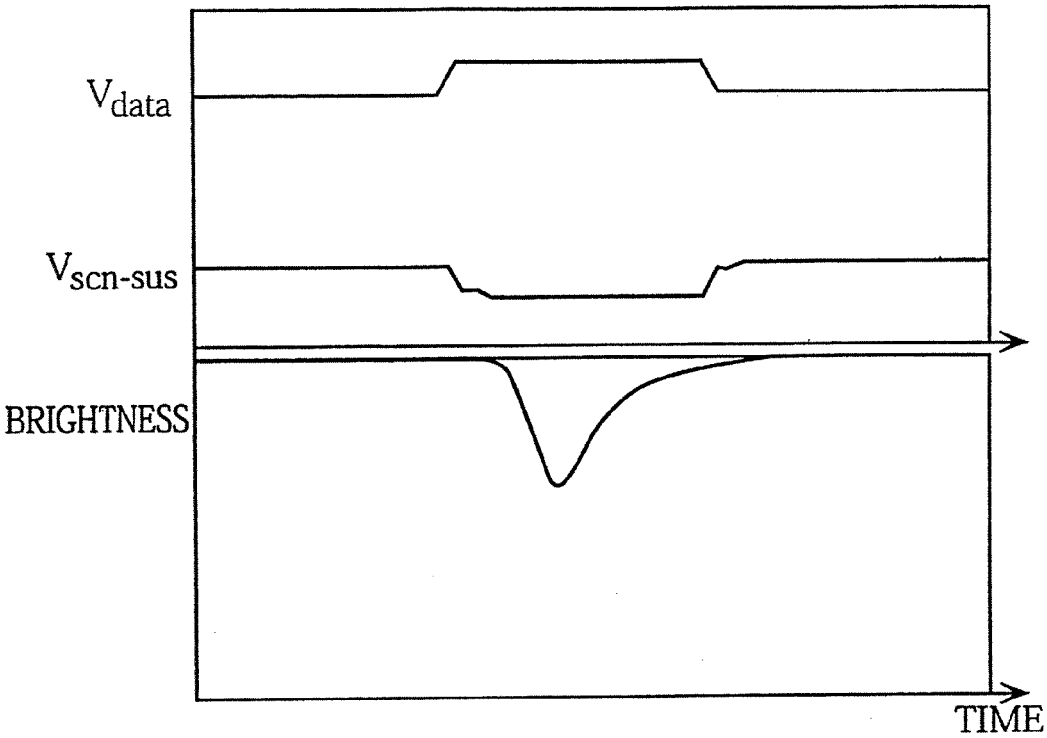
FIG. 21 shows the results of measurements made in experiment 5A.
Figure 21B:
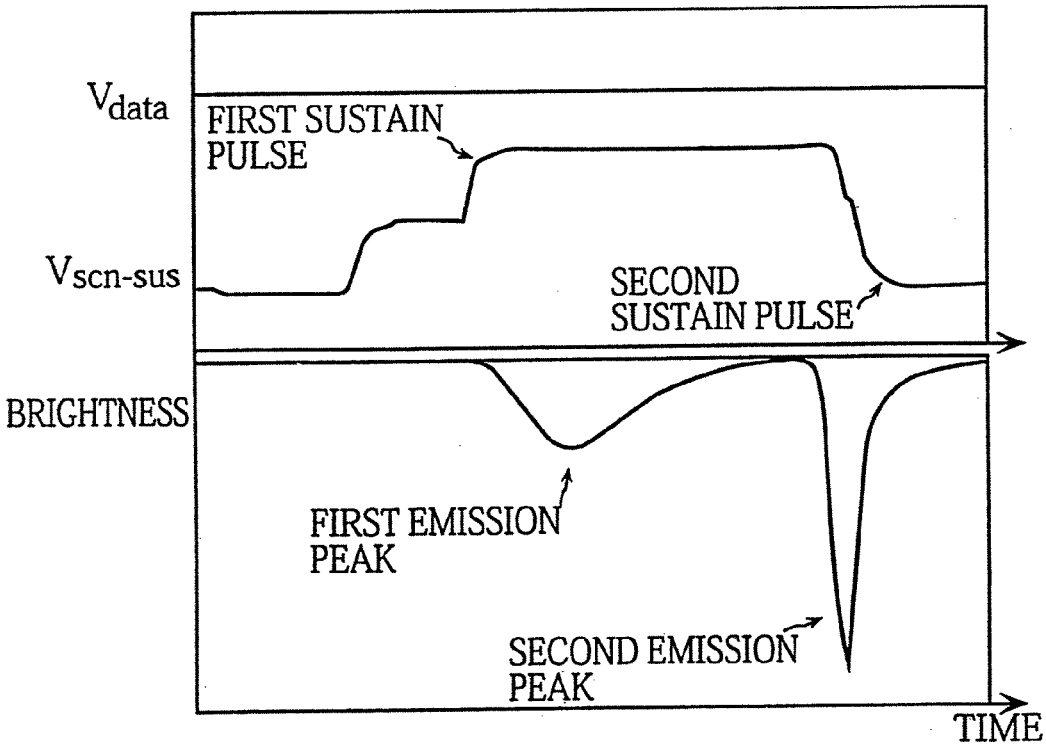

FIG. 21A shows the change over time of data pulse voltage $V_{data}$, scan pulse voltage $V_{SCN-SUS}$, and brightness occurring when the write discharge is performed. FIG. 21B shows the change over time of sustain pulse voltage $V_{SCN-SUS}$ and brightness occurring when the sustain discharge is performed.

It can be seen that the peak brightness of the write discharge shown in FIG. 21A is larger than the peak brightness for the first sustain pulse caused by the sustain discharge, and has the same peak brightness area as the peak brightness for the second sustain pulse.

Experiment 5B

The PDP was driven using both a simple rectangular wave and a two-step rising staircase waveform described in the present embodiment, for the data pulses, and the image quality and screen flicker were measured.

The data pulse was generated using a given waveform generator, and its voltage amplified by a high-speed high-voltage amplifier before being applied to the PDP. The maximum voltage $V_p$ in both cases was 100V. Table Two shows the results of the experiment.

TABLE TWO

| | MAX. VOLTAGE $V_p$ [V] | QUALITY OF DISPLAY IMAGE | FLICKER |
|---|---|---|---|
| RECTANGULAR WAVE | 100 | HALF TONE DISCONTINUITY | NO |
| WAVEFORM OF FIFTH EMBODIMENT | 100 | SATISFACTORY | NO |

From these results, it can be seen that using the waveform of the present embodiment for the data pulses produces a more satisfactory half-tone gray scale display and less flicker than if a simple rectangular wave is used, so that a high quality image can be produced.

Sixth Embodiment

Figure 22:
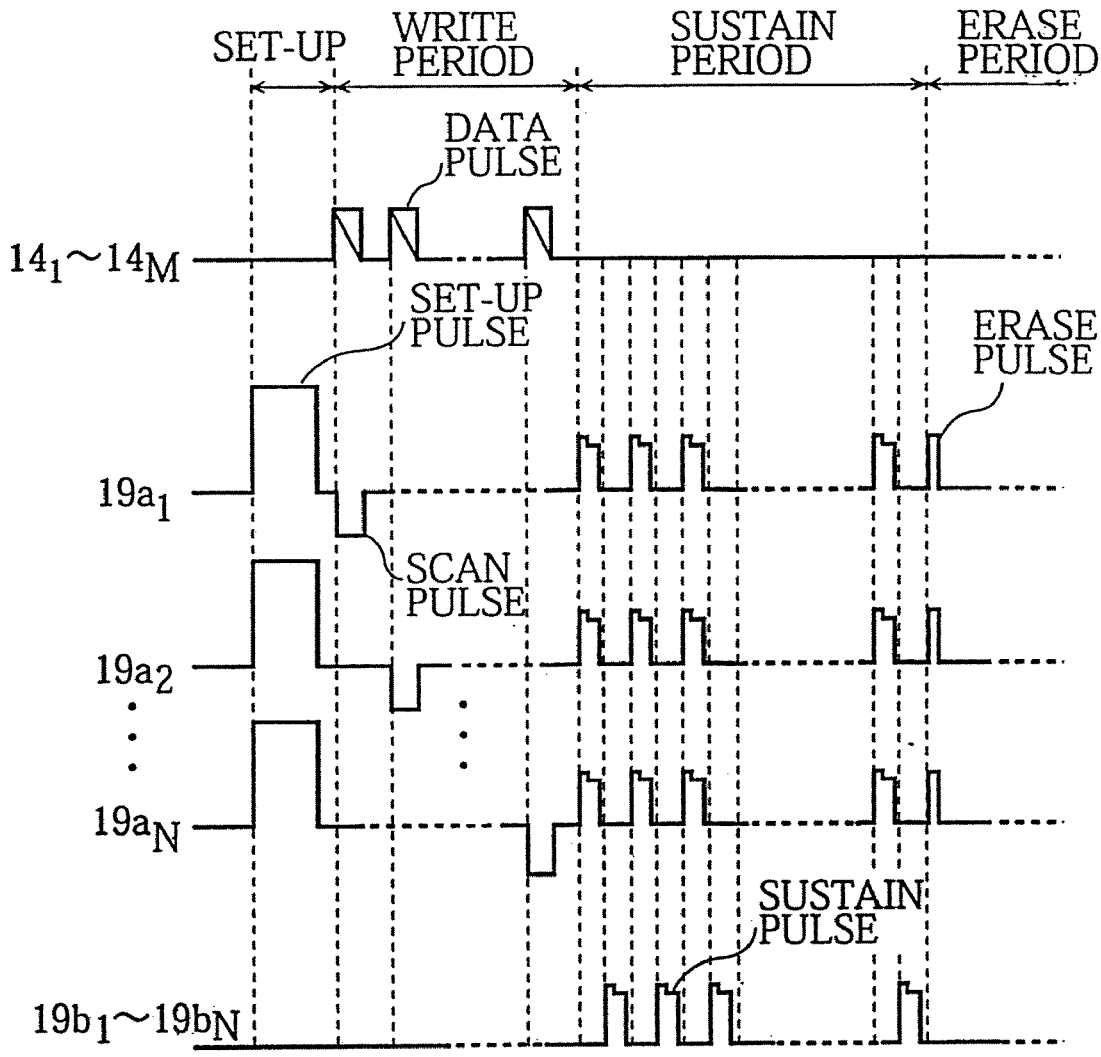
FIG. 22 is a time chart showing a PDP driving method relating to the sixth embodiment.

FIG. 22 is a time chart showing a PDP driving method relating to the present embodiment.

The present embodiment uses a two-step falling staircase waveform as a sustain pulse.

To apply this kind of two-step falling staircase waveform as the sustain pulse, a pulse adding circuit like the one explained in the second embodiment should preferably be used as the sustain pulse generators 112*a* and 112*b* shown in FIGS. 5 and 6.

When a simple rectangular wave like the one in the related art is used for the sustain pulses when driving the PDP, the higher the sustain pulse discharge is set the stronger the discharge, enabling light to be emitted at a high luminance. However, as shown in Experiment 6 below, if the discharge occurring at the rise time is too strong, an abnormal operation in which weak discharge occurs during the fall time is likely to be performed.

This phenomenon is generally referred to as the self-erasing discharge, and occurs when an overly strong discharge at the rise time causes the wall charge accumulated inside the discharge cells to be too high. This means that discharge at the fall time takes place in the reverse direction to that at the rise time. If this self-erasing discharge is generated, the wall charge accumulated by the discharge during the rise time is reduced, causing a corresponding drop in luminance. Additionally, when discharge is performed by the next pulse voltage in the reverse direction, the reduction in effective voltage applied to the discharge gas inside the discharge cell causes an abnormal operation in which unstable discharge is produced.

If a two-step falling staircase sustain pulse like the one in this embodiment is used, sudden voltage changes can be avoided and the self-erasing discharge restricted, even if the sustain pulse voltage is set at a high level.

Accordingly, in the driving method of the present embodiment, the sustain pulse voltage is set at a high level and light emission of a high luminance produced, while stable operation can be ensured, enabling superior image quality to be achieved.

Figure 2:
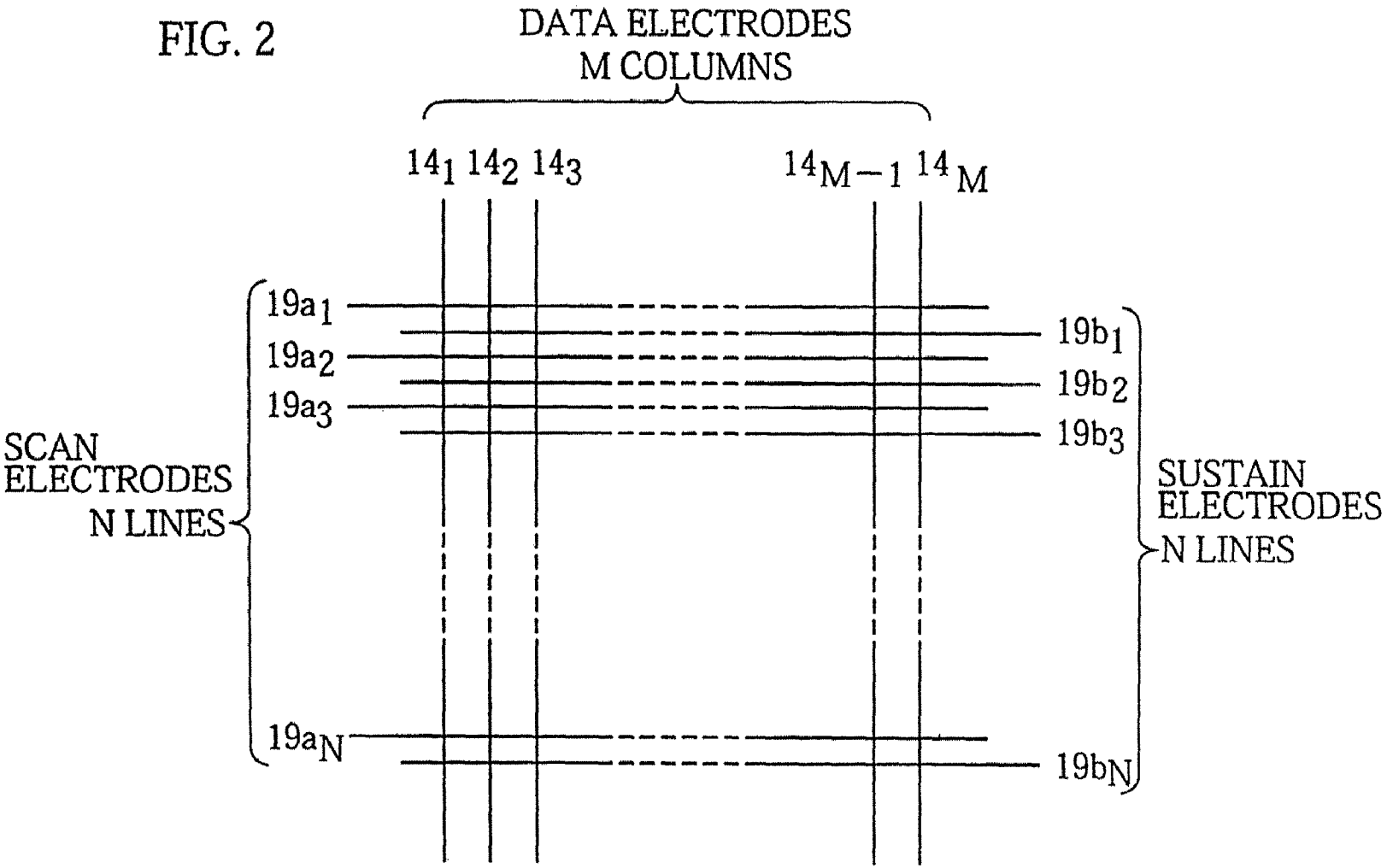
FIG. 2 shows an electrode matrix for the above PDP.
Figure 3:
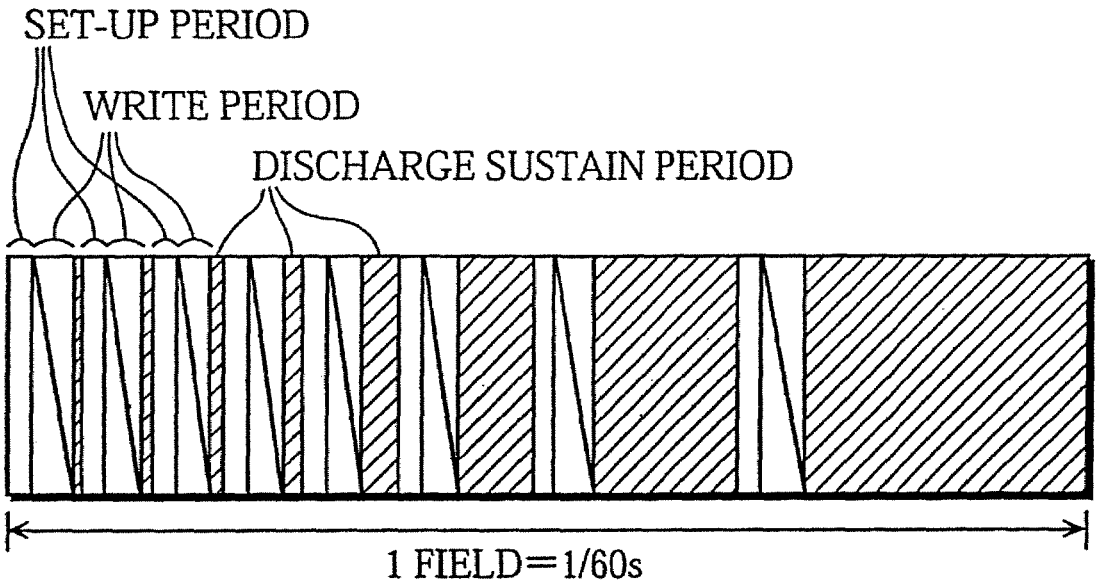
FIG. 3 shows a frame division method occurring when the above PDP is driven.

An example of a technique that uses a staircase pulse is U.S. Pat. No. 4,140,945. FIG. 2 of this reference teaches a technique in which an enhancement pulse is added to a conventional pulse to form a staircase waveform. In order to achieve the above effects; however, it is desirable to set the sustain pulse as described below.

When using this kind of two-step falling waveform as a sustain pulse, self-erasing discharge can be restricted if the maximum voltage for the sustain pulse is in the range of the starting voltage $V_f$+150V or lower, so the PDP should preferably be driven in this range.

Experiment 6

The PDP was driven using a simple rectangular wave as a sustain pulse, and changes over time in the voltage between the scan electrodes and the sustain electrodes, and the brightness measured. A reasonably high drive voltage and one similar to that in a conventional PDP was used.

The PDP was then driven at a reasonably high voltage using a two-step staircase waveform for the sustain pulses. The changes over time in voltage between the scan electrodes and the sustain electrodes, and in brightness were measured.

Additionally, the PDP was driven under each of the conditions above and the luminance in each case measured in the following way. A photo diode was used to observe brightness and the relative luminance in each case calculated from the integral value of the peak brightness. Measurement of the waveforms in each case was performed using a digital oscilloscope.

Figure 23A:
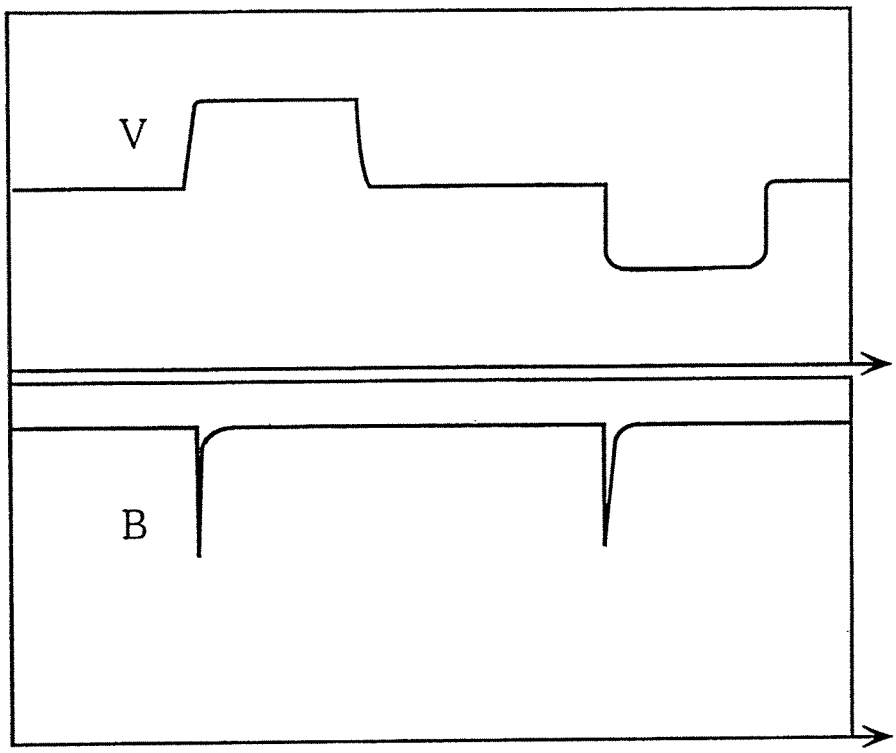
FIGS. 23 and 24 show the results measurements made in experiment 6.
Figure 23B:
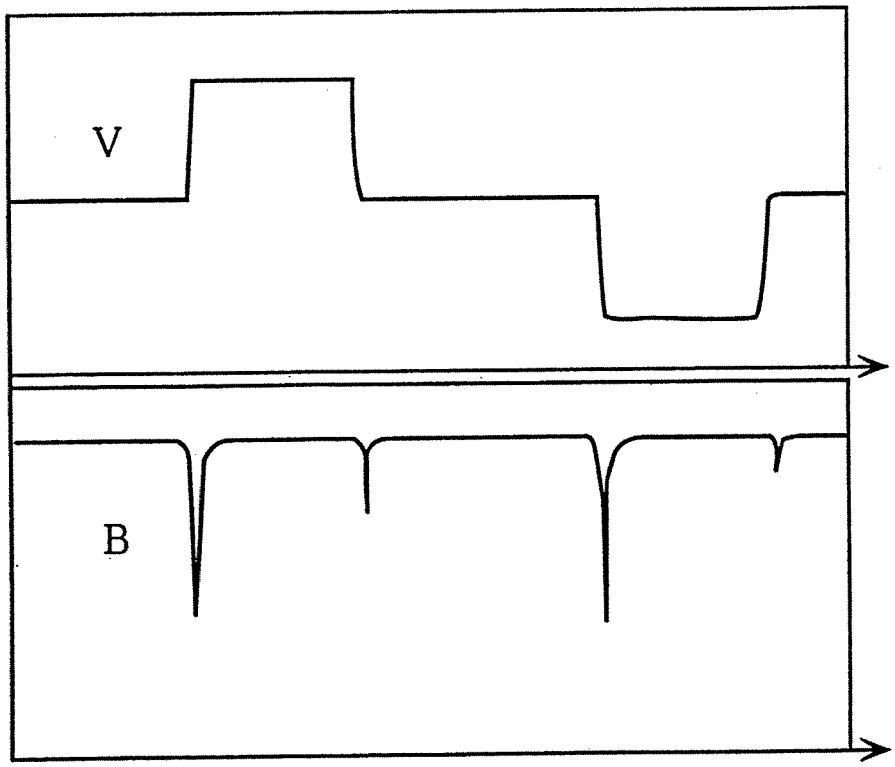
Figure 24:
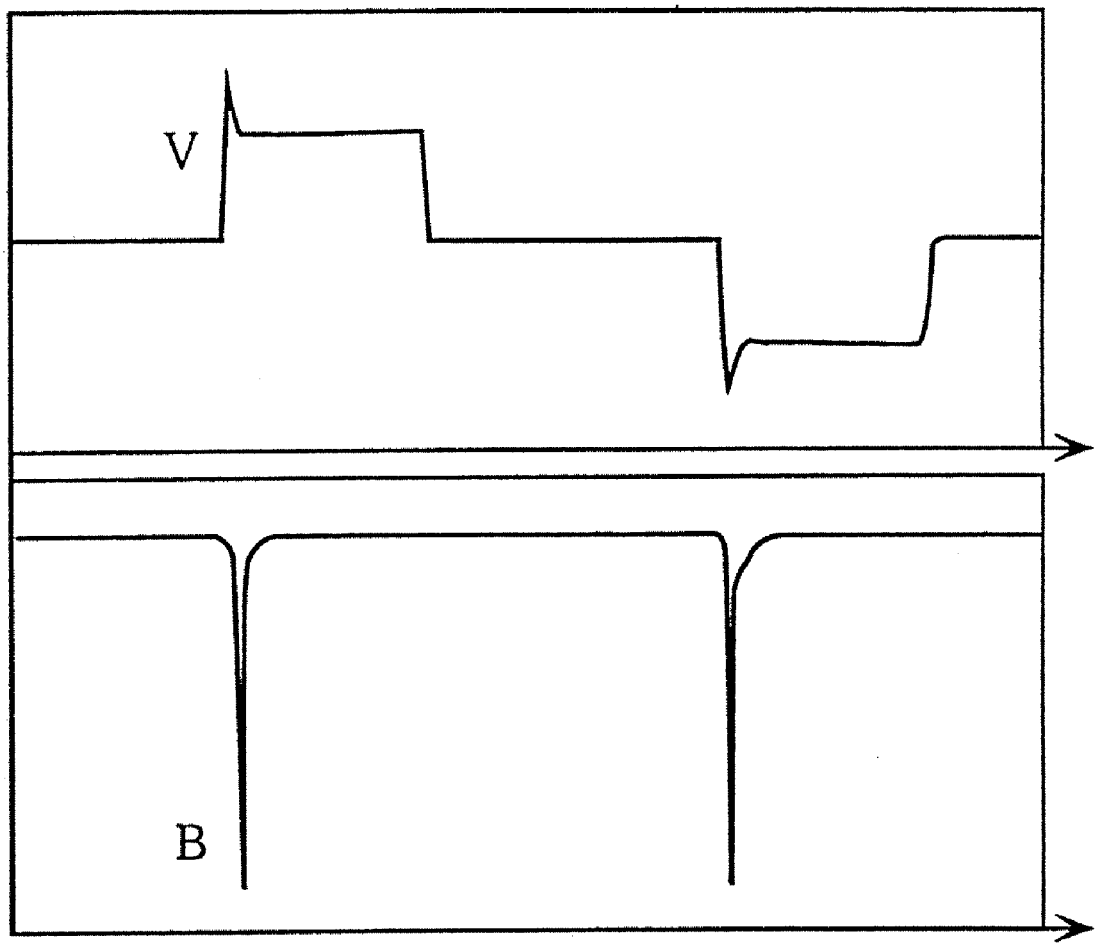

FIGS. 23 and 24 show the results of measurement of changes over time in the voltage V and brightness B. FIG. 23A shows results for a rectangular wave at a regular drive voltage, and FIG. 23B for a rectangular wave at a reasonably high drive voltage. FIG. 24 shows results for a two-step falling staircase waveform at a reasonably high voltage.

TABLE THREE

| | MAX. VOLTAGE $V_p$ [V] | RELATIVE BRIGHTNESS | SELF-ERASING DISCHARGE |
|---|---|---|---|
| RECTANGULAR WAVE | 200 | 1.00 | NO |
| RECTANGULAR WAVE | 280 | 1.83 | YES |
| WAVEFORM OF SIXTH EMBODIMENT | 280 | 2.10 | NO |

Table Three shows the maximum voltage of $V_p$ of the sustain pulses, the luminance measurement result (relative value) and whether a self-erasing discharge is present or not.

When the PDP was driven at a conventional drive voltage ($V_p$=100V) using a rectangular wave for the sustain pulses, a light emission peak could be observed only at the rise time and not at the fall time (i.e. self-erasing discharge was not generated), as shown in FIG. 23A. When the PDP was driven at a reasonably high drive voltage ($V_p$=280V) using a rectangular wave for the sustain pulses, however, a small light emission peak was also observed at the fall time (i.e. self-erasing discharge was generated), as shown in FIG. 23B.

In contrast, when the PDP was driven at a reasonable high drive voltage ($V_p$=280V) using a two-step falling staircase waveform for the sustain pulses, a light emission peak was only observed at the rise time not the fall time, as shown in FIG. 24. This shows that using the driving method of the present embodiment makes the self-erasing charge unlikely to be generated even at a reasonable high maximum drive voltage.

The relative luminance values in Table Three reveal that luminance is higher when a two-step falling staircase waveform is used than when a rectangular wave is used.

A two-step falling staircase waveform was used for the sustain pulses and light emission checked with the maximum voltage set at various levels. It was observed that no light emission peak was visible at the fall time when the maximum voltage was no more than twice as much ($2V_{smin}$) the minimum discharge sustain voltage $V_{smin}$ and that a light emission peak was visible at the fall time when the maximum voltage was more than twice as much ($2V_{smin}$) as the minimum discharge sustain voltage self-erasing discharge $V_{smin}$.

Seventh Embodiment

Figure 25:
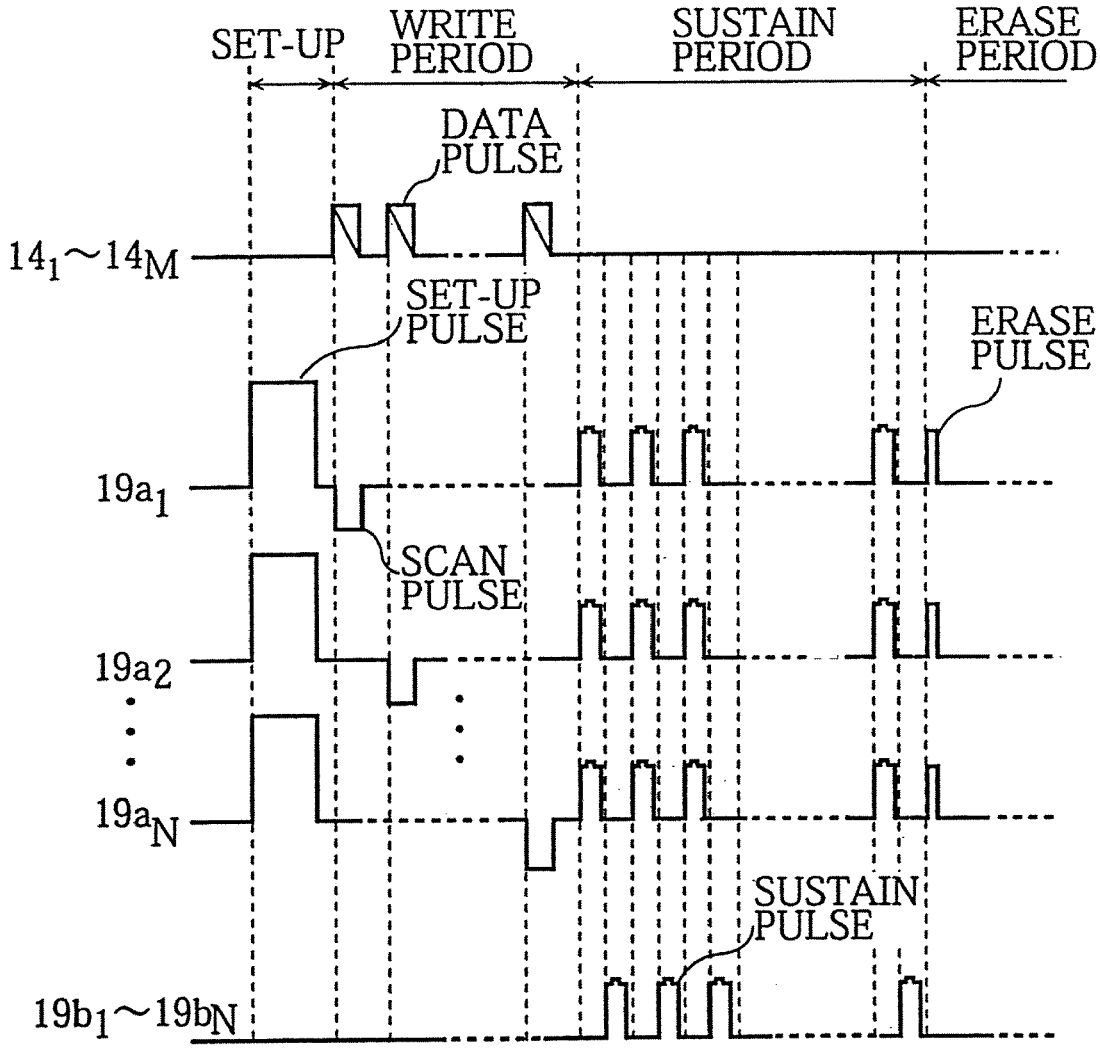
FIG. 25 is a time chart showing a PDP driving method relating to the seventh embodiment.

FIG. 25 is a time chart showing a PDP driving method relating to the present embodiment.

The present embodiment uses a staircase waveform that rises and falls in two steps for the sustain pulses.

To apply a two-step rising and falling staircase waveform for the sustain pulses in this way, a pulse adding circuit like the one explained in the first embodiment may be used as the sustain pulse generators 112*a* and 112*b* shown in FIGS. 5 and 6, with the second pulse set more narrowly.

Figure 26A:
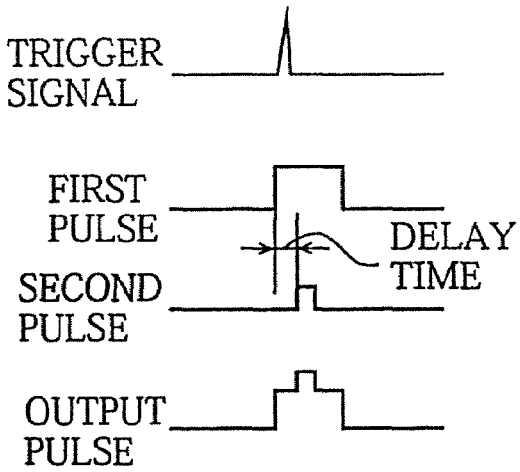
FIG. 26 shows the situation when a first and second pulse are added by the pulse adding circuit to form a staircase waveform with a two-step rise and fall.
Figure 26B:
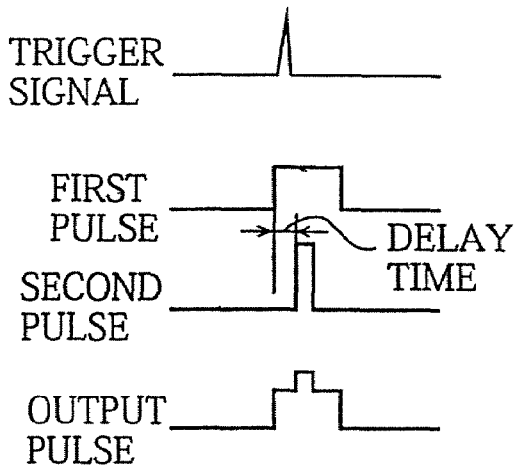

A two-step rising and falling staircase waveform can be generated in the following way. The kind of pulse adding circuit shown in FIG. 9, in which first and second pulse generators are connected in series using a floating ground method, may be used. As shown in FIG. 26A, a broad rectangular wave is raised as a first pulse by the first pulse generator. Then, after a specified time delay, a very narrow rectangular wave is raised as a second pulse by the second pulse generator. The two pulses are then added. Alternately, a pulse adding circuit in which the first and second pulse generators are connected in parallel may be used. As shown in FIG. 26B, a wide rectangular wave is raised as the first pulse by the first pulse generator at a low level. Then, after a specified time delay, a narrow rectangular wave is raised as the second pulse by the second pulse generator at a high level. A two-step rising and falling staircase waveform is then generated by adding the two pulses.

When a simple rectangular pulse like the one in the related art is used for the sustain pulses in driving the PDP, raising the drive voltage causes the luminance to become higher, but the discharge current and power consumption also become proportionally higher. Thus, raising the drive voltage has little effect on luminous efficiency.

If a two-step rising and falling staircase waveform is used for the sustain pulses, the maximum voltage of the sustain pulses can be set at a high level, so that even if light is emitted at a high luminance, power consumption will not be very large. When compared with the related art, the PDP driving method of the present embodiment has higher luminance and a rate of increase in power consumption which is relatively lower than the rate of increase in luminance, enabling discharge efficiency to be increased.

This is due to the fact that use of a two-step rising and falling staircase waveform for the sustain pulses enables the generation of unnecessary power to be restricted by aligning the phase of the sustain pulse voltage applied to the discharge cells with the phase of the discharge current.

An example of the technique that uses a staircase pulse is U.S. Pat. No. 4,140,945. FIG. 2 of this reference teaches a technique in which an enhancement pulse is added to a conventional pulse to form a staircase waveform. In order to achieve the above effects, however, it is desirable to set the sustain pulse as described below.

The same effect can be achieved providing that a staircase waveform which rises in two steps is used for the sustain pulses, so that it is not absolutely necessary to change the falling period of the pulses to two steps as well.

In order to improve discharge efficiency further, when a sustain pulse rises in two steps, the voltage raised in the first step is set in relation to the starting voltage $V_f$ so that it is in the range of not less than $V_f$−20V but not more than $V_f$+30V, and the voltage sustaining period between the first step rise and the second step rise is set in relation to the discharge delay time $T_{df}$ so that it is not less than $T_{df}$−0.2 μs but not more than $T_{df}$+0.2 μs.

Experiment 7A

A PDP using a two-step rising and falling staircase waveform for the sustain pulses was driven and the amount of power consumed inside discharge cells when the sustain discharge was produced evaluated by observing a V-Q Lissajous's figure. The sustain pulses were generated by a given waveform generator and applied to the PDP after their voltage was amplified by a high-speed high-voltage amplifier.

The V-Q Lissajous's figure shows the way in which the wall charge Q accumulated in the discharge cells during the first cycle of the pulse changes in a loop. The loop area WS in the V-Q Lissajous's figure has a relation to the power consumption W during discharge that is expressed by the formula (1) below. Thus, observing this V-Q Lissajous's figure enables power consumption to be calculated.

$$W=fS \text{ (note that f is a driving frequency)} \quad (1)$$

When this measurement is made, the wall charge Q accumulated in the discharge cells is measured by connecting a wall charge measuring apparatus to the PDP. This apparatus uses the same principle as Sawyer-Tower circuits employed to evaluate characteristics of ferroelectrics and the like.

Figure 27:
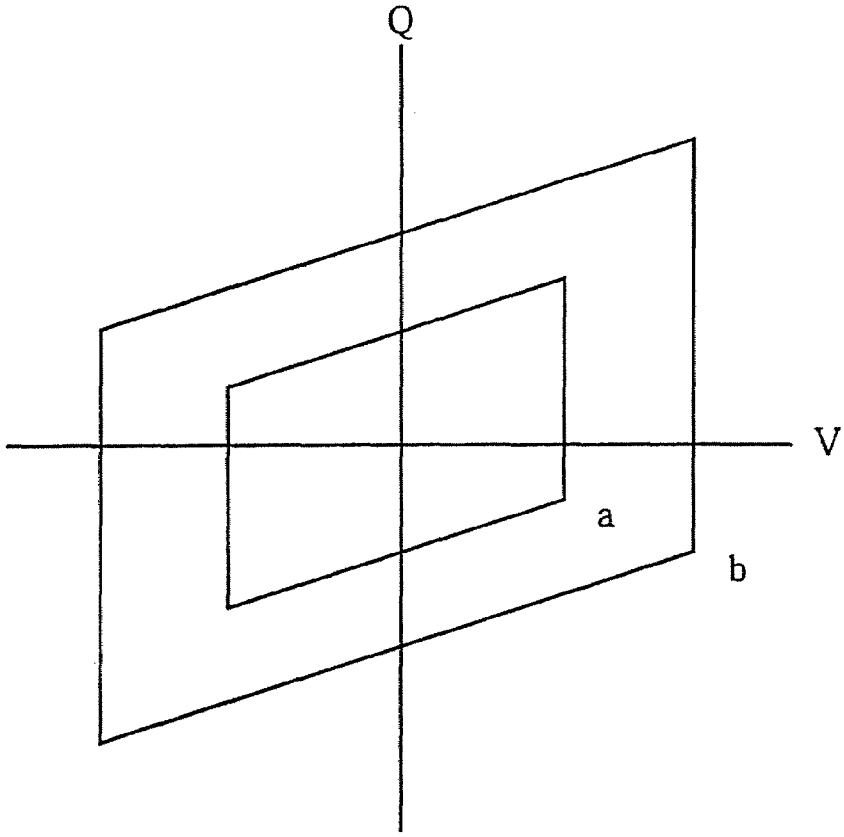
FIG. 27 is a chart showing V-Q Lissajous's figures produced when driving is performed using a simple rectangular wave as sustain pulses.

FIG. 27 shows V-Q Lissajous's figures occurring when a PDP using a simple rectangular wave as the sustain pulse was driven, a is the figure showing when the PDP was driven using a low voltage and b when the PDP was driven using a high voltage.

As shown in the drawing, when a simple rectangular wave is used for the sustain pulse, Lissajous's figures a and b are analogous parallelograms. This illustrates the fact that when a rectangular pulse is used, increases in the drive voltage produce proportional increases in power consumption.

Figure 28:
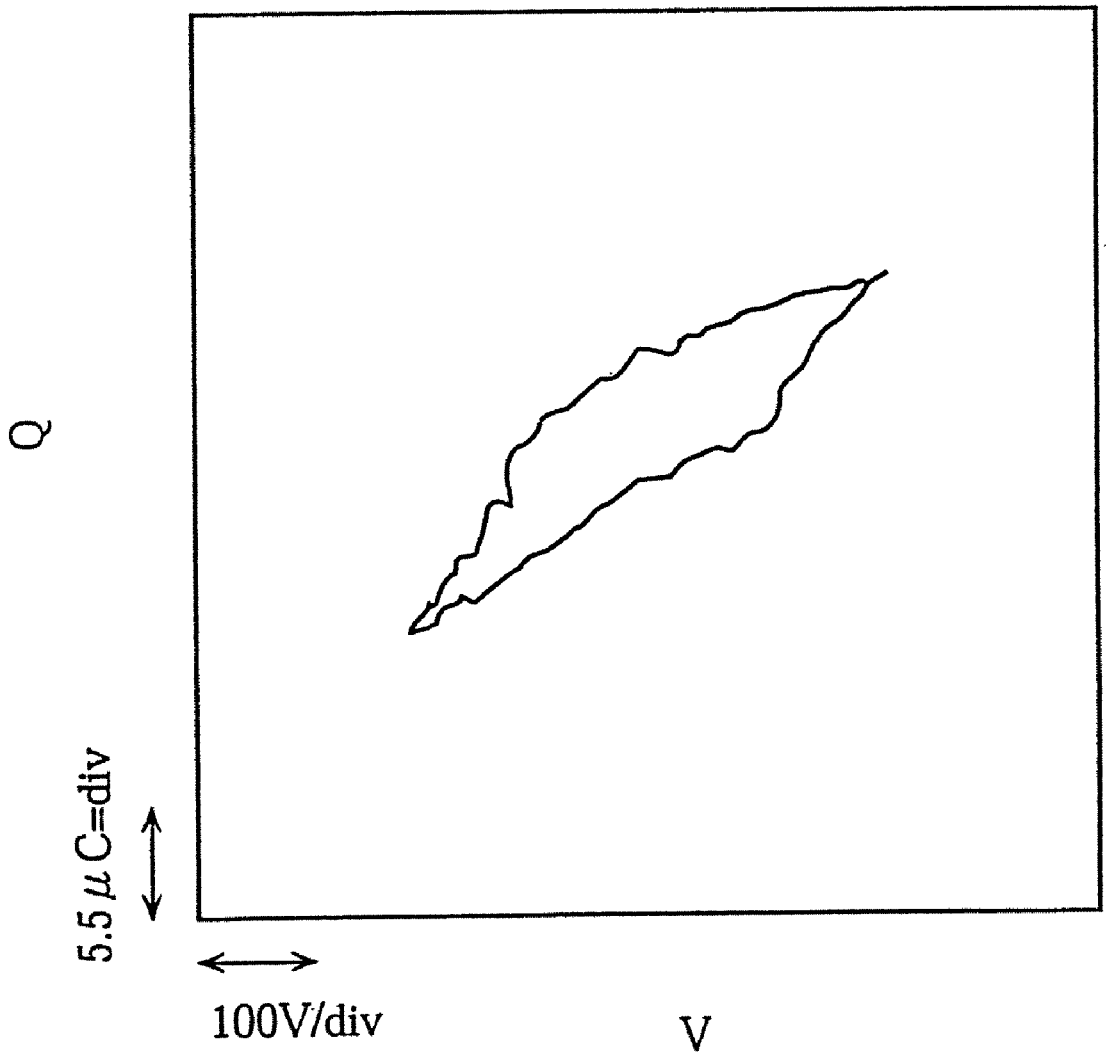
FIG. 28 is an example of a V-Q Lissajous's figure observed when a PDP is driven using the method of the seventh embodiment.

FIG. 28 is an example of a V-Q Lissajous's figure observed when the PDP is driven using a two-step rising and falling staircase waveform as the sustain pulse.

The V-Q Lissajous's figure shown in the drawing is an flattened lozenge shape rather than the parallelograms shown in FIG. 28.

This shows that even if the V-Q Lissajous's figure of FIG. 28 has the same wall charge transfer amount occurring in the discharge cells as the V-Q Lissajous's figures of FIG. 27 the loop area has become smaller. In other words, the same quantity of light is emitted, but power consumption has decreased considerably.

V-Q Lissajous's figures were measured for a PDP driven using a two-step rising and falling staircase waveform for the sustain pulses when various values were used for the voltage in the first-step rise and the voltage sustaining period from the first-step rise to the second-step rise. As a result, when the rising voltage in the first step was set in the range of $V_f$−20V to $V_f$+30V, a comparatively flattened loop was measured. When the voltage sustaining period was set in the range of $T_{df}$−0.2 μs to $T_{df}$+0.2 μs a comparatively flattened loop was also measured.

Experiment 7B

The PDP 10 was driven, using both a simple rectangular wave and a two-step rising and falling staircase waveform for the sustain pulses, and the luminance and power consumption in each case were measured.

As in Experiment 6, the relative luminance value was calculated from the integral value of the peak brightness. The power consumed when driving the PDP was also measured and a relative luminous efficiency calculated from the relative luminance and the relative power consumption. Table Four shows the relative values for relative luminance, relative power consumption and relative luminous efficiency.

TABLE FOUR

| | RELATIVE BRIGHTNESS | RELATIVE POWER CONSUMPTION | RELATIVE EFFICIENCY |
|---|---|---|---|
| RECTANGULAR WAVE | 1.00 | 1.00 | 1.00 |
| WAVEFORM OF SEVENTH EMBODIMENT | 1.30 | 1.15 | 1.13 |

From these results, it can be seen that using a two-step rising and falling staircase waveform rather than a simple rectangular wave for the sustain pulses enables luminance to increase by 30%, while the increase in power consumption is limited to around 15%, and luminous efficiency increases by 13%.

The PDP driving method of the present embodiment enables superior driving with higher luminance and luminous efficiency than in the driving method of the related art to be realized.

Eighth Embodiment

Figure 29:
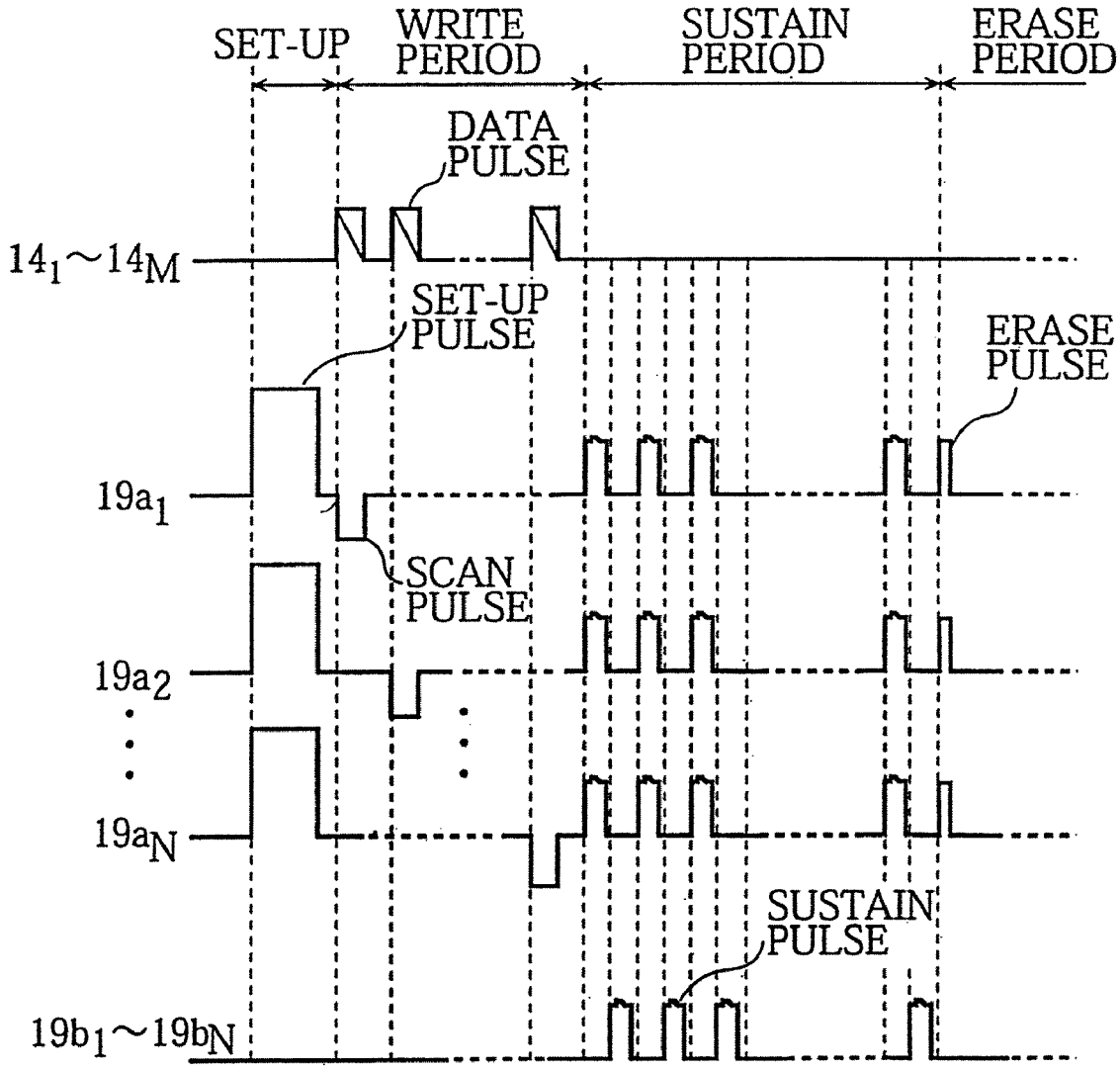
FIG. 29 a time chart showing a PDP driving circuit relating to the eighth embodiment.

FIG. 29 is a time chart showing a PDP driving method relating to the present embodiment.

The present embodiment uses a two-step rising and falling staircase waveform as the sustain pulse, as was the case in the seventh embodiment, but the waveform has the following unique features.

Figure 30:
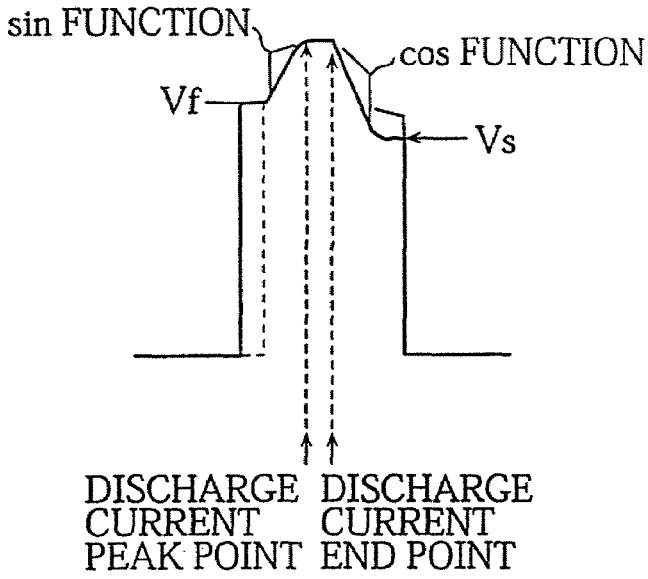
FIG. 30 shows a waveform for sustain pulses in the eighth embodiment.

FIG. 30 shows the waveform for the sustain pulse used in the present embodiment.

(1) The first step rise is performed at almost the same voltage as the starting voltage $V_f$ in the discharge cells.

(2) The voltage for the second step rise can be measured trigonometrically by a sine function, so that the maximum voltage change point and the peak discharge current point are almost identical.

(3) The start of the falling period is almost identical to the point at which the discharge current stops.

(4) The first falling step falls to the vicinity of the minimum sustain voltage $V_s$ at a speed determined trigonometrically by a cos function. The minimum sustaining voltage $V_s$ mentioned here is the minimum sustaining voltage used when a PDP is driven using a simple rectangular wave. This voltage $V_s$ can be measured by applying voltage between the scan electrodes 12*a* and the sustain electrodes 12*b* in the PDP 10 to place the discharge cells in an ignited state, reducing the applied voltage little by little and reading the applied voltage at the time when the discharge cells are first extinguished.

A pulse adding circuit as explained in the eighth embodiment may be used as the sustain pulse generators 112*a* and 112*b* shown in FIGS. 5 and 6, in order to apply a staircase waveform having the above unique characteristics for the sustain pulses. However, a pulse oscillator having a RLC (resistor-inductor-capacitator) circuit is used for the second pulse generator, so as to determine the rise and fall portions of the second pulse trigonometrically.

Figure 31A:
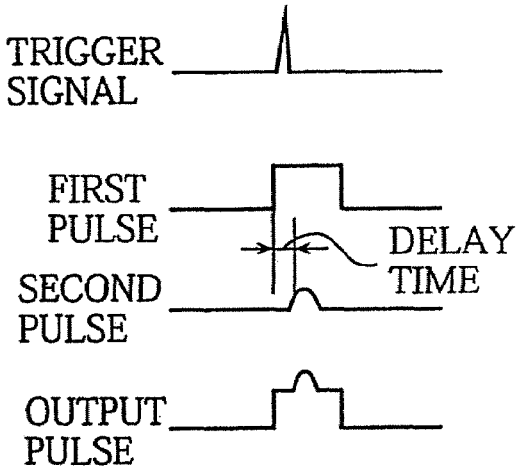
FIG. 31 shows the situation when a first and second pulse are added by the pulse adding circuit to form the staircase waveform of the eighth embodiment.
Figure 31B:
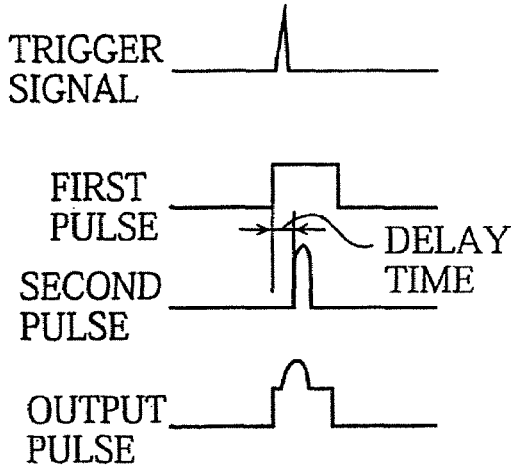

In other words, a waveform having the above unique characteristics can be generated in the following way. A pulse adding circuit having first and second pulse generators connected in series using a floating ground method as in FIG. 9 is used. As shown in FIG. 31A, a wide waveform is raised as a first pulse by the first pulse generator. Then, after a specified delay, an extremely narrow trigonometrically altered waveform is raised as the second pulse by the second pulse generator. The two pulses are then added. Alternately, a pulse adding circuit in which first and second pulse generators are connected in parallel may be used. As shown in FIG. 31A, a wide rectangular wave is raised at a comparatively low level as the first pulse by the first pulse generator. Then, after a specified delay, a narrow trigonometrically determined second pulse is raised at a comparatively high level by the second pulse generator. The two pulses are added to generate a waveform with the unique characteristics described above.

The slope at which the second pulse rises and falls can be adjusted by adjusting the time constant of the RLC circuit in the second pulse generator.

The driving method of this embodiment, like that of the seventh embodiment, improves luminance while restricting increases in power consumption, and improving luminous efficiency. The effects produced by this embodiment are much greater however.

The reason that luminous efficiency is even higher when using the waveform of the present embodiment lies in the fact that the phase of the voltage variation is delayed until after the phase of the discharge current in the second step of the rising period by using characteristics (1) and (2) above. This causes a situation in the discharge cells where an overvoltage is applied from the power source after discharge has started to take place within the cells, causing power to be forcibly injected into the plasma inside the discharge cells.

Furthermore, luminous efficiency is increased by creating a situation in which a high voltage is applied to the discharge cells primarily during the period in which light emission takes place. This is achieved using characteristics (3) and (4) above.

The following conclusions can be drawn based upon the above reasons.

When using a two-step rising and falling staircase waveform for the sustain pulses, the phase of the voltage (terminal voltage for the discharge cells) variation in the second step during the rising period should preferably be set later than the phase of the discharge current, so that luminous efficiency can be improved.

When using a staircase waveform which rises in the second step according to a trigonometrical function as the sustain pulse, the second step rise should preferably be performed within a discharge period $T_{dise}$ during which a discharge current is flowing, so that luminous efficiency can be improved.

The discharge period $T_{dise}$ is the period between the completion of a charge period $T_{chg}$ in which the discharge cells are charged to capacity and the end of the flow of the discharge current. Here, the 'discharge cell capacity' can be viewed as a geometric capacity decided by the structure of the discharge cells formed by the scan electrodes, the sustain electrodes, the dielectric layer and the discharge gas. As a result, the discharge period $T_{dise}$ can be described as 'the period from the completion of the charge period $T_{chg}$ during which the discharge cells are charged to geometric capacity to the completion of the discharge current'.

In an alternative to the present embodiment, when a staircase pulse is generated by adding the first and second pulses, a trigonometrically determined pulse may also be used for the first pulse. This generates a pulse in which both the first and second steps of the rising period are trigonometrically determined to be used for the sustain pulse.

When a sustain pulse with this kind of waveform is used, luminous efficiency may be further improved depending on the structure of the PDP. In this case, the first-step rise is a discharge period dscp from the start of the discharge period $T_{dise}$ until the discharge current has reached its maximum value. The second-step rise is a period between the time that the discharge current has reached its maximum value until the completion of the discharge period $T_{dise}$.

Experiment 8A

The PDP was driven using a waveform with the characteristics described above for the sustain pulses. A voltage V occurring between electrodes (scan and sustain electrodes) in the discharge cells, a wall charge amount Q accumulated in the discharge cells, the amount of variation in the wall charge amount dQ/dt and brightness B of the PDP were measured and a V-Q Lissajous's figure was also observed.

The measurement of wall charge Q, brightness B and the like took place as in the experiment of the seventh embodiment.

Figure 32:
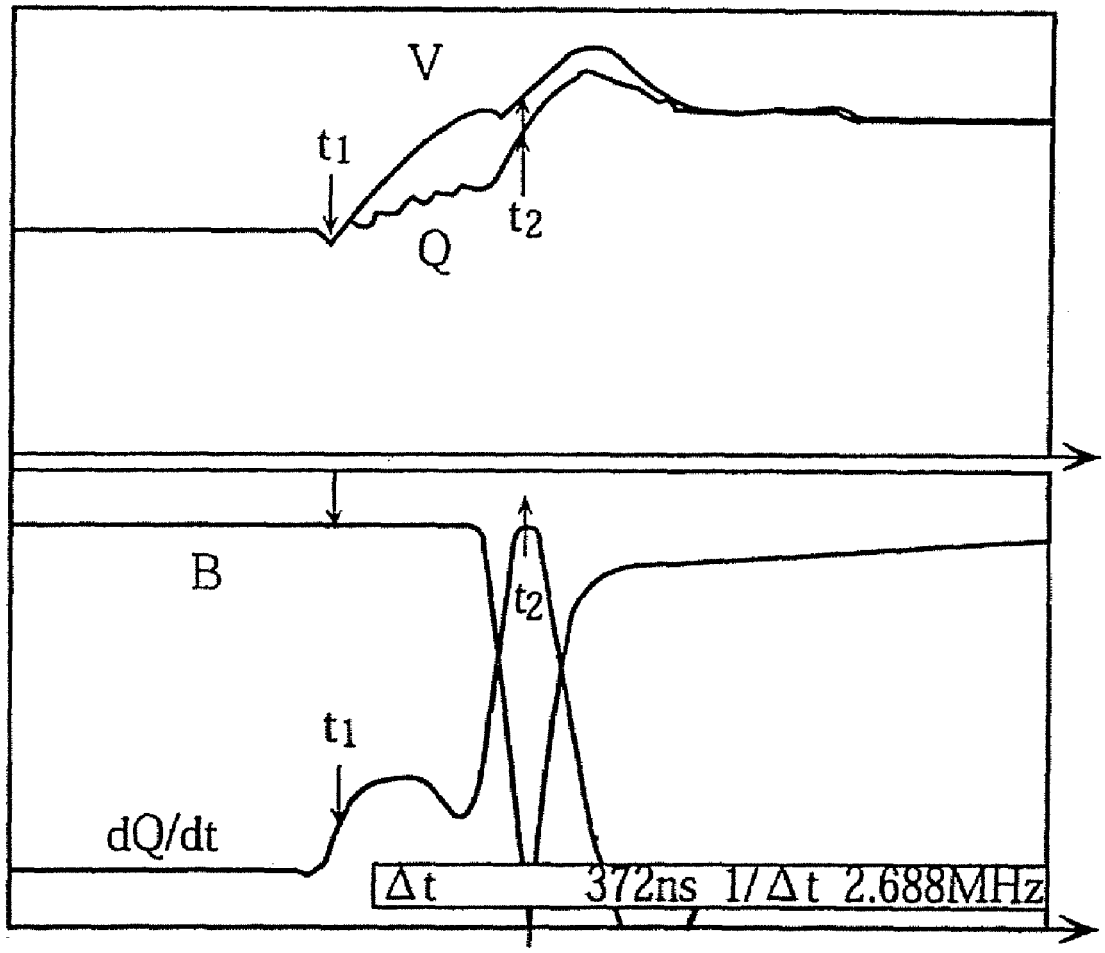
FIG. 32 shows the results of measurements made in experiment 8A.
Figure 33:
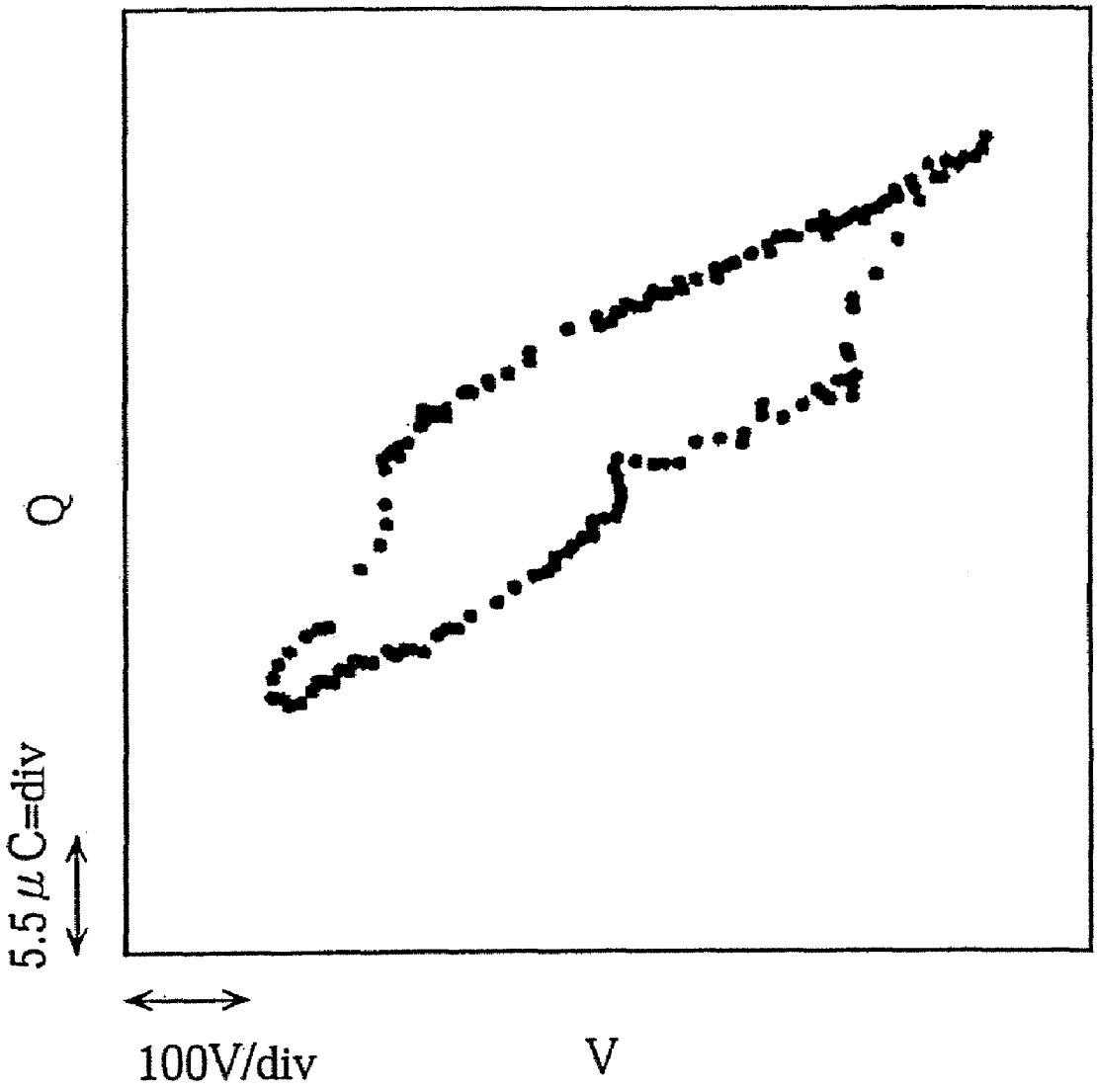
FIG. 33 is an example of a V-Q Lissajous's figure showing the results measured by experiment 8A.

FIGS. 32 and 33 show the results of these measurements. In FIG. 32, the electrode voltage V and the wall voltage Q, and the variation in wall voltage amount ΔQ and brightness B are plotted along a time axis. FIG. 33 is an example of a V-Q Lissajous's figure.

From FIG. 32 it can be seen that during the rise time the rise in voltage for second step rise starts immediately after to the point at which the discharge current starts to flow ($t_1$ in the drawing), and the phase for the rise in voltage for the second step is delayed until after the phase of the discharge current. The highest point of the rise in voltage V is restricted in the vicinity of the peak time for the discharge current ($t_2$ in the drawing).

The period during which the brightness B is at a high level coincides with the period in which a high voltage is applied to the discharge cells, revealing that a high voltage is applied to the discharge cells primarily during the period when light is being emitted.

The V-Q Lissajous's figure of FIG. 33 is a flattened diamond shape, with curved indentations at both left and right ends. These indentations show that the loop area has decreased, even though the wall charge transfer amount in the discharge cells remains the same. In other words, the power consumption is smaller although the amount of light emitted is the same.

Experiment 8B

The PDP 10 was driven by the same method as in the experiment in the seventh embodiment, using a simple rectangular wave and then the staircase waveform of the present embodiment for the sustain pulses. Luminance and power consumption were measured, and relative luminous efficiency calculated from relative luminance and relative power consumption. Table Five shows the values for relative luminance and relative power consumption and relative luminous efficiency.

TABLE FIVE

| | RELATIVE BRIGHTNESS | RELATIVE POWER CONSUMPTION | RELATIVE EFFICIENCY |
|---|---|---|---|
| RECTANGULAR WAVE | 1.00 | 1.00 | 1.00 |
| WAVEFORM OF EIGHTH EMBODIMENT | 2.11 | 1.62 | 1.30 |

From these results, it can be seen that using a staircase waveform like the one in the present embodiment rather than a simple rectangular wave as the sustain pulse enables luminance to double, while the increase in power consumption is limited to around 62%, and luminous efficiency increases by 30%.

The present embodiment shows an example which used a waveform whose second step in the rising period and first step in the falling period were trigonometrically determined, but any continuous function may be used to achieve similar effects. For example, a waveform altered by an exponential function or a Gaussian function may also be used.

Ninth Embodiment

Figure 34:
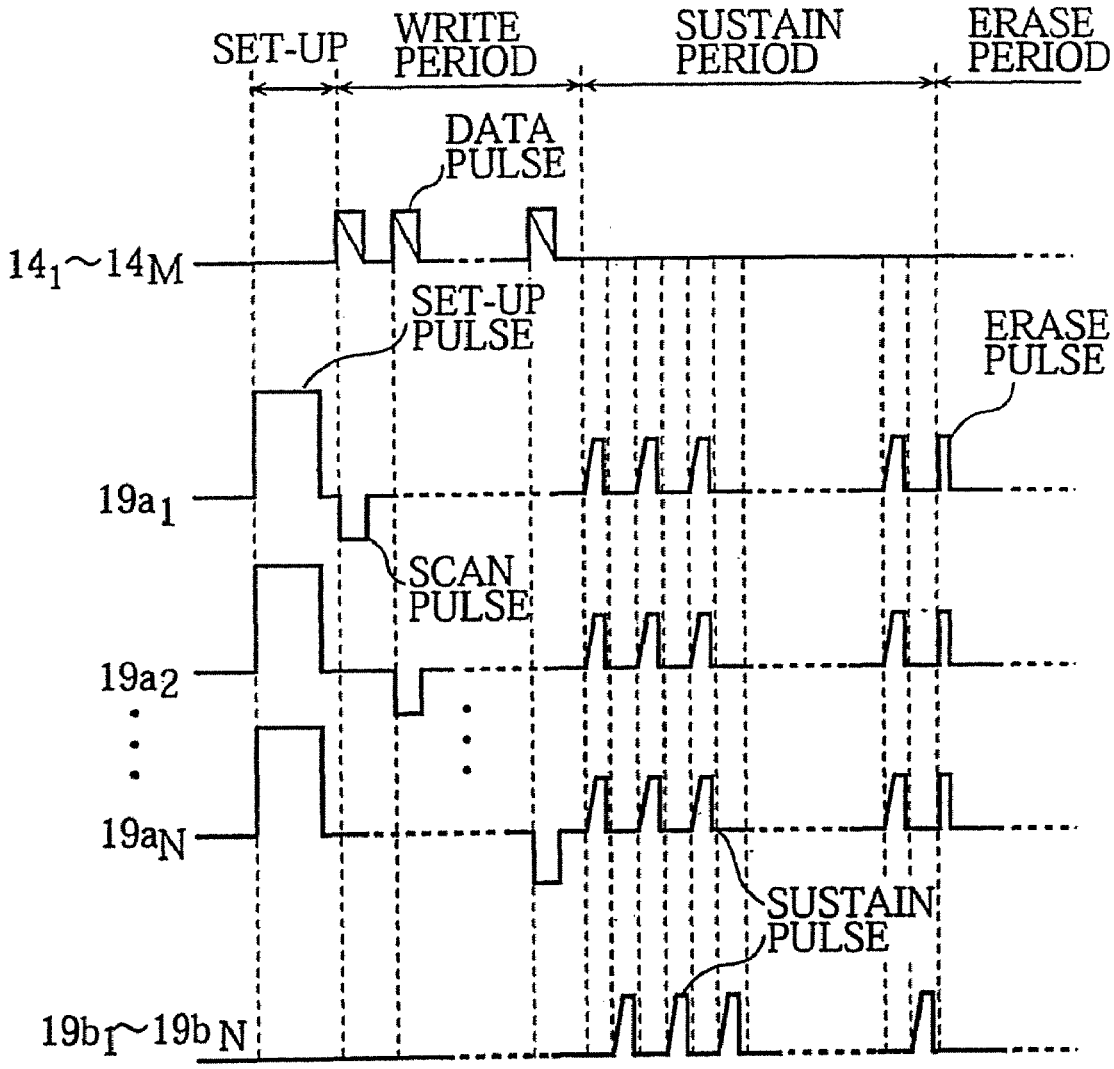
FIG. 34 is a time chart showing a PDP driving method relating to the ninth embodiment.

FIG. 34 is a time chart showing a PDP driving method relating to the present embodiment.

The present embodiment uses a trapezoid waveform, shaped so that no impact is made on the rate at which voltage is driven upward during the rise time, for the sustain pulses.

Figure 35:
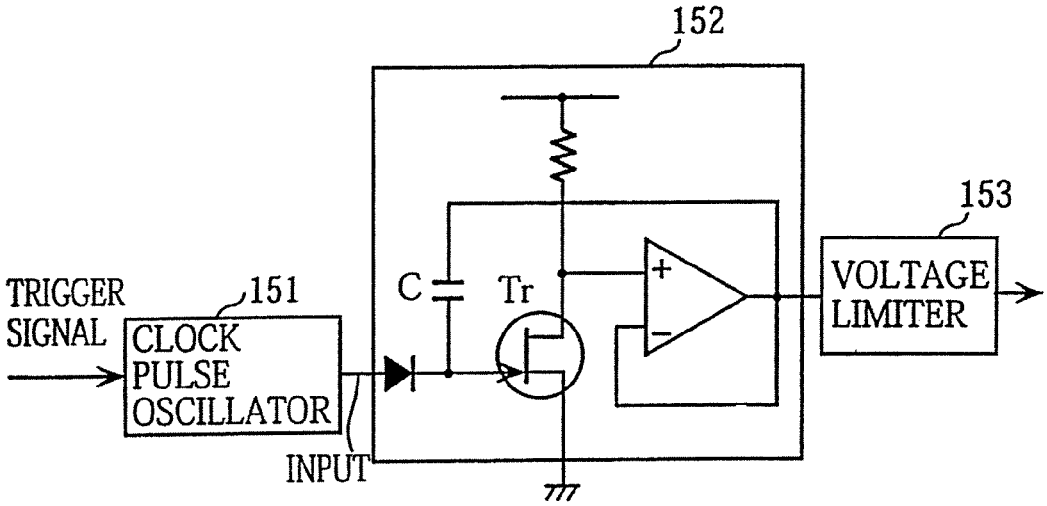
FIG. 35 is a block diagram showing a structure of a trapezoid waveform generating circuit relating to the ninth embodiment.
Figure 36A:
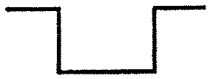
FIG. 36 shows a trapezoid waveform generated by the trapezoid waveform generating circuit.
Figure 36B:
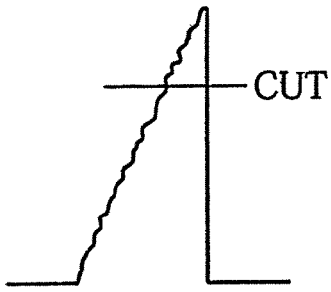
Figure 36C:
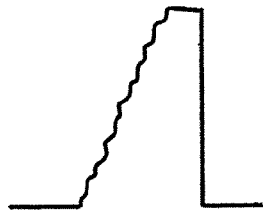

This kind of rising slope waveform may be applied for the sustain pulses using, for example, a trapezoid waveform generating circuit shown in FIG. 35 as the sustain pulse generators 112*a* and 112*b* shown in FIGS. 5 and 6. This trapezoid waveform generating circuit is composed of a clock pulse oscillator 151, a triangular wave generating circuit 152 and a voltage limiter 153. The voltage limiter 153 cuts the voltage at a certain level. In the trapezoid waveform generating circuit, the clock pulse oscillator 151 generates a rectangular wave shown in FIG. 36A in response to a trigger signal from the added pulse generator 103. The triangular waveform generating circuit 152 generates a triangular waveform shown in FIG. 36B based on this rectangular wave. Then the voltage limiter 153 cuts off the peak of the triangular waveform to generate a trapezoid waveform shown in FIG. 36C.

A mirror integrated saw wave generating circuit may be used for the triangular waveform generator 151, as shown in FIG. 35. The mirror integrated cut wave generating circuit of FIG. 35 is described in the *Denshi Tsushin Handobuku* already mentioned. A Zener diode limiter may be used, for example, as the voltage limiter 153.

Using a rising slope waveform for the sustain pulses rather than the simple rectangular wave of the related art enables power consumption to be kept at a low level without reducing luminance. In other words, superior image quality can be realized with low power consumption.

The reason for this is that causing the rise in voltage during the rising period of the sustain pulse to slope at an angle makes the applied voltage at the point of the maximum discharge current larger that the applied voltage at the discharge starting point, as was also the case in the eighth embodiment.

As an alternative to the present embodiment, a waveform in which the rise period is a slope and the fall period is in two steps may also be used for the sustain pulses to obtain the same effects as those in the seventh embodiment.

The angle of the rise slope in the sustain pulse should preferably be in the range of 20V to 800V/μs. When the sustain pulse has a width of 5 μs or less, the angle should preferably be in the range of 40V to 400V/μs.

Experiment 9A

The PDP was driven using a rising slope sustain pulse, and the voltage occurring between electrodes V (scan and sustain electrodes), the wall charge amount Q accumulated in the discharge cells, the variation dQ/dt in the wall charge amount Q and brightness B of the PDP were measured in the same way as for Experiment 8B in the eighth embodiment. A V-Q Lissajous□s figure was also observed.

The rising slope of the sustain pulse had a gradient of 200V/μs.

Figure 37:
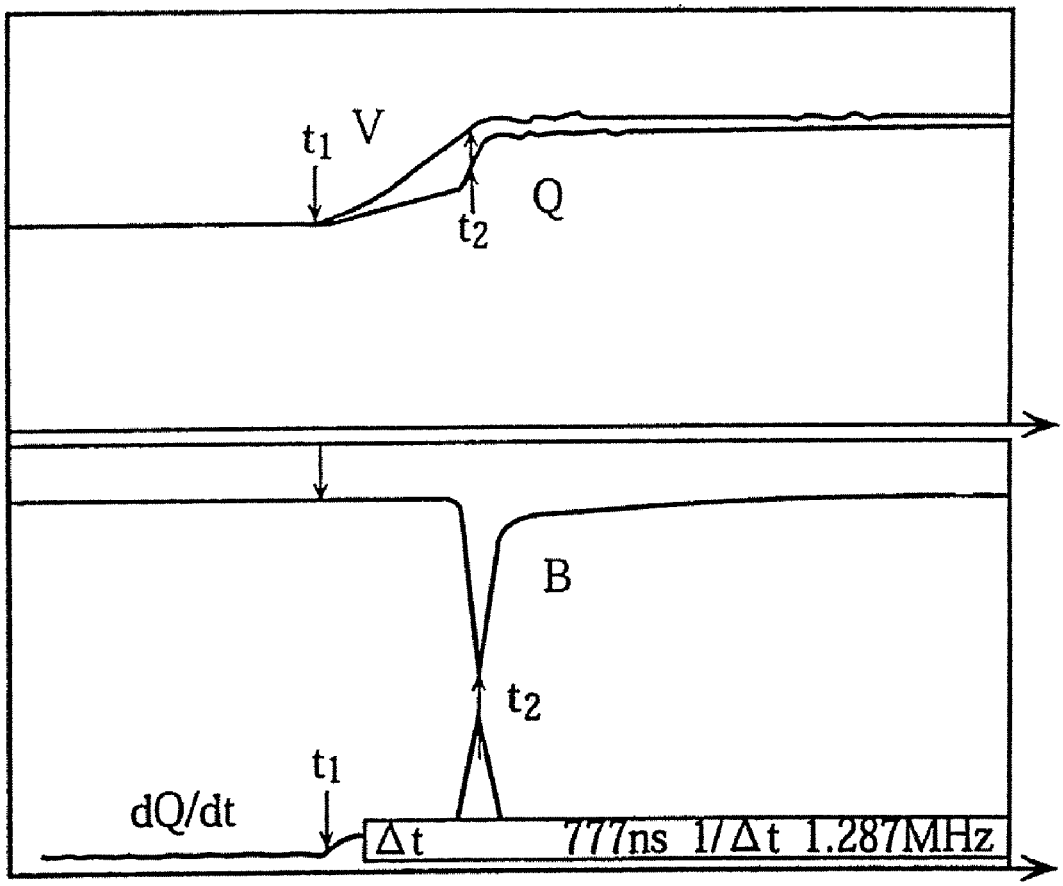
FIG. 37 shows the results of measurements made in experiment 9A.
Figure 38:
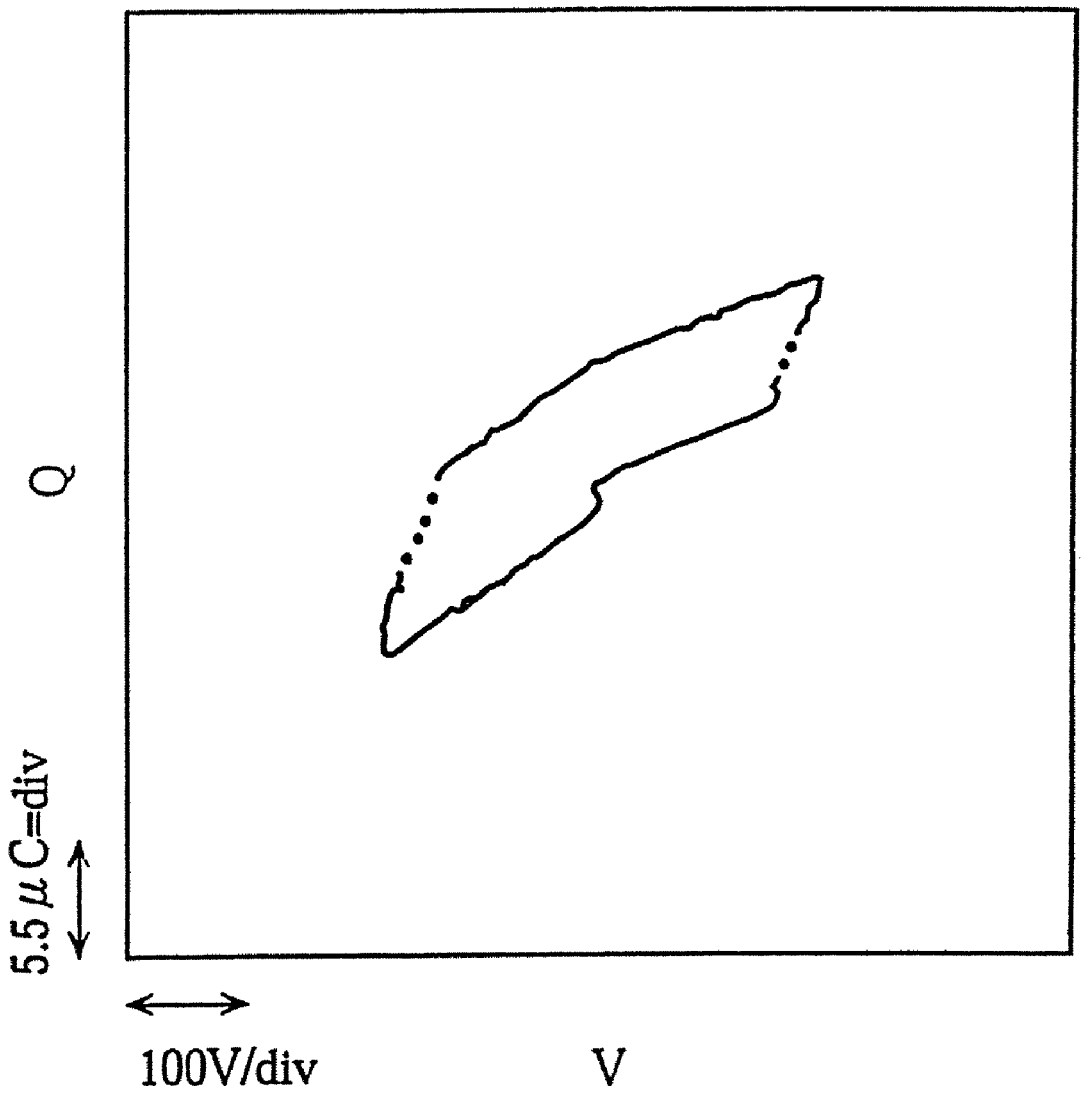
FIG. 38 is an example of a V-Q Lissajous's figure showing the results of measurements made in experiment 9A.

FIGS. 37 and 38 show the results of these measurements. In FIG. 37, the electrode voltage V and the wall voltage Q, and the variation in wall voltage amount ΔQ and brightness B are plotted along a time axis. FIG. 38 is an example of a V-Q Lissajous□s figure.

From FIG. 37 it can be seen that in the vicinity of the point showing the peak discharge current (the point shown by $t_2$ in the drawing, which is also the point showing the peak brightness) the voltage V is higher than the point at which the discharge current starts to flow ($t_1$ in the drawing).

The V-Q Lissajous□s figure of FIG. 38 is a thin flattened lozenge shape. This V-Q Lissajous□s figure is formed with slanting left and right ends due to the fact the starting voltage is lower that the ending voltage.

This shows that using a rising slope waveform for the sustain pulses rather than a simple rectangular wave makes the loop area smaller, even though the wall charge transfer amount in the discharge cells remains the same. In other words, the power consumption is smaller although the amount of light emitted is the same.

Experiment 9B

The PDP 10 was driven by the same method as in the experiment of the seventh embodiment, using either a simple rectangular wave or a rising slope waveform like the one in the present embodiment for the sustain pulses. The luminance and power consumption were measured in each case, and a relative luminous efficiency η calculated from the relative luminance and the relative power consumption. Table Six shows values for the relative luminance and relative power consumption and the relative luminous efficiency η.

TABLE SIX

| | RELATIVE BRIGHTNESS | RELATIVE POWER CONSUMPTION | RELATIVE EFFICIENCY |
|---|---|---|---|
| RECTANGULAR WAVE | 1.00 | 1.00 | 1.00 |
| WAVEFORM OF NINTH EMBODIMENT | 0.93 | 0.87 | 1.07 |

From these results, it can be seen that using the rising slope pulse of the present embodiment for the sustain pulses rather than a simple rectangular pulse causes luminance to be reduced by 7% and power consumption by 13%, so that luminous efficiency increases by around 7%.

Tenth Embodiment

Figure 39:
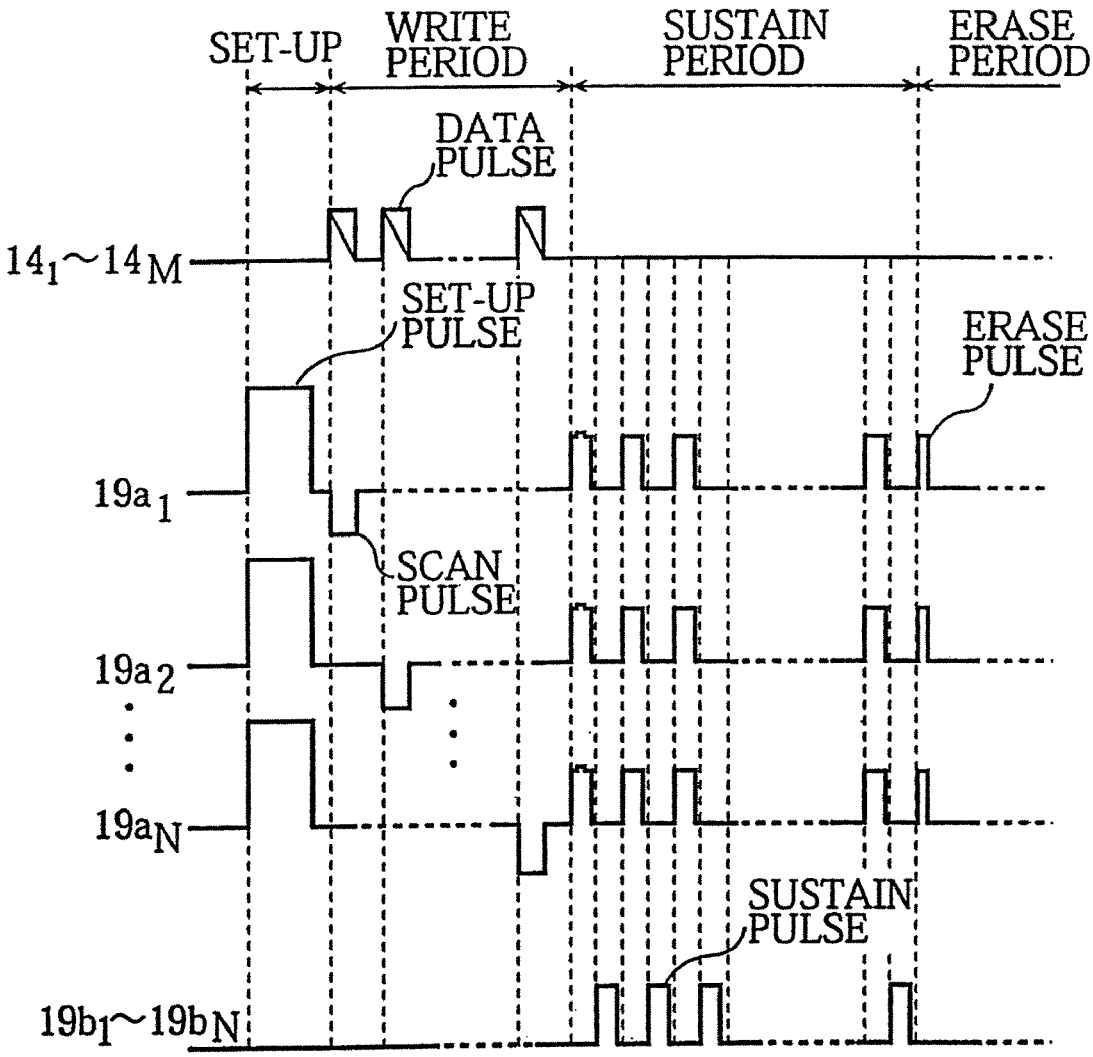
FIG. 39 is a time chart showing the PDP driving method relating to the tenth embodiment.

FIG. 39 is a time chart showing a PDP driving method relating to the present embodiment.

In the present embodiment, a first sustain pulse applied in the discharge sustain period uses a waveform that has been altered to a two-step rising and falling one, but from the second sustain pulse onward uses the same simple rectangular wave as in the related art.

To enable only the first sustain pulses to have a two-step rising and falling waveform, the pulse adding circuit explained in the first embodiment is used as the sustain pulse generator 112*b* shown in FIG. 5. However, a switch is provided to turn the operation of the second pulse generator ON and OFF. The second pulse generator is switched ON only when the first sustain pulses are applied.

When the first sustain pulses are applied, a first pulse generated by the first pulse generator and a second pulse generated by the second pulse generator are added to generate a two-step rising and falling staircase waveform, as shown in FIG. 26 relating to the seventh embodiment. On the other hand, when the second and subsequent sustain pulses are generated, only the first pulse is generated by the first pulse generator.

When a simple rectangular pulse like the one in the related art is used for the sustain pulses, the discharge generated by the first sustain pulses applied during the discharge sustain period is unstable (low discharge probability) and the light emitted is a comparatively small amount. This is one reason for deterioration in image quality caused by screen flicker.

The following may be given as reasons for the comparatively low discharge probability generated by the first sustain pulses.

Generally, there is a time delay (the discharge delay) from when a pulse is applied to when the discharge current is generated. The discharge delay has a strong correlation with the applied voltage. It is widely recognized in the art that higher voltage reduces the discharge delay, and causes the distribution of the discharge delay to be narrowed. The problem of a long discharge delay causing unstable discharge is also applicable to the sustain pulse.

However, a voltage $V_{gas}$ applied to the discharge gas within the discharge cells is dependent on a drive voltage supplied from a power source outside of the discharge cells and the wall voltage accumulated on the dielectric layer covering the electrodes. In other words the discharge delay is heavily influenced by the wall voltage.

Therefore, flicker caused by the wall charge accumulated as a result of the prior write discharge makes discharge delay and unstable discharge generation for the first sustain pulses more likely.

However, if a two-step rising and falling waveform is used for the first sustain pulses, as in the present embodiment, rather than using a simple rectangular wave, the discharge delay is decreased. Thus, the discharge probability when the first sustain pulses are applied is increased, reducing screen flicker.

Similar stability may be achieved during discharge by using a simple rectangular wave for the first sustain pulses if a wide pulse is used. However, using a added two-step staircase waveform for the pulses, as in the present embodiment, enables narrow pulses to be used, so that driving can be performed at high speed.

When a two-step rising and falling staircase waveform is used for the first sustain pulses in this way, obtaining an increase in discharge probability should preferably be ensured in the following way. The first-step rise should be raised to the vicinity of a minimum discharge sustain voltage $V_s$. After the second step rise is raised to the peak voltage level, the waveform starts to fall rapidly from near to the discharge end point. The voltage for the first step fall should then be reduced to the vicinity of the minimum discharge sustain voltage $V_s$.

The period from the second-step rise to the first-step fall, in other words the maximum voltage sustain period Pwmax, should preferably be set at no less than 0.2 μs and at no more than 90% of the pulse width PW.

Furthermore, the maximum voltage sustain period for the first sustain pulses $PW_{max1}$ should be set at not less than 0.1 μs longer than the maximum voltage sustain period for the second and subsequent pulses $PW_{max2}$. At this setting, the discharge probability for the first sustain pulses increases sharply and a satisfactory image can be obtained without flicker.

Experiment 10A

The PDP was driven using the simple rectangular wave of the related art and the staircase waveform of the present embodiment for the first sustain pulses and the voltage $V_{SCN-SUS}$ occurring between the electrodes (scan and sustain electrodes) in the discharge cells and the luminous efficiency B of the PDP were measured in each case.

The sustain pulses were generated by a given waveform generator and their voltage amplified by a high-speed high-voltage amplifier before being applied to the PDP. The voltage waveforms and brightness waveforms were measured by a digital oscilloscope.

Figure 40A:
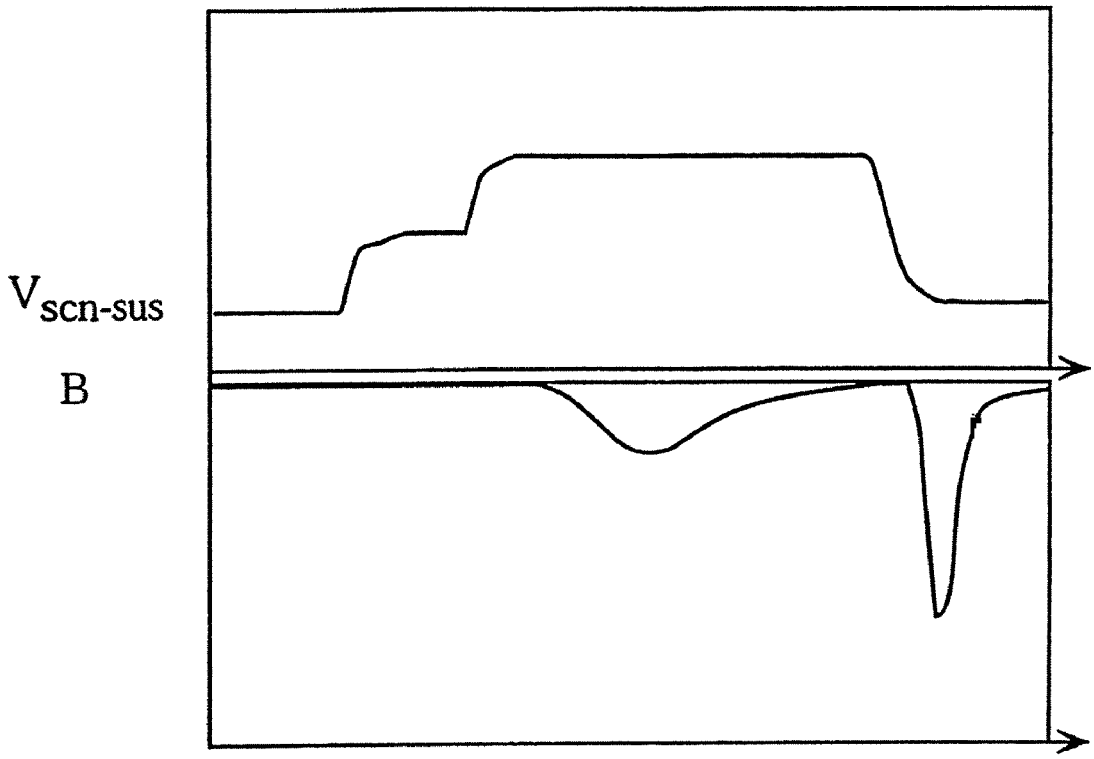
FIG. 40 shows the results of measurements made in experiment 10A.
Figure 40B:
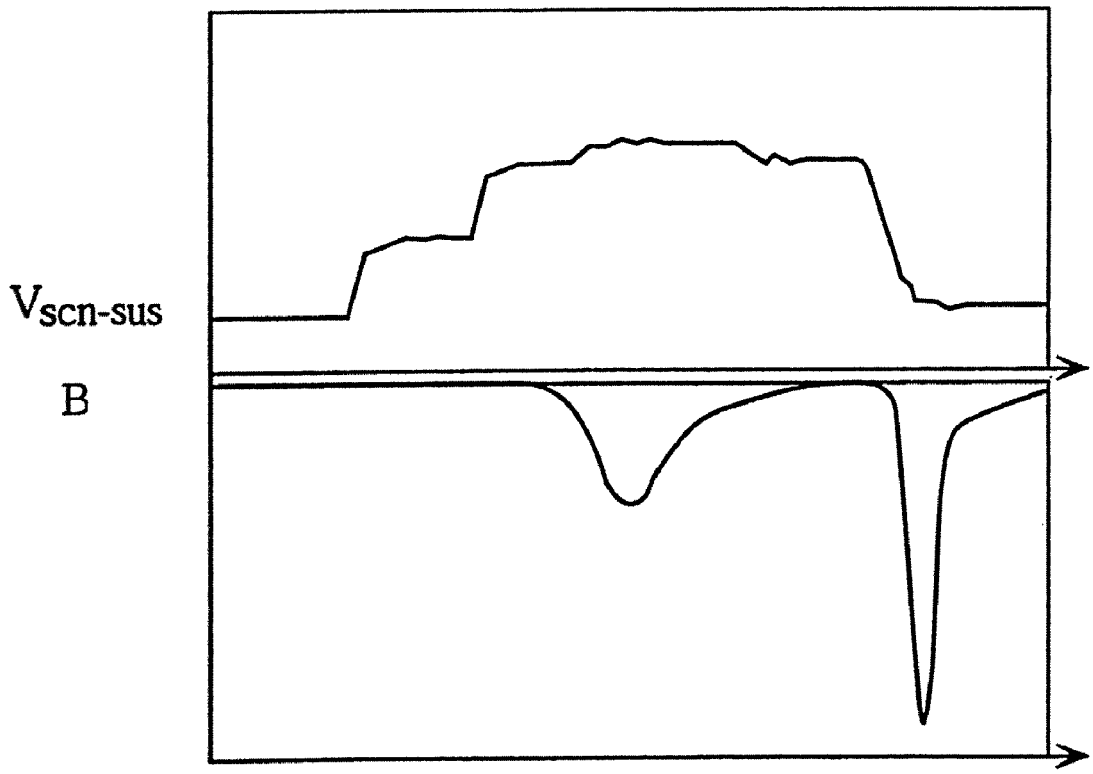

FIG. 40 shows the results of these measurements, A when a rectangular wave was used for the first sustain pulses and B when a staircase waveform was used for the first sustain pulses. In both graphs the electrode voltage $V_{SCN-SUS}$ and the brightness B are plotted along a time axis.

In FIG. 40, the period between the pulse rise start point and the light emission peak, in other words the discharge delay time, is lower in B than in A. Additionally, it can be seen that the light emission caused by discharge is stronger in B than in A.

Experiment 10B

The PDP 10 was driven using a simple rectangular wave with a maximum voltage $V_p$ of 180V and a two-step rising and falling staircase waveform with a maximum voltage of 230V for the first sustain pulses. The voltage waveform and the brightness waveform in each case were measured and an average discharge delay time calculated. Luminance and screen flicker were also measured. These results are shown in Table Seven.

TABLE SEVEN

| | MAX. VOLTAGE $V_p$ [V] | AVERAGE DISCHARGE DELAY TIME [μs] | RELATIVE BRIGHTNESS | FLICKER |
|---|---|---|---|---|
| RECTANGULAR WAVE | 180 | 1.86 | 1.00 | YES |
| WAVEFORM OF TENTH EMBODIMENT | 230 | 0.81 | 1.11 | NO |

From the results, it can be seen that using a two-step staircase waveform for the first sustain pulses reduces the discharge delay time and screen flicker.

The PDP driving method of the present embodiment thus enables a PDP with superior high-resolution images to be realized.

Eleventh Embodiment

Figure 41:
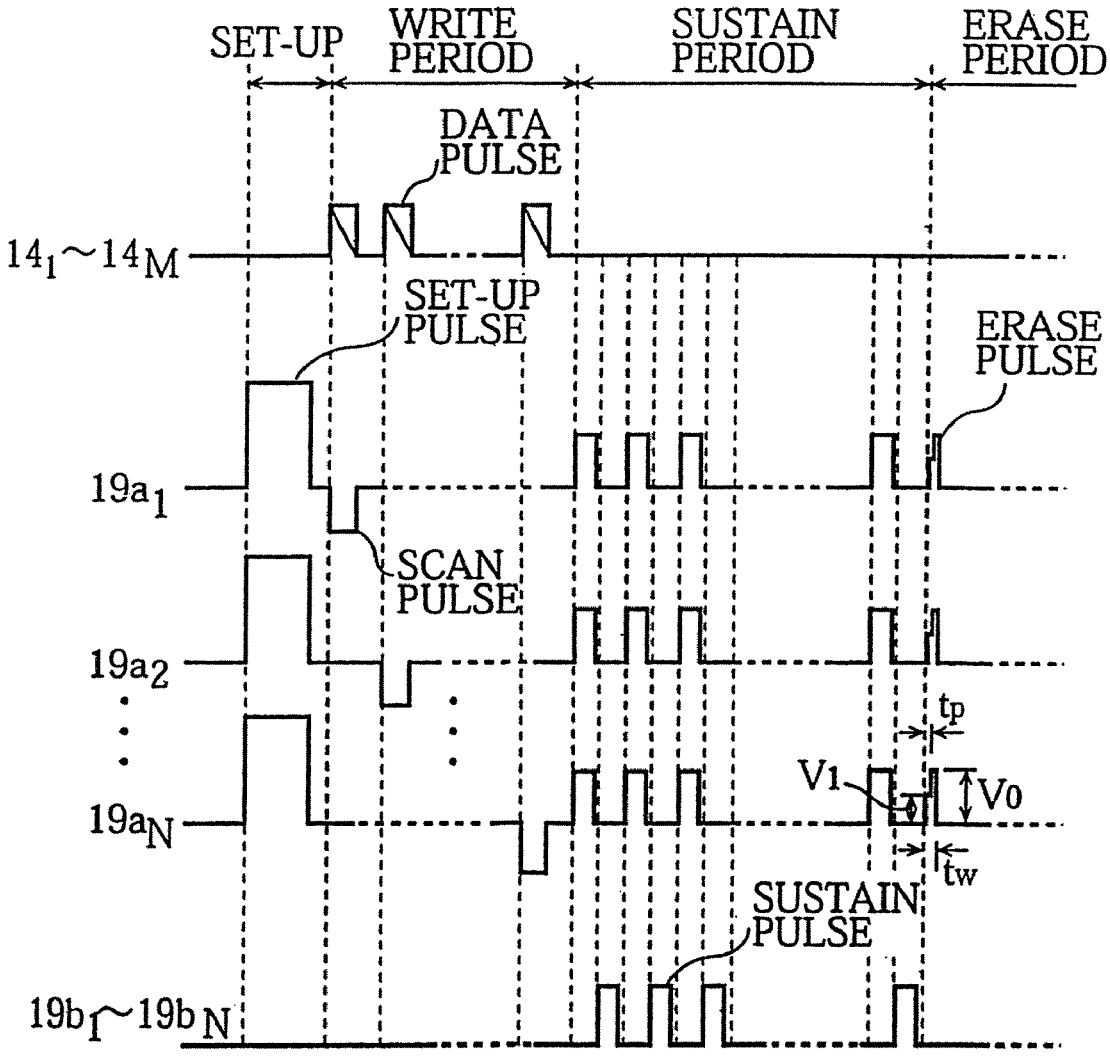
FIG. 41 is a time chart showing the PDP driving method relating to the eleventh embodiment.

FIG. 41 is a time chart showing a PDP driving method relating to the present embodiment.

The present embodiment uses a two-step rising staircase waveform for the erase pulses.

To apply a two-step rising waveform like this one for the erase pulses, a pulse adding circuit like the one explained in the first embodiment may be used as the erase pulse generator 113 in FIG. 6.

When a simple rectangular pulse like the one in the related art is used, there is a tendency for a strong discharge to be generated following the sudden change in voltage at the voltage rise time. This strong discharge produces a comparatively strong light emission over the whole screen, causing contrast to drop.

When this kind of strong discharge is generated, the wall charge amount remaining in the discharge cells after the erase pulse has been applied makes flicker more likely and causes faulty discharge to be generated in the next drive sequence.

However, using a two-step rising waveform for the erase pulses allows the applied voltage to be raised while avoiding much of the sudden change in voltage, enabling light emission to be restricted and the wall charge to be uniformly erased.

In the present embodiment, a driver IC with a low ability to withstand voltage is used as the first and second pulse generators in the pulse adding circuit to generate erase pulses by adding first and second pulses together. This enables driving to be performed at high speed.

An example of a technique using a rising staircase waveform as an erase pulse is disclosed in the paragraph "Two-Step Writing/Erasing" of *Low Voltage Selection Circuits for Plasma Display Panel* (T. N. Criscimagna, 1978 SID International Symposium Digest). However, the erase pulse should preferably be set as described in order to achieve the above-mentioned effect.

If the voltage $V_1$ in the first-step rise of this kind of two-step rising staircase waveform is too small relative to the peak voltage $V_e$, a comparatively large amount of light will be emitted in the second-step rise, so that most of the improvements in contrast will be lost. Thus, the ratio of $V_1$ to $V_e$ should preferably be set at no less than 0.05 to 0.2 and the ratio of $(V_e-V_1)$ to $V_e$ at no more than 0.8 to 0.95.

Additionally, if the period from the completion of the first step to the start of the second step in the rising period, in other words the level part of the first step $t_p$, is too wide relative to the pulse width $t_p$ it will have a detrimental effect. Therefore, the ratio of $t_p$ to $t_w$ should be set at 0.8 or less.

To realize more improved image quality the voltage $V_1$ in the first step of the rising period should preferably be set within the range of $V_f$−50V to $V_f$+30V and the maximum peak voltage $V_e$ within the range $V_f$ to $V_f$+100V. Here, $V_f$ is the starting voltage.

Experiment 11

The PDP was driven using two-step rising staircase waveform for the erase pulses. When driving was performed, the peak voltage $V_e$ and the pulse width $t_w$ were set at fixed values, but the ratio of the flat part of the first step in the rising period $t_p$ to the pulse width $t_w$ and the ratio of the voltage for the second step $(V_e-V_1)$ to the peak voltage $V_e$ were set at various values, and contrast measured in the same way as in the experiment in the first embodiment.

Figure 42:
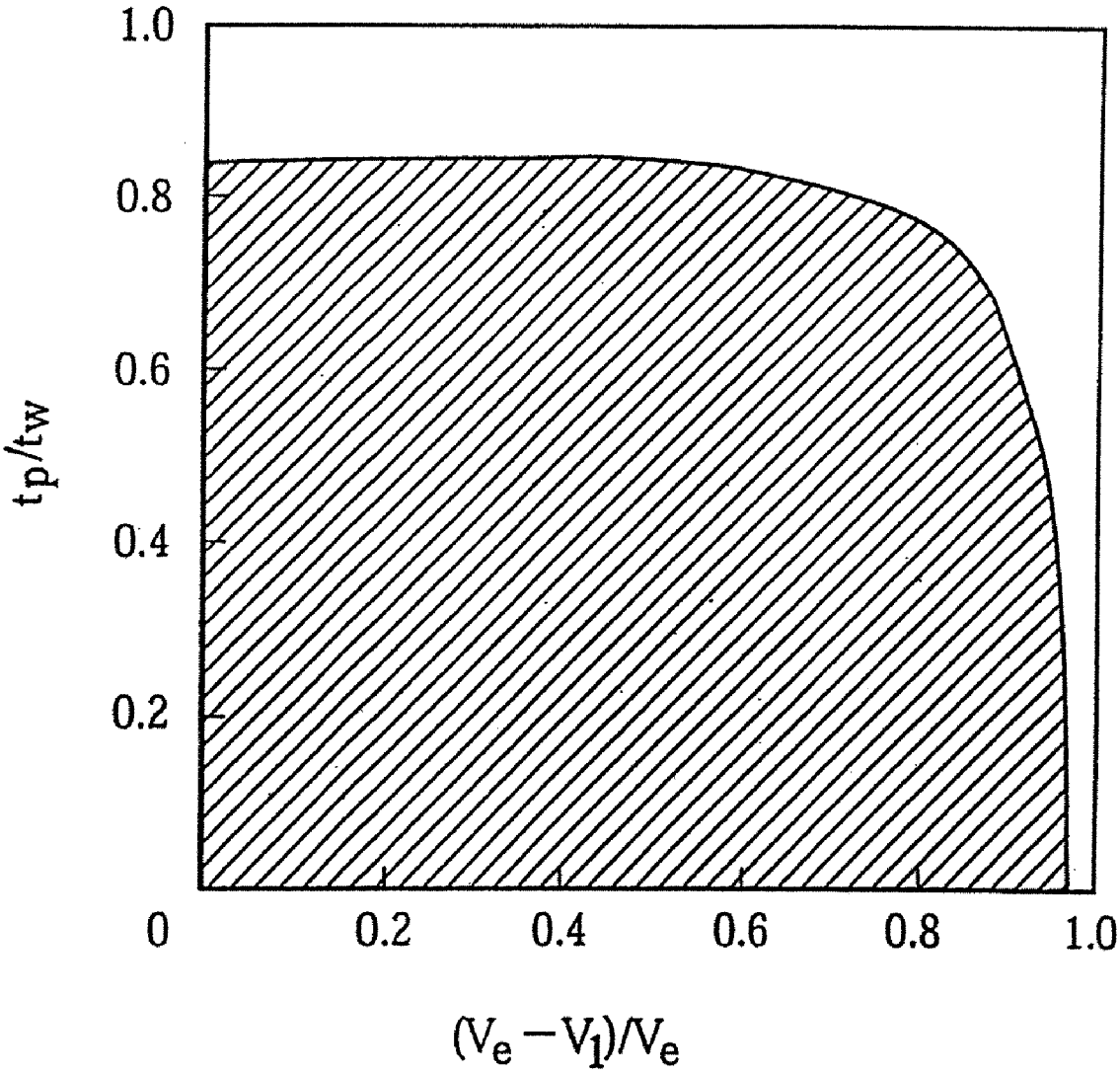
FIG. 42 shows the results measured by experiment 11.

FIG. 42 shows the results of these measurements. The drawing shows the relation between the ratios $t_p$ to $t_w$ and $(V_e-V_1)$ to $V_e$ and contrast for when a two-step rising waveform is used for the erase pulses.

In the drawing, the shaded area shows the range of acceptable results, in which contrast is high and luminance variations resulting from write defects uncommon. The area outside the shaded area shows unacceptable results.

From the drawing it can be seen that the ratio $t_p$ to $t_w$ should preferably be set at 0.8 or less and the ratio $(V_e-V_1)$ to $V_e$ at 0.8 to 0.95 or less. However, if the ratios $t_p$ to $t_w$ and $(V_e-V_1)$ to $V_e$ are set at too low a value, effects can not be obtained, so the ratios should preferably be set higher than 0.05.

The present embodiment used a two-step rising staircase waveform for the erase pulses, but a multi-step staircase waveform having three or more steps may be used to realize the same superior image quality.

Twelfth Embodiment

Figure 43:
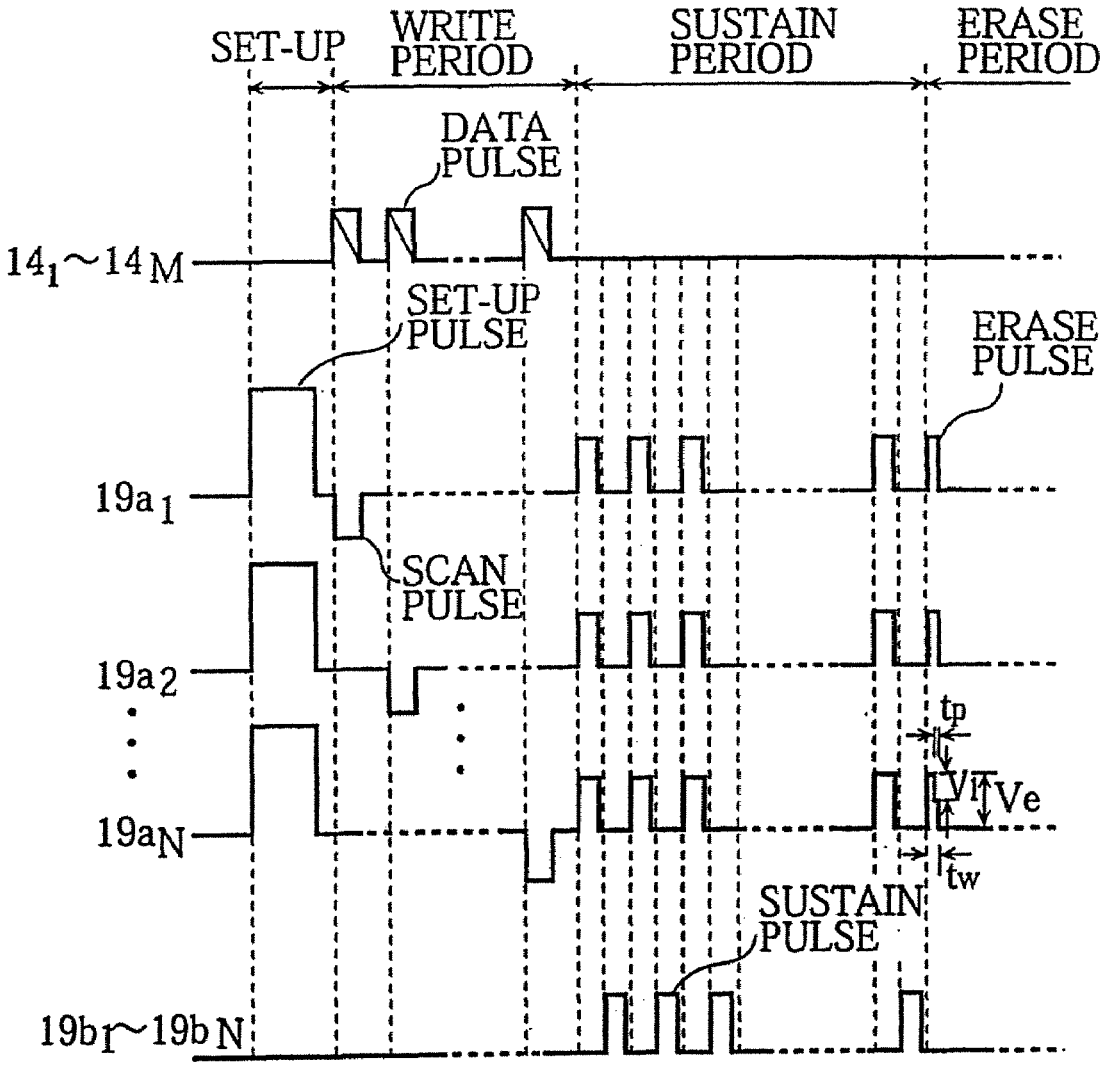
FIG. 43 is a time chart showing a PDP driving method relating to the twelfth embodiment.

FIG. 43 is a time chart showing a PDP driving method relating to the present embodiment.

The present embodiment uses a two-step falling waveform for the erase pulses.

The pulse adding unit described in the second embodiment should preferably be used as the erase pulse generator 113 in FIG. 6 to apply this kind of two-step falling waveform for the erase pulses.

When a simple rectangular wave like the one in the related art is used for the erase pulses, the existence of a discharge delay time for the erase discharge means that setting too narrow a pulse causes faulty erasing and a drop in image quality.

Using a two-step falling waveform like the one in the present embodiment rather than a simple rectangular wave as the erase pulses enables accurate erasing to be performed even if narrow erase pulses are set.

Reducing the width of the erase pulses enables the erase period to be reduced. This allows the write period and the sustain period to be lengthened accordingly, obtaining high luminance and high image quality.

Additionally, driver ICs with a low ability to withstand voltage are used as the first and second pulse generators in the pulse adding circuit to generated the erase pulses by adding first and second pulses. This enables driving to be performed at high speed.

When a two-step falling staircase waveform is used for the erase pulses in this way, erasing is performed accurately and the pulse width is set as short as possible. As a result the period Pwer from the rise time to the completion of the maximum voltage sustain period should be set at between $T_{df}$−0.1 μs and $T_{df}$+0.1 μs. Here, $T_{df}$ is the discharge delay time.

When this kind of two-step falling erase pulse is used, the maximum voltage Vmax should be set in the range of $V_f$ to V+100V in order to achieve the most satisfactory image quality.

Experiment 12

The PDP 10 was driven using a simple rectangular wave with a maximum voltage $V_p$ of 180V, and a pulse width of 1.50 μs, and a two-step falling staircase waveform with a maximum voltage of 200V and a pulse width of 0.77 μs as the erase pulses. Voltage waveforms and brightness waveforms were measured in each case and the average discharge delay time for the erase period measured. The condition of the screen was observed to judge whether the erase operation had been successful or not.

TABLE EIGHT

| | MAX. VOLTAGE $V_p$ [V] | AVERAGE DISCHARGE DELAY TIME [μs] | PULSE WIDTH [μs] | ERASING OPERATION |
|---|---|---|---|---|
| RECTANGULAR WAVE | 180 | 1.86 | 1.50 | SATISFACTORY |
| WAVEFORM OF TWELFTH EMBODIMENT | 200 | 0.77 | 0.75 | SATISFACTORY |

Table Eight shows the results of these measurements, revealing that the erase operation was satisfactory in both cases.

However, it can be seen that using a staircase waveform rather than a simple rectangular wave as the erase pulses greatly reduces the discharge delay time and driving the PDP using the method of the present embodiment enables satisfactory performance to be achieved even when using a narrow pulse.

In the present embodiment, a two-step falling staircase waveform was used for the erase pulses, but the same effects can be achieved by using a multi-step falling staircase waveform with three steps or more.

Thirteenth Embodiment

The PDP used in this embodiment has the same basic structure as the PDP 10 in FIG. 1, but a mixture of the four gases helium, neon, xenon and argon is used instead of a mixture of neon and xenon or helium and xenon as the enclosed discharge gas, and the pressure in the enclosed space is set at 800 to 4000 torr, a pressure higher than atmospheric pressure.

Figure 44:
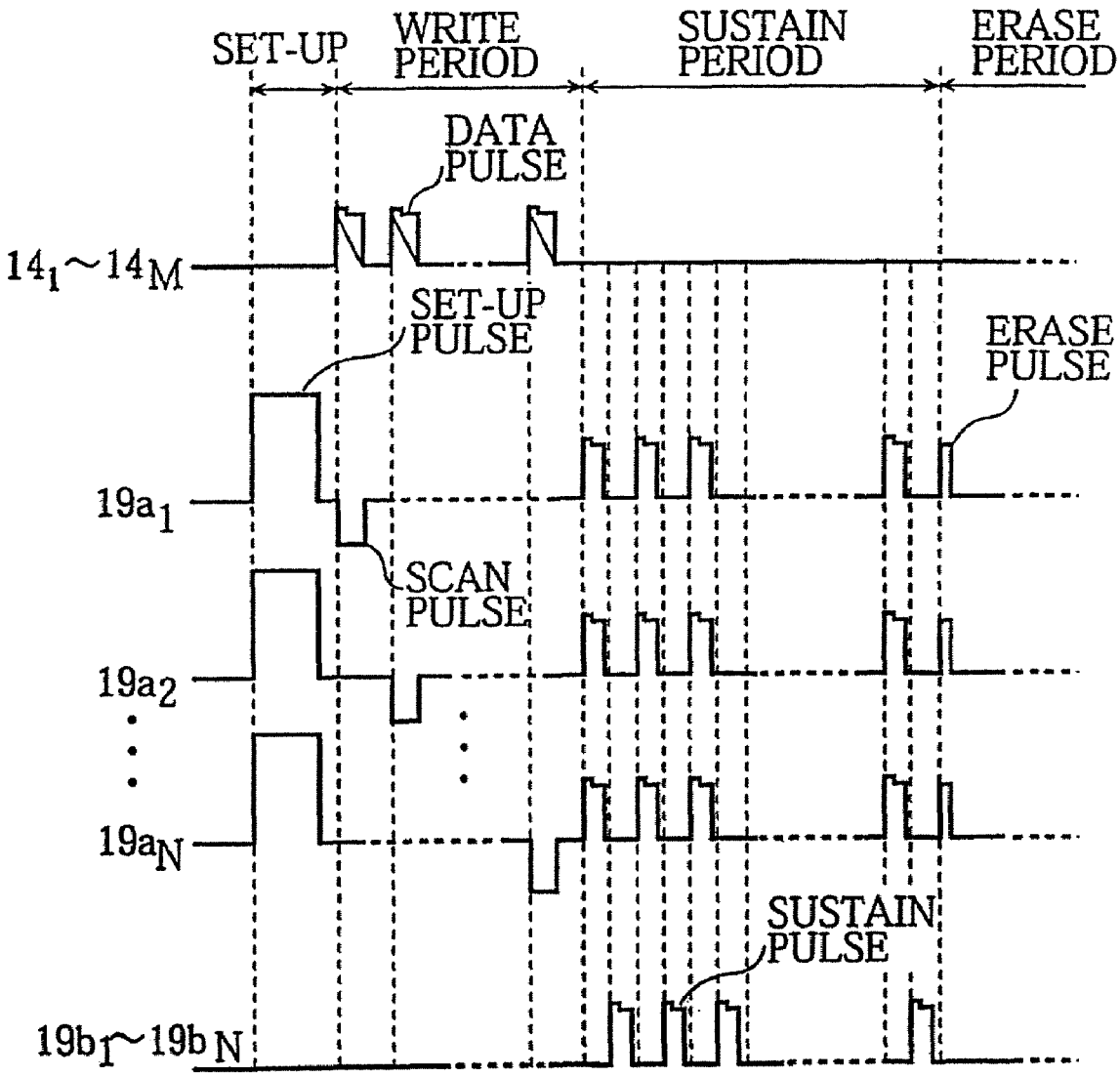
FIG. 44 is a time chart showing a PDP driving method relating to the thirteenth embodiment.

FIG. 44 is a time chart showing a PDP driving method relating to the present embodiment.

As shown in the drawing, in the present embodiment driving is performed using two-step falling staircase waveforms for both the data pulses applied in the write period and the sustain pulses applied in the discharge sustain period. In other words, the present embodiment uses a two-step falling waveform as a data pulse, as in the fourth embodiment and a two-step falling waveform as a sustain pulse, as in the sixth embodiment.

The present embodiment combines structural features with features of the waveforms applied when driving the PDP, as explained below, to improve luminance and luminous efficiency while restricting increases in discharge voltage and display images of a satisfactory quality.

When encasing the gas medium in the PDP the pressure used is normally less than 500 torr. This means that the ultraviolet light generated following discharge is mainly resonance lines with a center wavelength of 147 nm. If, however, the pressure in the enclosed space is high (a large number of atoms are enclosed in the discharge space), as above, the proportion of excimer radiation with a center wavelength of 154 nm or 172 nm is larger. Resonance lines have a tendency towards self-absorption, while molecule beams have little or no self-absorption, meaning that the amount of ultraviolet light reflected by the phosphor layer is greater in this case, improving luminance and luminous efficiency. The efficiency of the conversion from ultraviolet to visible light by a normal phosphor layer is greater the longer the wavelength, so this is another reason why the present embodiment improves luminance and luminous efficiency.

In a conventional PDP, the discharge has a first glow phase, but if a high pressure setting of 800 to 4 000 torr is used for in the present invention, a filament glow phase or a second glow phase can be more easily produced. This causes the density of electrons in the positive column to increase, supplying concentrated energy, and increasing the amount of ultraviolet light emitted.

The enclosed gas medium is a mixture of the four gases mentioned above, having a comparatively small amount of Xenon, which enables high luminance and luminous efficiency to be obtained while preserving a low discharge voltage.

If a high pressure is set in the enclosed space of a PDP structure where scan electrodes and data electrodes are placed opposing each other so that discharge spaces are sandwiched between them, as shown in FIG. 1, there is a tendency for write defects to be generated. This is most likely because a high pressure in the enclosed space increases the starting voltage. When a simple rectangular wave was used for the set-up pulse and the write pulse, as in the related art, however, even when the applied discharge for the write pulse was set at a high level a discharge delay was produced. As a result, write defects are difficult to avoid.

However, a two-step falling staircase waveform is used for the data pulses in the present embodiment, reducing the discharge delay, and enabling the write discharge to be completed within the period in which the data pulse is being applied. As a result, the wall charge amount produced by the write discharge increases and write defects are reduced. This staircase waveform is generated by adding two pulses together, meaning that driver ICs with a low ability to withstand voltage can be used as the pulse generators. As a result, driving can be performed at high speed.

In the present embodiment a two-step falling staircase waveform is also used for the sustain pulses, so that a high sustain pulse voltage is set, increasing luminance and maintaining stable operations. This enables superior image-quality without flicker and the like to be realized.

Experiment 13A

PDPs with a electrode distance of 40 μm and having discharge gases composed of the following combinations of gas were produced: helium 50%, neon 48%, xenon 2%; helium 50%, neon 48%, xenon 2%, argon 0.1%; helium 30%, neon 68%, xenon 2%; helium 30%, neon 67.9%, xenon 2%, argon 0.1%. The relation between Pd area and starting voltage $V_f$ was examined for each of the PDPs.

Figure 45:
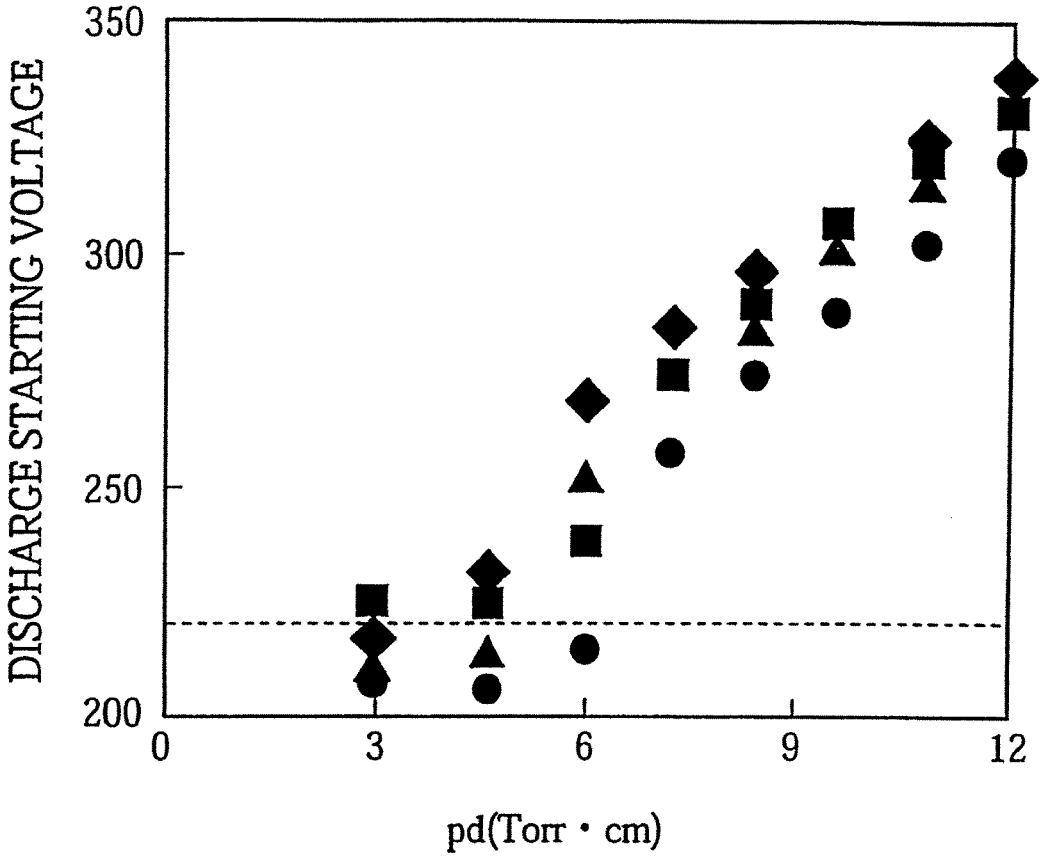
FIG. 45 is a graph showing the results of experiment 13A.

The graph in FIG. 45 shows these results. Beneath the graph is a table showing the luminance (discharge voltage is 250V) for PDPs using different kinds of gas.

From the drawing, it can be seen that increases in pressure in the enclosed space cause increases in the starting voltage, but if a mixture of the four gases described above is used for the discharge gas the starting voltage can be restricted to a comparatively low level.

In particular, if the mixture of helium 30%, neon 67.9%, xenon 2%, argon 0.1% is used luminance is comparatively good and the starting voltage can be kept within the effective starting voltage area (less than 220V) even if the Pd area is kept beneath 6 (torr×cm), meaning that the electrode distance d is 60 μm and the pressure in the enclosed space 1 000 torr.

The minimum starting voltage for this gas combination is in the vicinity of Pd=4, so it would be preferable to set the Pd at 4, (for example: pressure of enclosed space 2 000 torr and electrode distance d of 20 μm).

The absolute values, particularly for the starting voltage, vary according to the amount of xenon used, but the relative relationship between them hardly changes at all.

Experiment 13B

PDPs each with barrier ribs having a height of 60 μm and the above mixture of four gases enclosed at a pressure of 2000 torr were driven by a driving method using the simple rectangular wave of the related art shown in FIG. 4 and by a driving method using the staircase waveform of the present invention shown in FIG. 44. Actual image display was performed and relative luminance, luminous efficiency η and image quality (flicker) evaluated.

Table Nine shows these results.

TABLE NINE

| | RELATIVE BRIGHTNESS B | RELATIVE POWER CONSUMPTION W | RELATIVE EFFICIENCY n | QUALITY OF DISPLAY IMAGE |
|---|---|---|---|---|
| RECTANGULAR WAVE | 1.00 | 1.00 | 1.00 | LARGE AMOUNT OF FLICKER |
| WAVEFORM OF THIRTEENTH EMBODIMENT | 1.31 | 0.72 | 1.82 | SATISFACTORY |

From these results it can be seen that relative luminance, power consumption, relative efficiency and display quality are superior when the driving method of the present embodiment is used rather than the driving method using a simple rectangular wave.

This illustrates that the combination of panel structure and driving method stipulated by the present embodiment enables high luminance, high efficiency and satisfactory image quality to be obtained even if the pressure in the enclosed space of the PDP is high.

The driving method of the present embodiment was applied to a PDP in which a mixture of four gases was enclosed at a pressure of 2 000 torr, as in the present embodiment, and a PDP with a mixture of neon (95%) and xenon (5%) enclosed at a pressure of 500 torr. The luminous efficiency η in each case was compared and the efficiency of the former PDP was found to be about one and a half times greater than the latter. This confirms that the combination of driving method and discharge gas composition and pressure stipulated by the present embodiment is a valid one.

In the present embodiment, both the data pulses and the sustain pulses have two-step falling waveforms, but as an alternative example the same effect may be achieved if one or the other or both of the data pulses and sustain pulses has two-step rising waveforms.

Furthermore, even if two-step rising or falling waveforms are used only for the data pulses and simple rectangular waves are used for the sustain pulses, almost the same effects can be achieved as in the present embodiment although with a lower degree of efficiency.

Fourteenth Embodiment

Figure 46:
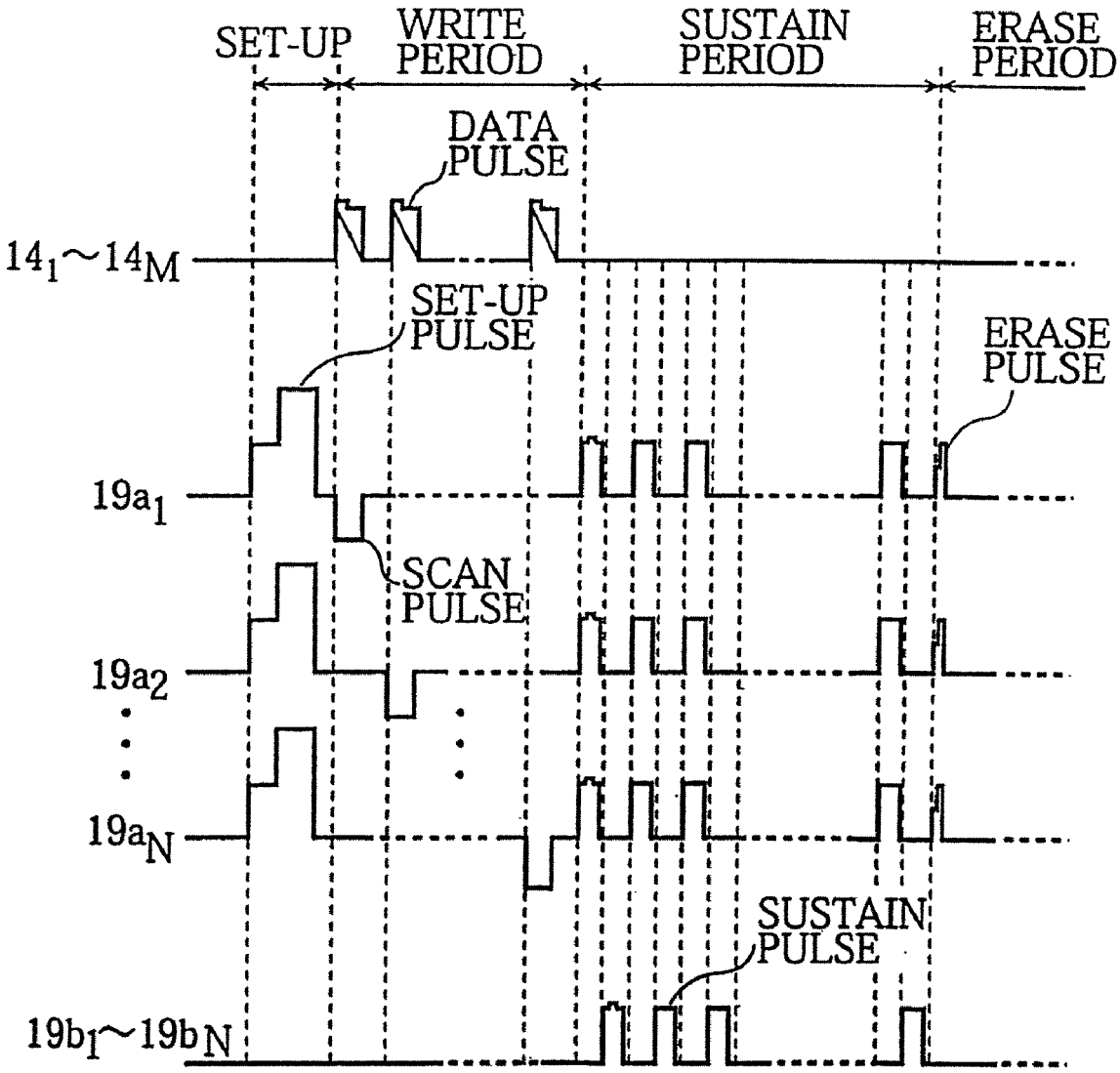
FIG. 46 is a time chart showing a PDP driving method relating to the fourteenth embodiment.

FIG. 46 is a time chart showing a PDP driving method relating to the present embodiment.

The present embodiment uses staircase waveforms for the set-up pulses, write pulses, the first sustain pulses and the erase pulses.

In the present embodiment, as shown in FIG. 46, a two-step rising staircase waveform is used for the set-up pulses, as in the first embodiment, a two-step falling staircase waveform is used for the data pulses as in the fourth embodiment, a two-step rising and falling staircase waveform is used for the first sustain pulses as in the tenth embodiment and a two-step rising staircase waveform is used for the erase pulses as in the eleventh embodiment.

By applying voltage to the combinations of waveforms in each period, contrast can be improved and flickering caused by discharge delay restricted as explained below.

Using staircase waveforms for the set-up and erase pulses enables contrast to be improved during the set-up and erase discharges, but also has a tendency to increase the size of the discharge delay $Td_{add}$ in the write discharge and the discharge delay $Td_{sus1}$ in the first sustain discharge. The reason for this is that using a staircase waveform for the set-up and erase pulses causes discharge to become weaker, decreasing the amount of transfer charge and hence the amount of wall transfer charge occurring in the set-up period.

In the present embodiment, however, the operation for reducing the discharge delay $Td_{add}$ by using a staircase waveform for the data pulses and the operation for reducing the discharge delay $Td_{sus1}$ by using a staircase waveform for the first sustain pulses prevents discharge delay and so flicker is not generated.

In a driving method like the one in the present embodiment extremely high contrast can be obtained and satisfactory image quality achieved even if high speed driving using write pulses with a width of 1.25 μs is performed.

Experiment 14A

PDP 10 was driven with simple rectangular waves used for both the write and sustain pulses, and both simple rectangular waves and two-step rising and falling waveforms used for the set-up and erase pulses. An average discharge delay time $Td_{add}$ (μs) occurring at the write discharge, an average discharge delay time $Td_{sus1}$ (μs) occurring at the first sustain discharge, the contrast ratio and a discharge efficiency P (%) for the first sustain discharge were measured.

The discharge efficiency P was measured by performing the operation from writing to the sustain discharge 10 000 times and counting how many times light was emitted in the first sustain discharge.

Judgement of light emission was performed by using an avalanche photo diode (APD) to observe the light emission during discharge on a digital oscilloscope.

Experiment 14B

The PDP 10 was driven using a staircase waveform for both the set-up and erase pulses and a simple rectangular wave for all of the sustain pulses, with a simple rectangular wave and a two-step rising and falling staircase waveform variously used for the write pulses. The average discharge delay time $Td_{add}$ (μs) occurring at the write discharge, the average discharge delay time $Td_{sus1}$ (μs) occurring at the first sustain discharge, the contrast ratio and the discharge efficiency P (%) for the first sustain discharge were measured.

Experiment 14C

The PDP 10 was driven using a staircase waveform for the set-up, erase and write pulses, with a simple rectangular wave and a two-step rising and falling staircase waveform variously used for the first sustain pulses. The average discharge delay time $Td_{add}$ (μs) occurring at the write discharge, the average discharge delay time $Td_{sus1}$ (μs) occurring at the first sustain discharge, the contrast ratio and the discharge efficiency P (%) for the first sustain discharge were measured. Table Ten shows the results of Experiments 14A, 14B and 14C.

TABLE TEN

| | 14A RECTANGULAR WRITE AND SUSTAIN PULSES SET-UP/ERASE PULSE | | 14B STAIRCASE SET-UP AND ERASE PULSES RECTANGULAR SUSTAINE PLUSES WRITE PULSE | | 14C STAIRCASE SET-UP, ERASE AND WRITE PULSES FIRST SUSTAIN PULSE | |
|---|---|---|---|---|---|---|
| | RECTANGULAR WAVE | STAIRCASE WAVEFORM | RECTANGULAR WAVE | STAIRCASE WAVEFORM | RECTANGULAR WAVE | STAIRCASE WAVEFORM |
| Tdadd [μsec] | 1.86 | 2.17 | 2.17 | 1.45 | 1.45 | 0.71 |
| Tdsusl [μsec] | 1.86 | 2.42 | 2.42 | 1.76 | 1.76 | 0.79 |
| | 150:1 | 400:1 | 400:1 | 400:1 | 400:1 | 400:1 |
| P [%] | 95.0 | 78.0 | 78.0 | 90.0 | 90.0 | 99.9 |

From the results for Experiment 14A it can be seen that using a staircase waveform rather than a simple rectangular wave for the set-up and erase pulses greatly improves contrast. At the same time, however, the average discharge delay time $Td_{add}$ occurring at the write discharge, and the average discharge delay time $Td_{sus1}$ occurring at the first sustain discharge become bigger and the discharge efficiency P is reduced.

From this and from the results of the Experiment 14B it can be seen that using a staircase waveform rather than a simple rectangular wave for the write pulses as well as for the set-up and erase pulses keeps the contrast at an improved level and restricts the increase in the average discharge delay time $Td_{add}$ occurring at the write discharge, and the average discharge delay time $Td_{sus1}$ occurring at the first sustain discharge, as well as restricting the fall in the discharge efficiency P.

From this and from the results of the Experiment 14C it can be seen that using a staircase waveform rather than a simple rectangular wave for the write pulses and the first sustain pulses as well as for the set-up and erase pulses improves contrast, reduces the average discharge delay time $Td_{add}$ occurring at the write discharge, and the average discharge delay time $Td_{sus1}$ occurring at the first sustain discharge, and improves the discharge efficiency P.

Fifteenth Embodiment

Figure 47:
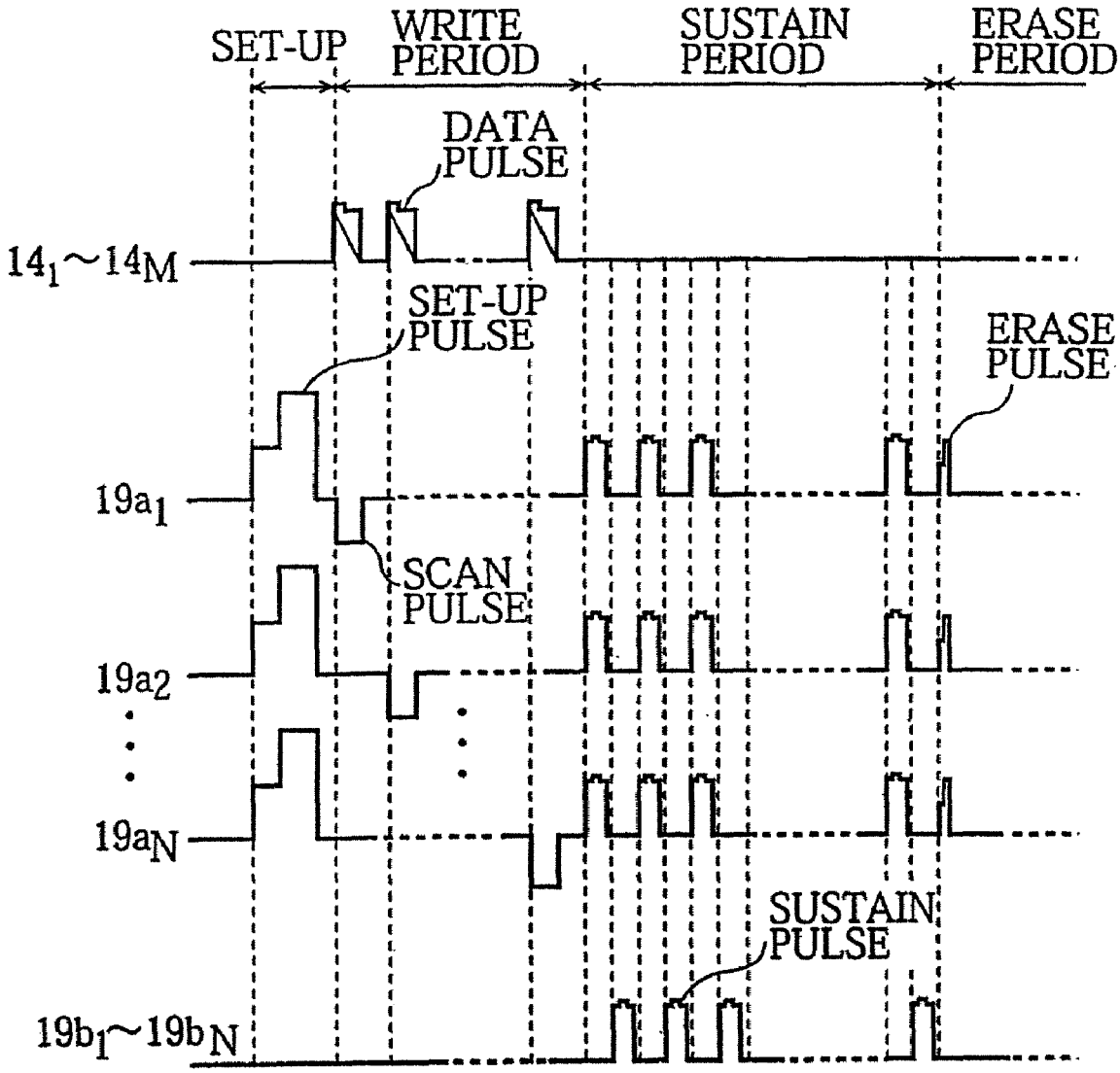
FIG. 47 is a time chart showing a PDP driving method relating to the fifteenth embodiment.

FIG. 47 is a time chart showing a PDP driving method relating to the present embodiment.

In the present embodiment, staircase waveforms are used for the set-up, write, and erase pulses as in the fourteenth embodiment. Staircase waveforms are also used not just for the first, but for all of the sustain pulses.

In the present embodiment, as shown in FIG. 47, a two-step rising staircase waveform is used for the set-up pulses, as in the first embodiment, a two-step falling staircase waveform is used for the data pulses as in the fourth embodiment, a two-step rising and falling staircase waveform is used for the sustain pulses as in the seventh embodiment and a two-step rising staircase waveform is used for the erase pulses as in the eleventh embodiment.

By applying voltage to the combinations of waveforms in each period, contrast can be improved, flickering caused by discharge delay restricted, and high luminous efficiency realized, as explained below.

However, generally speaking, PDP with a higher resolution tend to have lower luminous efficiency. This is most likely due to the fact that smaller discharge cells mean that the wall surface area per each unit of volume in the discharge space is larger, causing the wall surface loss of excitons and charged particles from the discharge gas to increase. PDPs with a higher resolution are also more likely to have a larger amount of impurities such as steam remaining from an evacuation process performed during the manufacturing process. This is most likely due to the fact that reductions in the intervals between the barrier ribs worsen conductance. A large amount of impurities in the discharge gas also tends to increase the starting voltage.

Accordingly, using a simple rectangular wave like the one in the related art to drive a high resolution PDP at high speed makes flicker more likely and driving the PDP in a stable manner is difficult. In the present embodiment, however, a high resolution PDP can be driven stably even at a high speed of around 1.25 μs, enabling driving to be performed stably while displaying a high vision image at full specification.

In a comparatively high resolution PDP, using a staircase waveform for the sustain pulses allows great improvements in luminous efficiency to be obtained. Variations in cell pitch in this kind of PDP produce wide variations in the effect obtained. The reason for this is, that it is difficult to obtain effects by using a staircase waveform in a PDP with wide electrodes as a comparatively large discharge current can be obtained even when using a simple rectangular wave as the sustain pulses. In a PDP with narrow electrodes, however, using a simple rectangular wave as the sustain pulses means that little discharge current is obtained, so using a staircase waveform allows the effects to be more easily produced.

Experiment 15A

The PDP was driven using a staircase waveform for the set-up and erase pulses, and a simple rectangular wave for all the sustain pulses, with a simple rectangular wave and a two-step rising and falling staircase waveform variously used for the write pulses. Cell pitch was set at 360 μm and 140 μm. Relative luminous efficiency η and contrast ratio were measured.

Experiment 15B

The PDP was driven using a staircase waveform for the write pulses as well as for the set-up and erase pulses, and a simple rectangular wave for all the write pulses, with a simple rectangular wave and a two-step rising and falling staircase waveform variously used for the sustain pulses. Cell pitch was set at 360 μm and 140 μm. Relative luminous efficiency η and contrast ratio were measured.

In both Experiments 15A and 15B a contrast ratio of around 400:1 was found to be satisfactory. Table Eleven shows the results of the measurements for relative luminous efficiency η.

TABLE ELEVEN

| | | STAIRCASE SET-UP AND ERASE PULSES | | | |
|---|---|---|---|---|---|
| | | 15A RECTANGULAR SUSTAIN PULSES WRITE PULSE | | 15B STAIRCASE WRITE PULSES SUSTAIN PULSE | |
| | | RECTANGULAR WAVE | STAIRCASE WAVEFORM | RECTANGULAR WAVE | STAIRCASE WAVEFORM |
| CELL PITCH | 360 μm | 1.00 | 1.00 | 1.00 | 1.08 |
| | 140 μm | 0.72 | 0.72 | 0.72 | 0.94 |

From these results it can be seen that a PDP with a cell pitch of 140 μm generally has a lower luminous efficiency than a PDP with a cell pitch of 360 μm.

From the results of Experiment 15A it can be seen that the luminous efficiency does not change whether a simple rectangular wave or a staircase waveform is used for the write pulses. The results of Experiment 15B, however, show that using a staircase waveform for the sustain pulses produces a higher luminous efficiency than if a simple rectangular wave is used.

The results of Experiment 15B further show that using a staircase waveform rather than a simple rectangular wave for the sustain pulses increases luminous efficiency by around 8% in the PDP with the cell pitch of 360 μm and by around 30% in the PDP with the cell pitch of 140 μm. In particular, this reveals that using a staircase waveform for the sustain pulses in a high resolution PDP greatly improves luminous efficiency.

Thus, using the driving method of the present embodiment enables a PDP to be driven at high speed with a high luminous efficiency, allowing high resolution images to be displayed stably.

Additional Information

The present invention obtains improved contrast, image quality and luminous efficiency by using unique waveforms, in particular a staircase waveform, for the set-up, write, sustain and erase pulses, as described above. However, the means of applying pulses to the scan electrodes, sustain electrodes and data electrodes need not be restricted to that described in the above embodiments, provided that such a means can be generally employed when driving a PDP using the ADS method.

For example, in the above embodiments, an example in which the staircase waveform set-up and erase pulses were applied to the scan electrodes 19*a* was described, but the invention can be implemented with the same effects by applying the pulses to the data electrodes 14 and the sustain electrodes 19*b*.

In the above embodiments, a staircase waveform was used for the data pulses applied to the data electrodes 14 as one example of using a staircase waveform for the write pulses, but a staircase waveform may also be used for the scan pulses applied to the scan electrodes 19*a*.

Furthermore, in the discharge sustain period in the above embodiments, an example in which a positive sustain pulse was applied alternately to the scan electrodes 19*a* and the sustain electrodes 19*b* was given. As an alternative, positive and negative sustain pulses may be applied alternately to either the scan electrodes 19*a* or the sustain electrodes 19*b*. In this case using a staircase waveform for the sustain pulses enables the same effects to be achieved.

The panel structure of the PDP also need not be the same as that described in the above embodiments. The driving method of the present invention can also be applied when driving a conventional surface discharge PDP or to an opposing discharge PDP.

POSSIBLE INDUSTRIAL APPLICATION

The PDP driving method and display apparatus relating to the present invention may be used effectively in computer and television displays, and in particular in large scale apparatuses of this type.

The invention claimed is:

1. A plasma display panel driving method for a plasma display panel in which a plurality of discharge cells are arranged, each discharge cell having a first electrode and a second electrode, the plasma display panel driving method comprising:

a set-up step for applying a set-up pulse to the discharge cells;

a write step for applying a write pulse to selected discharge cells of the plurality of discharge cells based on image data input; and a discharge sustain step for applying a sustain pulse to the discharge cells, wherein the sustain pulse applied in the discharge sustain step to the discharge cells is of a positive polarity and has a staircase waveform that rises in at least two steps, and wherein a period when the sustain pulse is applied to the first electrode is not simultaneous with a period when the sustain pulse is applied to the second electrode.

2. The plasma display panel driving method according to claim 1, wherein a first sustain pulse applied during the sustain period is of a positive polarity and has a staircase waveform that rises and falls in at least two steps.

3. A plasma display apparatus comprising:

a plasma display panel that includes a plurality of pairs of display electrodes, a plurality of data electrodes arranged to intersect the display electrodes, and a plurality of discharge cells each formed in a space between the display electrodes and the data electrodes; and a driving circuit operable to drive the plasma display panel by repeating a set-up period of applying a set-up pulse to one of each pair of display electrodes, a write period of applying a write pulse to selected data electrodes of the plurality of data electrodes to write an image, and a discharge sustain period of applying at least one sustain pulse across the pairs of display electrodes after the write step to perform a sustain discharge in discharge cells related to the written image, wherein the driving circuit is operable to apply, during the discharge sustain period, the sustain pulse having a staircase waveform that rises in at least two steps, and wherein a period when the sustain pulse is applied to the first electrode is not simultaneous with a period when the sustain pulse is applied to the second electrode.

4. The plasma display apparatus according to claim 3, wherein a first sustain pulse applied by the driving circuit during the discharge sustain period is of a positive polarity and has a staircase waveform that rises and falls in at least two steps.

5. A plasma display panel driving method for a plasma display panel in which a plurality of discharge cells are arranged, the plasma display panel driving method comprising:

a write step for applying a write pulse to selected discharge cells of the plurality of discharge cells; and a discharge sustain step for applying at least one sustain pulse to the discharge cells, wherein a first sustain pulse applied in the discharge sustain step has a staircase waveform that rises and falls in at least two steps.

6. The plasma display panel driving method according to claim 5, wherein a maximum voltage sustain period of the first sustain pulse is longer than a maximum voltage sustain period of a second sustain pulse at least by 0.1 μs.

7. The plasma display panel driving method according to claim 6, wherein the maximum voltage sustain period of the first sustain pulse is 0.2 μs or longer and constitutes 90% or less of a pulse width PW of the first sustain pulse.

8. A plasma display apparatus comprising:

a plasma display panel including:

a first substrate on which a plurality of pairs of a first electrode and a second electrode are arranged;

a second substrate on which a plurality of third electrodes are arranged, the second substrate facing to the first substrate; and a plurality of discharge cells formed between the first and second substrates and each discharge cell having a first electrode, a second electrode, and a third electrode; and a driving circuit operable to drive the plasma display panel by repeating a write period of applying a write pulse to selected discharge cells of the plurality of discharge cells and a discharge sustain period of applying at least one sustain pulse to the plurality of discharge cells, wherein a first sustain pulse applied in the discharge sustain period by the driving circuit has a staircase waveform that rises and falls in at least two steps.

9. The plasma display apparatus according to claim 8, wherein a maximum voltage sustain period of the first sustain pulse is longer than a maximum voltage sustain period of a second sustain pulse at least by 0.1 μs.

10. The plasma display apparatus according to claim 8, wherein the maximum voltage sustain period of the first sustain pulse is 0.2 μs or longer and constitutes 90% or less of a pulse width PW of the first sustain pulse.

* * * * *

UNITED STATES PATENT AND TRADEMARK OFFICE

CERTIFICATE OF CORRECTION

PATENT NO. : 7,705,807 B2
APPLICATION NO. : 11/927821
DATED : April 27, 2010
INVENTOR(S) : Nobuaki Nagao et al.

It is certified that error appears in the above-identified patent and that said Letters Patent is hereby corrected as shown below:

On the Cover Page of the Patent
The Foreign Priority Data of Japanese Application No. H10-250749 filed on September 4, 1998, Japanese Application No. H10-348072 filed on December 8, 1998, and the PCT application PCT/JP1999/003873 filed on July 19, 1999, published as WO2000/14711 on March 16, 2000, need to be added.

Signed and Sealed this

Seventeenth Day of August, 2010

David J. Kappos

David J. Kappos
*Director of the United States Patent and Trademark Office*